US008690608B2

(12) United States Patent
Naito et al.

(10) Patent No.: US 8,690,608 B2
(45) Date of Patent: Apr. 8, 2014

(54) SPECIAL USB PLUG HAVING DIFFERENT STRUCTURE FROM STANDARD USB PLUG AND USB RECEPTACLE MATABLE WITH THE SPECIAL USB PLUG

(75) Inventors: Takeharu Naito, Tokyo (JP); Masahide Watanabe, Tokyo (JP); Masayuki Katayanagi, Tokyo (JP); Yohei Yokoyama, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 121 days.

(21) Appl. No.: 13/493,337

(22) Filed: Jun. 11, 2012

(65) Prior Publication Data

US 2012/0322282 A1 Dec. 20, 2012

(30) Foreign Application Priority Data

Jun. 20, 2011 (JP) ..... 2011-136795
Sep. 9, 2011 (JP) ..... 2011-197680
Jan. 13, 2012 (JP) ..... 2012-4872
Jan. 23, 2012 (JP) ..... 2012-11339

(51) Int. Cl.
*H01R 24/00* (2011.01)

(52) U.S. Cl.
USPC ..... 439/660; 439/607.01

(58) Field of Classification Search
USPC ..... 439/660, 955, 489, 607.01, 439/607.35–607.4
See application file for complete search history.

(56) References Cited

U.S. PATENT DOCUMENTS 6,059,583 A * 5/2000 Croft et al. ..... 439/131
7,207,836 B2 * 4/2007 Tsai ..... 439/541.5
7,241,157 B2 * 7/2007 Zhuang et al. ..... 439/188
7,537,483 B2 * 5/2009 Lin et al. ..... 439/607.01
7,547,217 B1 * 6/2009 Lin ..... 439/76.1
7,572,146 B1 * 8/2009 Chiang ..... 439/607.01
7,575,454 B1 * 8/2009 Aoki et al. ..... 439/188
7,695,318 B1 * 4/2010 Wang et al. ..... 439/607.01
7,722,407 B2 * 5/2010 Momose ..... 439/638
8,079,879 B2 * 12/2011 Chiang ..... 439/660
8,323,057 B2 * 12/2012 Ho ..... 439/660
8,393,912 B2 * 3/2013 Ko ..... 439/345
8,523,593 B2 * 9/2013 Ko ..... 439/345
8,535,087 B1 * 9/2013 McKee et al. ..... 439/489
2008/0182442 A1 * 7/2008 Choi et al. ..... 439/166
2008/0261448 A1 * 10/2008 Yi et al. ..... 439/607
2009/0061671 A1 * 3/2009 Qin et al. ..... 439/188

(Continued)

FOREIGN PATENT DOCUMENTS

JP 2005-242476 A 9/2005
JP 2009-164087 A 7/2009

*Primary Examiner* — Amy Johnson
*Assistant Examiner* — Vladimir Imas
(74) *Attorney, Agent, or Firm* — Holtz, Holtz, Goodman & Chick, PC

(57) ABSTRACT

A universal serial bus (USB) receptacle with which and from which a standard USB plug and a special USB plug are selectively matable and removable along a predetermined direction. The standard USB plug is in accordance with a USB standard so as to have a standard shell. The special USB plug has a special shell so as to have a different structure from the standard shell. The USB receptacle comprises a detector. The detector has a contact portion. The contact portion is arranged at a position where the standard shell does not arrive when the standard USB plug is mated with the USB receptacle. The special shell is connected to the contact portion at the position when the special USB plug is mated with the USB receptacle.

53 Claims, 45 Drawing Sheets

(56) References Cited

U.S. PATENT DOCUMENTS

2009/0111330 A1* 4/2009 Lin et al. ..... 439/638
2012/0052709 A1* 3/2012 Ko ..... 439/345
2012/0270443 A1* 10/2012 Shih ..... 439/607.01
2013/0225010 A1* 8/2013 Naito ..... 439/676

* cited by examiner

SPECIAL USB PLUG HAVING DIFFERENT STRUCTURE FROM STANDARD USB PLUG AND USB RECEPTACLE MATABLE WITH THE SPECIAL USB PLUG

CROSS REFERENCE TO RELATED APPLICATIONS

Applicants claim priority under 35 U.S.C. §119 of Japanese Patent Applications No. JP2011-136795 filed Jun. 20, 2011, No. JP2011-197680 filed Sep. 9, 2011, No. JP2012-004872 filed Jan. 13, 2012 and No. JP2012-011339 filed Jan. 23, 2012.

BACKGROUND OF THE INVENTION

This invention relates to a connector (universal serial bus (USB) receptacle) matable with at least two types of mating connectors (plugs), wherein the connector comprises a structure to identify the type of the mating connector mated with the connector. Moreover, this invention relates to the USB receptacle (special receptacle) matable with any plug of a USB 3.0 plug in accordance with a USB 3.0 standard, a USB 2.0 plug in accordance with a USB 2.0 standard, and a special plug, wherein the special receptacle comprises a detector to identify whether the mated plug is the special plug or not.

For example, a connector matable with a mating connector is disclosed in JP-A 2005-242476 or JP-A 2009-164087, contents of which are incorporated herein by reference.

The connector of JP-A 2005-242476 is a USB receptacle in accordance with a USB standard so that the USB receptacle is connectable to a USB plug. The USB receptacle of JP-A 2005-242476 is provided with a switch so as to determine whether the USB plug is connected or not. However, the USB receptacle of JP-A 2005-242476 is undetectable the type of the connected USB plug.

The connector of JP-A 2009-164087 is detectable the type of the mating connector. In other words, the connector of JP-A 2009-164087 has a detecting structure to detect the type of the mating connector. However, the connector of JP-A 2009-164087 is not a connector in accordance with a USB standard such as the USB 2.0 standard or the USB 3.0 standard. Moreover, considering the USB standard, it is difficult to apply the detecting structure of the connector of JP-A 2009-164087 to a USB receptacle such as the connector of JP-A 2005-242476.

Nevertheless, it is desired to connect a special USB plug (special plug), which is configured by modifying a standard USB plug in accordance with the USB standard such as the USB 2.0 standard or the USB 3.0 standard, to a USB receptacle (special receptacle) which is connectable to the standard USB plug.

It is also desired that the USB receptacle connected to the special USB plug functions differently from the USB receptacle connected to the standard USB plug. For example, it is desired to supply a large current to the special USB plug while supplying a standard current to the standard USB plug.

Moreover, it is desired to connect the special USB plug to a standard USB receptacle in accordance with the USB standard. In other words, it is desired to avoid that the special USB plug is connectable only to the special receptacle.

SUMMARY OF THE INVENTION

It is therefore an object of the present invention to provide a USB receptacle (special receptacle) which is able to identify or detect whether a connected USB plug is a standard USB plug in accordance with a USB standard such as a USB 2.0 standard or a USB 3.0 standard, or a special USB plug (special plug) other than the standard USB plug. It is also an object of the present invention to provide the special receptacle detectable the special plug even if the special plug has a structure connectable to a standard USB receptacle in accordance with the USB standard.

Moreover, it is an object of the present invention to provide the special plug matable with the aforementioned special receptacle.

One aspect (first aspect) of the present invention provides a universal serial bus (USB) receptacle with which and from which a standard USB plug and a special USB plug are selectively matable and removable along a predetermined direction. The standard USB plug is in accordance with a USB standard so as to have a standard shell. The special USB plug has a special shell so as to have a different structure from the standard USB plug. The USB receptacle comprises a detector. The detector has a contact portion. The contact portion is arranged at a position where the standard shell does not arrive when the standard USB plug is mated with the USB receptacle. The special shell is connected to the contact portion at the position when the special USB plug is mated with the USB receptacle.

Another aspect (second aspect) of the present invention provides a universal serial bus (USB) receptacle with which and from which a standard USB plug and a special USB plug are selectively matable and removable along a predetermined direction. The standard USB plug is in accordance with a USB standard so as to have a standard shell made of a conductive material. The special USB plug has a special shell made of a conductive material. The special shell includes a part having same shape as the standard shell and an identified portion projecting over the part in the predetermined direction so that the special USB plug has a different structure from the standard USB plug. The USB receptacle comprises a plurality of contacts, a holding member made of an insulating material, a shell made of a conductive material and a detector made of a conductive material. Each of the contacts has a contact part. The holding member holds the contacts so that the contacts are arranged in a pitch direction perpendicular to the predetermined direction. The holding member has a body portion. The body portion has a plate-like shape which extends in the predetermined direction while having a thickness in a vertical direction perpendicular to both the predetermined direction and the pitch direction. The contact parts of the contacts are arranged on an upper surface of the body portion. The shell encloses the holding member in a plane perpendicular to the predetermined direction. The shell has a shape which is connectable to the standard shell when the USB receptacle is mated with the standard USB plug and connectable to the special shell when the USB receptacle is mated with the special USB plug. The detector is other than the shell. The detector is held by the holding member so as not to be directly connected to the shell. The detector has a contact portion. The contact portion is arranged at a position where the standard shell does not arrive when the standard USB plug is mated with the USB receptacle. The identified portion of the special shell is connected to the contact portion at the position when the special USB plug is mated with the USB receptacle.

Yet another aspect (third aspect) of the present invention provides the USB receptacle according to the second aspect and further comprising an additional holding member made of an insulating material and a plurality of additional contacts. The additional holding member has a support portion. The additional holding member is installed on the holding member so that the support portion has a plate-like shape extending in the predetermined direction. The support portion is arranged so as to be apart from the body portion in the vertical direction. The support portion is formed with a hole. The hole pierces the support portion in the vertical direction. The additional contacts are held by the additional holding member. Each of the additional contacts is contactable only through the hole of the support portion in a space interposed between the support portion and the body portion.

Yet another aspect (fourth aspect) of the present invention provides a special universal serial bus (USB) plug matable with the USB receptacle according to the third aspect along a predetermined direction. The special USB plug comprises a special holding member, a plurality of standard contacts in accordance with the USB standard, a plurality of special contacts different from the standard contacts and a special shell made of a conductive material. The special holding member has a modified holding portion and an extended portion. The modified holding portion corresponds to a standard holding member of a standard USB plug which is in accordance with the USB standard. The extended portion has a plate-like shape projecting over the modified holding portion in the predetermined so as to have an end surface in the predetermined direction. The extended portion is provided with a thin portion. The thin portion has a small thickness in a vertical direction perpendicular to the predetermined direction. The thin portion extends in the predetermined direction to arrive at the end surface of the extended portion. The standard contacts are configured to be connected to the contacts of the USB receptacle, respectively. The standard contacts are held by the special holding member so as to be arranged on a lower surface of the special holding member in the vertical direction and so as not to arrive at the extended portion in the predetermined direction. The special contacts are configured to be connected to the additional contacts of the USB receptacle, respectively. The special contacts are held and arranged by the special holding member so as to be exposed on an upper surface of the thin portion. The special shell includes a part having same shape as a standard shell of a standard USB plug which is in accordance with the USB standard, a side protrusion projecting over the part in the predetermined direction and a notch. The notch is formed so that the thin portion is visible from above in the vertical direction. The side protrusion protrudes in the predetermined direction so as to cover a side portion of the extended portion in a pitch direction perpendicular to both the predetermined direction and the vertical direction. The side protrusion is connected to the contact portion of the USB receptacle when the special USB plug is mated with the USB receptacle.

Yet another aspect (fifth aspect) of the present invention provides a universal serial bus (USB) receptacle with which and from which a standard USB plug and a special USB plug are selectively matable and removable along a predetermined direction. The standard USB plug is in accordance with a USB standard so as to have a standard shell made of a conductive material. The special USB plug has a special shell made of a conductive material. The special shell includes a part having same shape as the standard shell and an identified portion projecting over the part in the predetermined direction so that the special USB plug has a different structure from the standard shell. The USB receptacle comprises a plurality of contacts, a holding member made of an insulating material, a shell made of a conductive material and a detector made of a conductive material. The holding member holds the contacts so that the contacts are arranged in a pitch direction perpendicular to the predetermined direction. The shell encloses the holding member in a plane perpendicular to the predetermined direction. The shell has a shape which is connectable to the standard shell when the USB receptacle is mated with the standard USB plug and connectable to the special shell when the USB receptacle is mated with the special USB plug. The detector is other than the shell. The detector is held by the holding member so as not to be directly connected to the shell. The detector has a contact portion. The contact portion is arranged at a position where the standard shell does not arrive when the standard USB plug is mated with the USB receptacle. The identified portion of the special shell is connected to the contact portion at the position when the special USB plug is mated with the USB receptacle.

Yet another aspect (sixth aspect) of the present invention provides a universal serial bus (USB) receptacle with which and from which a standard USB plug and a special USB plug are selectively matable and removable along a predetermined direction. The standard USB plug is in accordance with a USB standard. The special USB plug has a different structure from the standard shell. The USB receptacle comprises a plurality of contacts, a holding member made of an insulating material, an additional holding member made of an insulating material, a plurality of additional contacts and a shell made of a conductive material. The holding member holds the contacts so that the contacts are arranged in a pitch direction perpendicular to the predetermined direction. The holding member has a body portion. The body portion has a plate-like shape which extends in the predetermined direction. The contacts are arranged on an upper surface of the body portion. The additional holding member is installed on the holding member in a vertical direction perpendicular to both the predetermined direction and the pitch direction. The additional holding member has a support portion. The support portion has a plate-like shape extending in the predetermined direction. The support portion is arranged above the body portion so as to be apart from the body portion. The support portion is formed with a hole. The hole pierces the support portion in the vertical direction. The additional contacts are held by the additional holding member so that each of the additional contacts has a part located within a space between the support portion and the body portion. The part of the additional contact is connectable only through the hole of the support portion. The shell encloses the holding member and the additional holding member in a plane defined by the vertical direction and the pitch direction.

Yet another aspect (seventh aspect) of the present invention provides a special universal serial bus (USB) plug matable with a USB receptacle, which is matable with a standard USB plug in accordance with a USB standard, along a predetermined direction. The special USB plug is configured by modifying the standard USB plug. The special USB plug comprises a special holding member, a plurality of standard contacts in accordance with the USB standard, a plurality of special contacts different from the standard contacts and a special shell. The special holding member has a modified holding portion and an extended portion. The modified holding portion corresponds to a standard holding member of the standard USB plug. The extended portion has a plate-like shape projecting over the modified holding portion in the predetermined. The extended portion is provided with a thin portion. The thin portion has a small thickness in a vertical direction perpendicular to the predetermined direction. The standard contacts are held by the special holding member so as to be arranged in a pitch direction perpendicular to both the predetermined direction and the vertical direction. The standard contacts are placed on a lower surface of the special holding member in the vertical direction so as not to arrive at the extended portion in the predetermined direction. The standard contacts are held by the special holding member so as to be arranged in the pitch direction. The special contacts are placed so as to be exposed on an upper surface of the thin portion. The special shell encloses the special holding member.

Especially, in order to detect that the special USB plug (special plug) is mated with the USB receptacle (special receptacle) which is matable, in a mating-removing direction (predetermined direction), with any one of a standard USB 2.0 plug (USB 2.0 plug) in accordance with the USB 2.0 standard, a standard USB 3.0 plug (USB 3.0 plug) in accordance with the USB 3.0 standard and the special plug, the following structures may be considered useful: 1) configure the special plug by modifying the USB 2.0 plug or the USB 3.0 plug so that the special plug has a shell (special shell) longer than a shell (standard shell) of the USB 2.0 plug and a shell (standard shell) of the USB 3.0 plug in the predetermined direction; and 2) provide a detector having a contact portion within the special receptacle so that the contact portion is arranged at a position where the USB 2.0 plug or the USB 3.0 plug does not arrive while the special plug is contactable.

Regarding a standard USB 3.0 receptacle (USB 3.0 receptacle) in accordance with the USB 3.0 standard, the inside of the USB 3.0 is formed with a space (first space) where the USB 3.0 plug does not arrive when the USB 3.0 receptacle is mated with the USB 3.0 plug. Moreover, the inside of the USB 3.0 is formed with a space (second space) where the USB 2.0 plug does not arrive when the USB 3.0 receptacle is mated with the USB 2.0 plug. Considering a standard size of the USB standard, the second space is included within the first space. Accordingly, if the USB 3.0 receptacle has a part located within the second space, any of the USB 2.0 plug and the USB 3.0 plug does not arrive at the aforementioned part when mated with the USB 3.0 receptacle.

If the special receptacle is provided with a space (predetermined space) corresponding to the aforementioned second space therewithin, it may be possible to form the detector so that the contact portion is located in the predetermined space. If the contact portion is located in the predetermined space, the special receptacle is matabale with any one of the USB 2.0 plug, the USB 3.0 plug and the special plug while it is possible to detect that the special receptacle is mated not with the USB 2.0 plug or the USB 3.0 plug but with the special plug.

Moreover, if the special shell of the special plug is configured to be accommodated in the predetermined space when the special plug is mated with the special receptacle, it is possible to mate the special plug with the USB 3.0 receptacle.

Regarding a standard USB 2.0 receptacle (USB 2.0 receptacle) in accordance with the USB 2.0 standard, the USB 2.0 plug has plug side contacts (i.e. contacts in accordance with the USB 2.0 standard) each having a contact part. The contact part has a long and thin plate-like shape extending in the predetermined direction. In the predetermined direction, a size of the plate-like contact part is sufficiently larger (i.e. longer) than a size of the predetermined space. Accordingly, in a case where a size of the special shell of the special plug is designed so that the special plug does not pass the predetermined space, it is possible to establish a connection according to the USB 2.0 standard when thus configured special plug is mated with the USB 2.0 receptacle.

As described above, in the case where the special shell is configured so that the special shell is accommodated in the predetermined space when the special plug is mated with the special receptacle, the special plug is matable with any one of the special receptacle, the USB 2.0 receptacle and the USB 3.0 receptacle.

Following aspects of the present invention are based on the studies or the considerations described above. Each of the following aspects of the present invention provides a special receptacle or a special plug as described below.

One aspect (eighth aspect) of the present invention provides a special receptacle matable along a predetermined direction with any one of a USB 3.0 plug which is in accordance with a USB 3.0 standard of a USB standard, a USB 2.0 plug which is in accordance with a USB 2.0 standard of the USB standard and a special plug configured by modifying the USB 3.0 plug so as to have a special shell. The special receptacle comprises a plurality of first contacts, a plurality of second contacts, a holding member, a shell, a predetermined space and a detector. The first contacts are in accordance with the USB 3.0 standard. The second contacts are in accordance with the USB 2.0 standard. The holding member holds the first contacts and the second contacts. The shell is attached to the holding member. The predetermined space is formed within the special receptacle. The predetermined space corresponds to a space, formed within a USB 3.0 receptacle in accordance with the USB 3.0 standard, where the USB 2.0 plug does not arrive when the USB 2.0 plug is mated with the USB 3.0 receptacle. The detector is held by the holding member. The detector has a contact portion. The contact portion is arranged in the predetermined space. The contact portion is configured to be brought into contact with the special shell under a mated state where the special receptacle is mated with the special shell. The detector is configured to detect that the special plug is mated with the special receptacle when the special shell is brought into contact with the contact portion.

As can be seen from the previously described description, the special receptacle according to the eighth aspect of the present invention also may be a modification of the USB receptacle according to the first aspect of the present invention. More specifically, the eighth aspect also provides the USB receptacle, which is the USB receptacle according to the first aspect, matable along the predetermined direction with any one of a USB 3.0 plug which is the standard USB plug in accordance with a USB 3.0 standard of the USB standard, a USB 2.0 plug which is the standard USB plug in accordance with a USB 2.0 standard of the USB standard and the special USB plug configured by modifying the USB 3.0 plug so as to have the special shell. The USB receptacle comprises a plurality of first contacts, a plurality of second contacts, a holding member, a shell, a predetermined space and the detector. The first contacts are in accordance with the USB 3.0 standard. The second contacts are in accordance with the USB 2.0 standard. The holding member holds the first contacts and the second contacts. The shell is attached to the holding member. The predetermined space is formed within the USB receptacle. The predetermined space corresponds to a space, formed within a USB 3.0 receptacle in accordance with the USB 3.0 standard, where the USB 2.0 plug does not arrive when the USB 2.0 plug is mated with the USB 3.0 receptacle. The detector is held by the holding member. The detector has the contact portion. The contact portion is arranged in the predetermined space. The contact portion is configured to be brought into contact with the special shell under a mated state where the USB receptacle is mated with the special shell. The detector is configured to detect that the special USB plug is mated with the USB receptacle when the special shell is brought into contact with the contact portion.

Another aspect (ninth aspect) of the present invention provides a universal serial bus (USB) receptacle matable along a predetermined direction with any one of a USB 3.0 plug which is in accordance with a USB 3.0 standard of a USB standard, a USB 2.0 plug which is in accordance with a USB 2.0 standard of the USB standard and a special plug formed by modifying the USB 2.0 plug or the USB 3.0 plug so as to have a special shell. The special receptacle comprises a plurality of contacts, a holding member, a shell, a predetermined space and a detector. the holding member holds the contacts. The shell is attached to the holding member. The predetermined space is formed within the special receptacle. The predetermined space corresponding to a space, formed within a USB 3.0 receptacle in accordance with the USB 3.0 standard, where the USB 2.0 plug does not arrive when the USB 2.0 plug is mated with the USB 3.0 receptacle. The detector is held by the holding member. The detector has a contact portion. The contact portion is arranged in the predetermined space. The contact portion is configured to be brought into contact with the special shell under a mated state where the special receptacle is mated with the special shell. The detector is configured to detect that the special plug is mated with the special receptacle when the special shell is brought into contact with the contact portion.

As can be seen from the previously described description, the special receptacle according to the ninth aspect of the present invention also may be a modification of the USB receptacle according to the first aspect of the present invention. More specifically, the ninth aspect also provides the USB receptacle, which is the USB receptacle according to the first aspect, matable along the predetermined direction with any one of a USB 3.0 plug which is the standard USB plug in accordance with a USB 3.0 standard of the USB standard, a USB 2.0 plug which is the standard USB plug in accordance with a USB 2.0 standard of the USB standard and the special USB plug formed by modifying the USB 2.0 plug or the USB 3.0 plug so as to have the special shell. The USB receptacle comprises a plurality of contacts, a holding member, a shell, a predetermined space and the detector. The holding member holds the contacts. The shell is attached to the holding member. The predetermined space is formed within the USB receptacle. The predetermined space corresponds to a space, formed within a USB 3.0 receptacle in accordance with the USB 3.0 standard, where the USB 2.0 plug does not arrive when the USB 2.0 plug is mated with the USB 3.0 receptacle. The detector is held by the holding member. The detector has the contact portion. The contact portion is arranged in the predetermined space. The contact portion is configured to be brought into contact with the special shell under a mated state where the USB receptacle is mated with the special shell. The detector being configured to detect that the special USB plug is mated with the USB receptacle when the special shell is brought into contact with the contact portion.

Yet another aspect (tenth aspect) of the present invention provides a special plug matable with the special receptacle according to the eighth or ninth aspect in a predetermined direction. The special plug comprises a special shell. The special shell is configured to be accommodated in the predetermined space when the special receptacle is mated with the special shell.

As can be seen from the previously described description, the tenth aspect of the present invention provides a special universal serial bus (USB) plug matable with the USB receptacle according to the eighth or ninth aspect in a predetermined direction. The special USB plug comprises a special shell. The special shell is configured to be accommodated in the predetermined space when the special USB receptacle is mated with the special shell.

An appreciation of the objectives of the present invention and a more complete understanding of its structure may be had by studying the following description of the preferred embodiment and by referring to the accompanying drawings.

Figure 1:
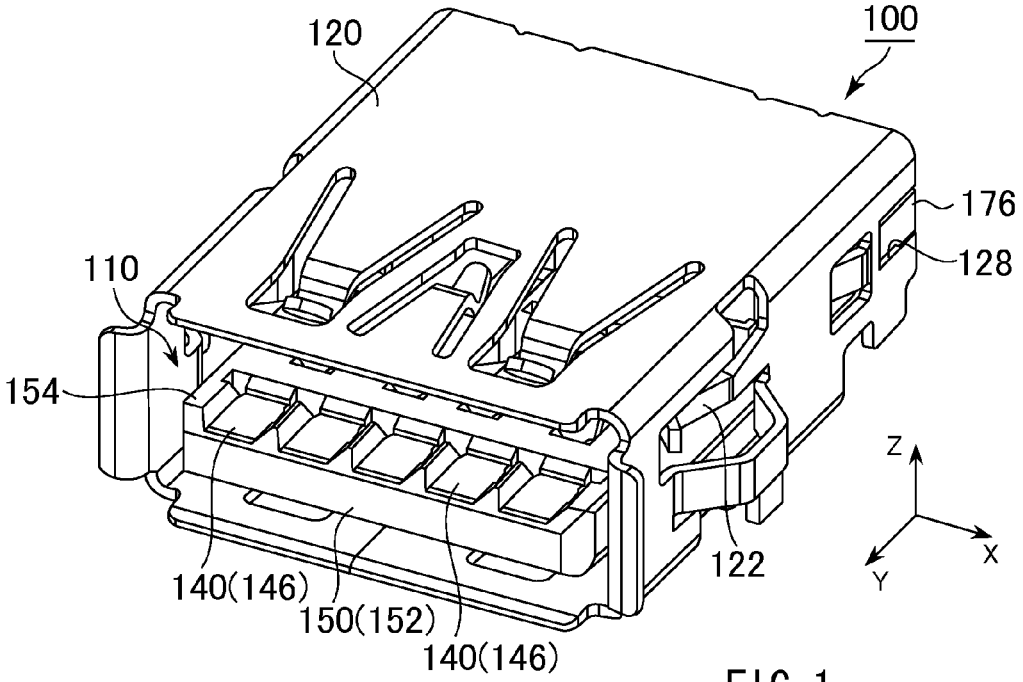
FIG. 1 is a perspective view showing a USB receptacle according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Hereinafter, it is described in detail about a universal serial bus (USB) receptacle and a USB plug according to the embodiments of this invention while referring to Figures.

The First Embodiment

Figure 2:
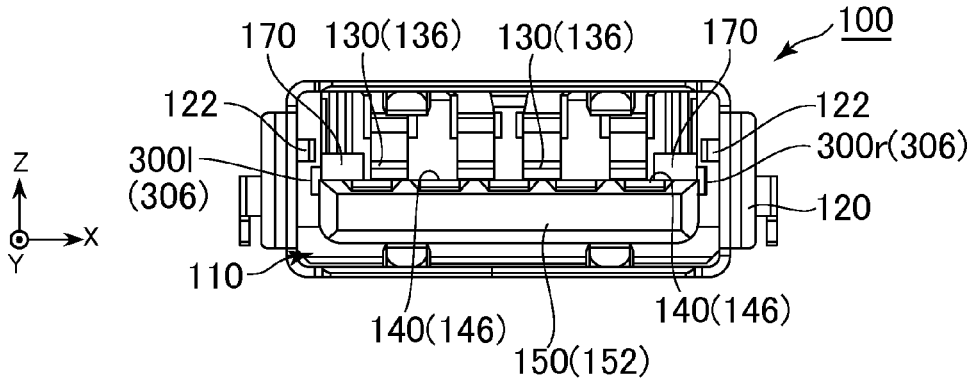
FIG. 2 is a front view showing the USB receptacle of FIG. 1.
Figure 3:
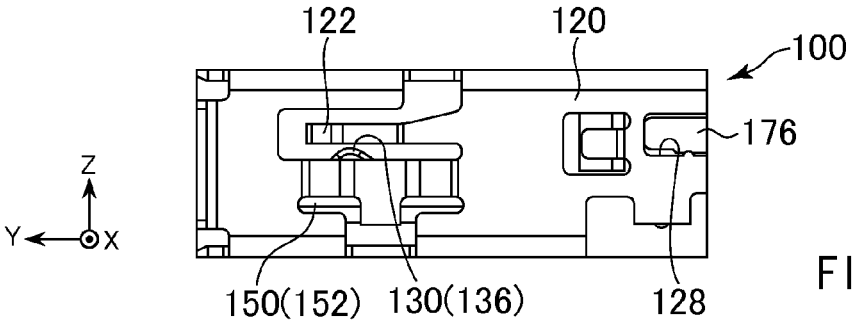
FIG. 3 is a side view showing the USB receptacle of FIG. 1.

Referring to FIGS. 1 to 3, a USB receptacle 100 according to the first embodiment of the present invention is configured to be attached to a circuit board (not shown). The USB receptacle 100 is configured so that a special USB plug 500, a standard USB plug 400, a special USB plug 500*x* and a special USB plug 500*y* shown in FIGS. 4 and 6 to 8 are selectively matable with and removal from the USB receptacle 100 along the Y-direction (predetermined direction). Especially, as described later, the USB receptacle 100 according to the present embodiment is detectable whether a mated USB plug (i.e. mating plug) is the special USB plug 500 (see FIGS. 4 and 5) or the standard USB plug 400 (see FIG. 6). The USB receptacle 100 is further able to detect the special USB plug 500*x* (see FIG. 7) and the special USB plug 500*y* (see FIG. 8) in some detecting methods. Hereinafter, in the first place, it is described about structures of the standard USB plug 400 and the special USB plug 500 each configured to be connected to the USB receptacle 100. Then, it is described about structures of the USB receptacle 100.

Figure 6:
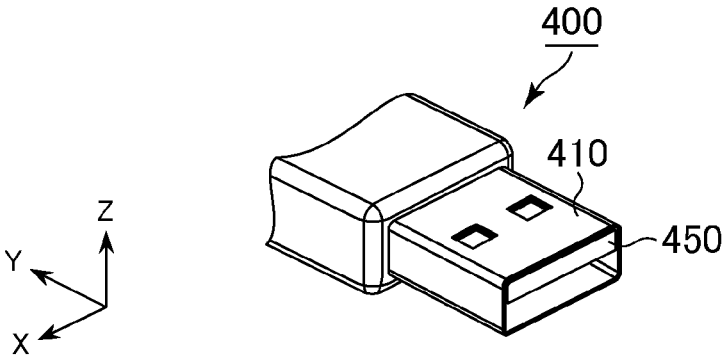
FIG. 6 is a perspective view showing a standard USB plug which is matable with the USB receptacle of FIG. 1.

As shown in FIG. 6, the standard USB plug 400 is a USB plug in accordance with a USB 3.0 standard (i.e. a USB standard). The standard USB plug 400 comprises a plurality of contacts and other members in accordance with the USB 3.0 standard. More specifically, the standard USB plug 400 comprises a plurality of contacts (not shown) for a USB 2.0 connection, a plurality of contacts (not shown) for a USB 3.0 connection, a standard holding member 450 made of an insulating material and a standard shell 410 made of a conductive material. The standard holding member 450 holds the contacts for the USB 2.0 connection and the contacts for the USB 3.0 connection. The standard shell 410 covers the standard holding member 450. Each of the standard holding member 450 and the standard shell 410 has a size in accordance with the USB 3.0 standard.

Figure 4:
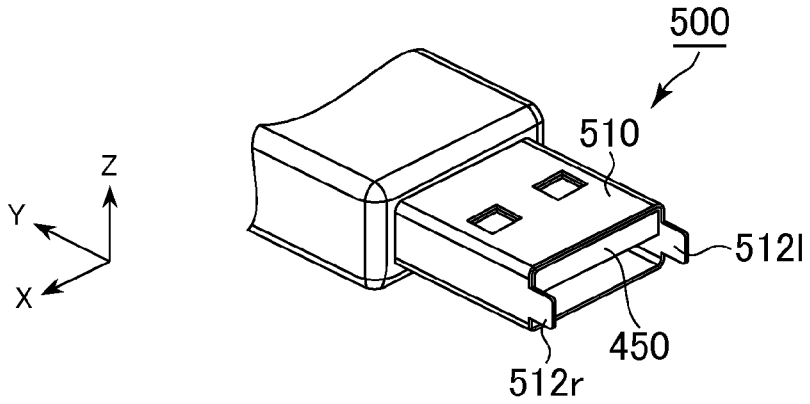
FIG. 4 is a perspective view showing a special USB plug which is matable with the USB receptacle of FIG. 1.
Figure 5:
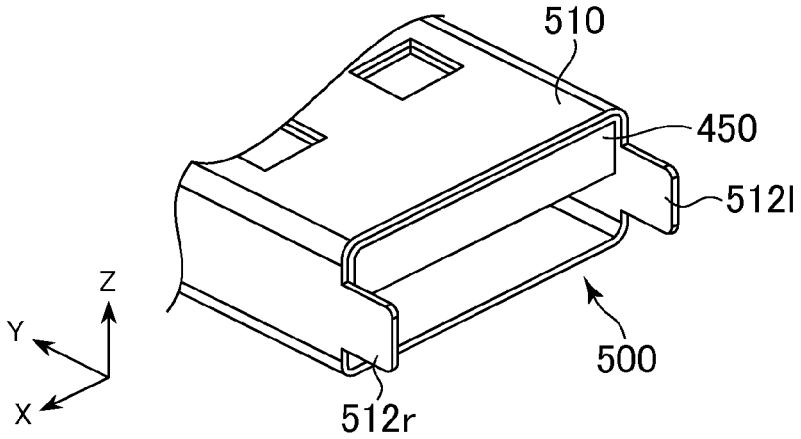
FIG. 5 is a partially enlarged, perspective view showing in the vicinity of a leading end of the special USB plug of FIG. 4.

Referring to FIGS. 4 and 5, the special USB plug 500 according to the present embodiment is configured similar to the standard USB plug 400. More specifically, the special USB plug 500 comprises a plurality of the contacts (not shown) for the USB 2.0 connection, a plurality of the contacts (not shown) for the USB 3.0 connection, the standard holding member 450 and a special shell 510 made of a conductive material. The special shell 510 covers the standard holding member 450. The special shell 510 has a similar, but different, shape and size to the standard shell 410. In detail, the special shell 510 has two identified portions 512*r* and 512*l* (i.e. a first identified portion 512*r* and a second identified portion 512*l*) so as to have a different shape and size from the standard shell 410. The first identified portion 512*r* and the second identified portion 512*l* protrude in the negative Y-direction from both ends in the X-direction (pitch direction) of the special shell 510, respectively. The special shell 510 according to the present embodiment has the same size as the standard shell 410 except the first identified portion 512*r* and the second identified portion 512*l*. In detail, the whole special shell 510 is larger (i.e. longer) than the standard shell 410 in the Y-direction (predetermined direction) by the size of the first identified portion 512*r* or the second identified portion 512*l*. As described above, the special USB plug 500 has the special shell 510 so as to have a different structure from the standard USB plug 400. More specifically, the special shell 510 includes a part having the same shape as the standard shell 410, and the identified portion 512*r* and 512*l* projecting over the part in the Y-direction so that the special USB plug 500 has a different structure from the standard USB plug 400.

Figure 7:
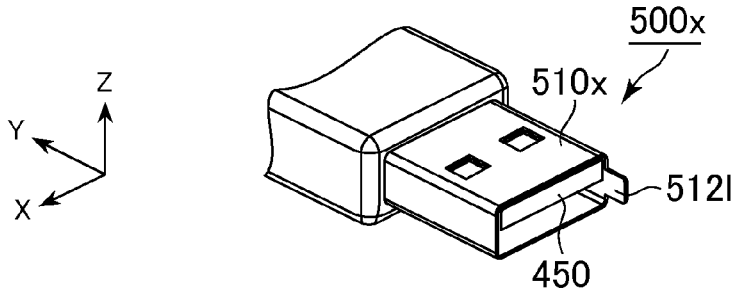
FIG. 7 is a perspective view showing another special USB plug which is matable with the USB receptacle of FIG. 1.
Figure 8:
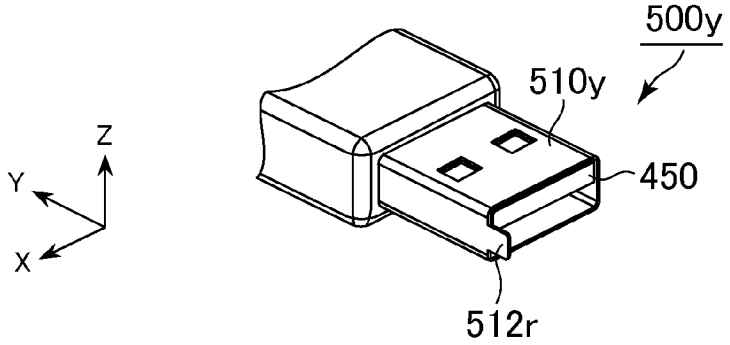
FIG. 8 is a perspective view showing yet another special USB plug which is matable with the USB receptacle of FIG. 1.

As can be seen from FIGS. 4, 7 and 8, each of the special USB plug 500*x* and the special USB plug 500*y* is formed by modifying only the special shell 510 of the special USB plug 500. In detail, the special USB plug 500*x* shown in FIG. 7 has a special shell 510*x*. The special shell 510*x* has the second identified portion 512*l*. However, the special shell 510*x* does not have the first identified portion 512*r*. The special USB plug 500*y* shown in FIG. 8 has a special shell 510*y*. The special shell 510*y* has the first identified portion 512*r*. However, the special shell 510*y* does not have the second identified portion 512*l*. As can be seen from the above description, the USB receptacle 100 according to the present embodiment is detectable three types of special USB plugs at most, namely the special USB plug 500 which has both the first identified portion 512*r* and the second identified portion 512*l*, the special USB plug 500*y* which has only the first identified portion 512*r*, and the special USB plug 500*x* which has only the second identified portion 512*l*.

As shown in FIGS. 1 and 2, the USB receptacle 100 according to the present embodiment comprises a connector body 110, a positioner 320 (see FIG. 9) made of an insulating material and a shell 120 made of a conductive material. The shell 120 encloses the connector body 110 and the positioner 320 in a plane perpendicular to the Y-direction (predetermined direction).

The shell 120 according to the present embodiment roughly has a rectangular cube-like shape. In other words, the shell 120 has a rectangular cross-section in a plane perpendicular to the Y-direction (predetermined direction). The rectangular cross-section of the shell 120 has a long side in the X-direction (pitch direction) and a short side in the Z-direction (vertical direction). The shell 120 is formed with shell-side connecting portions 122 on both side surfaces thereof, respectively. The shell-side connecting portion 122 is configured to be connected to the standard shell 410 or the special shell 510 when the USB receptacle 100 is mated with the standard USB plug 400 or the special USB plug 500. In other words, the shell 120 is electrically connected with the standard shell 410 or the special shell 510 when the USB receptacle 100 is mated with the standard USB plug 400 or the special USB plug 500. The shell 120 is provided with attached portions 128 at rear ends (i.e. ends in the negative Y-direction) of the both side surfaces thereof, respectively. The attached portion 128 is a notch which is cut forward (i.e. cut along the positive Y-direction). In other words, the attached portion 128 is depressed forward. As described later, the attached portion 128 is used when the shell 120 is attached to the connector body 110.

Figure 9:
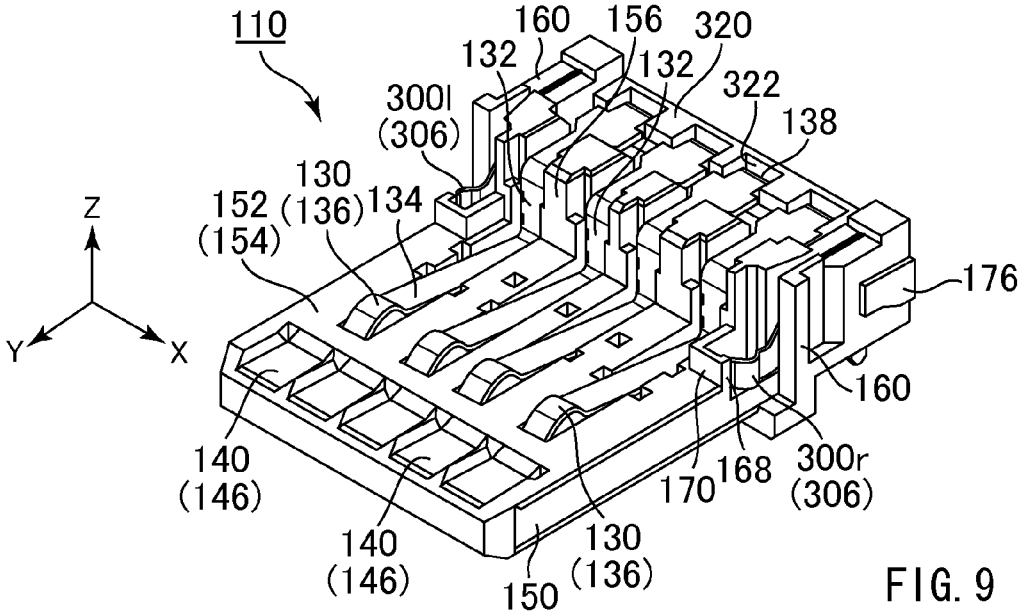
FIG. 9 is a perspective view showing a connector body of the USB receptacle of FIG. 1.
Figure 10:
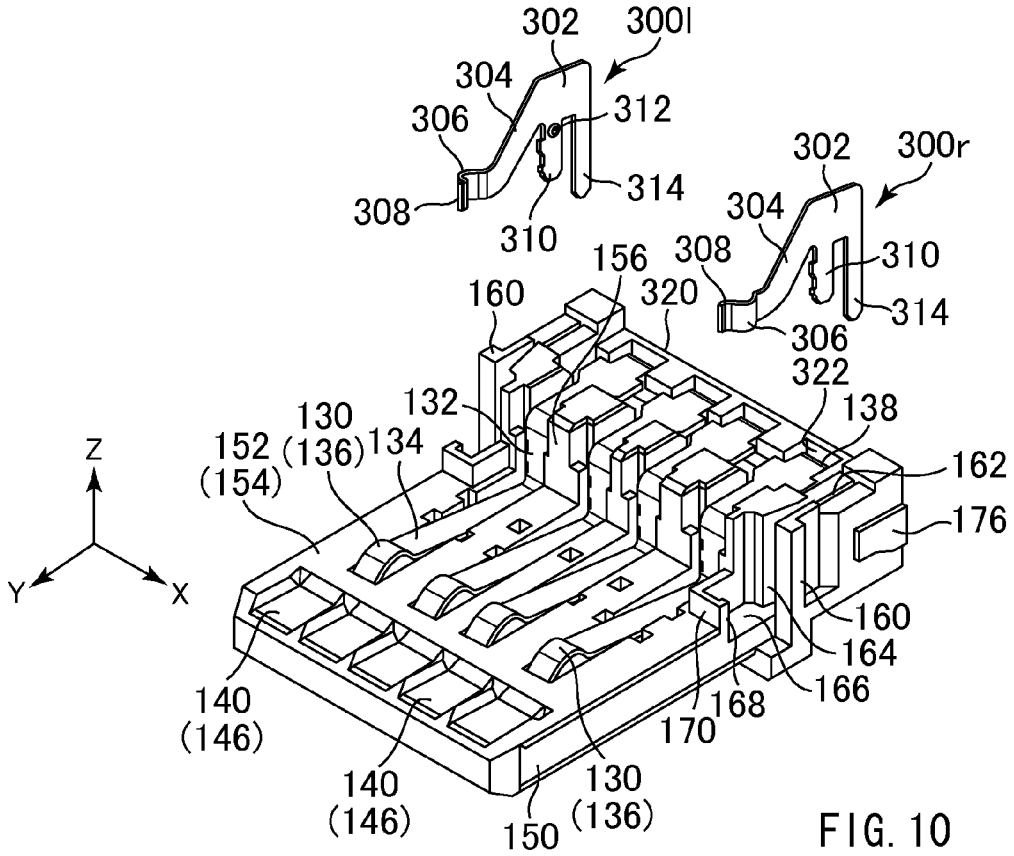
FIG. 10 is a perspective view showing the connector body of FIG. 9, wherein a first detector and a second detector are detached from the connector body.
Figure 11:
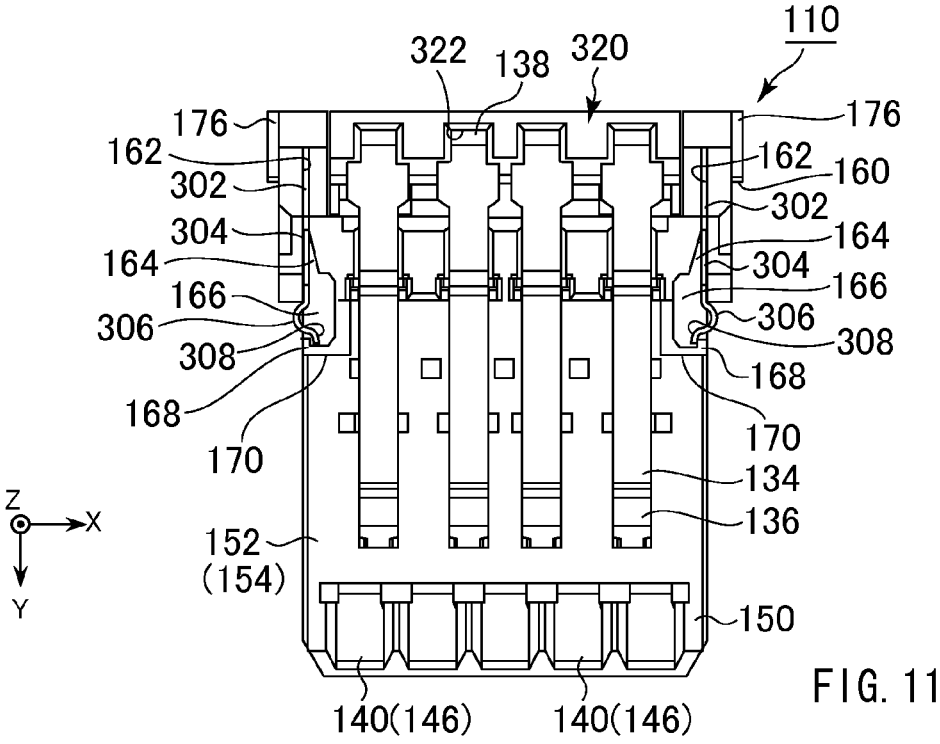
FIG. 11 is a top view showing the connector body of FIG. 9.
Figure 17:
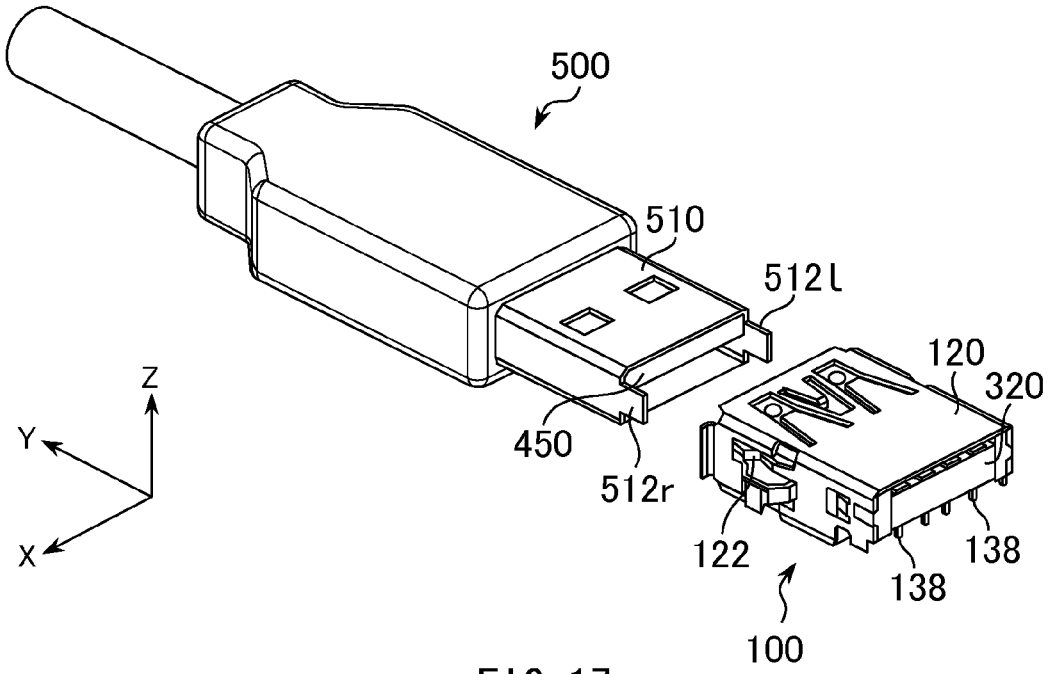
FIG. 17 is a perspective view showing the USB receptacle of FIG. 1 and the special USB plug of FIG. 4 in the unmated state.
Figure 18:
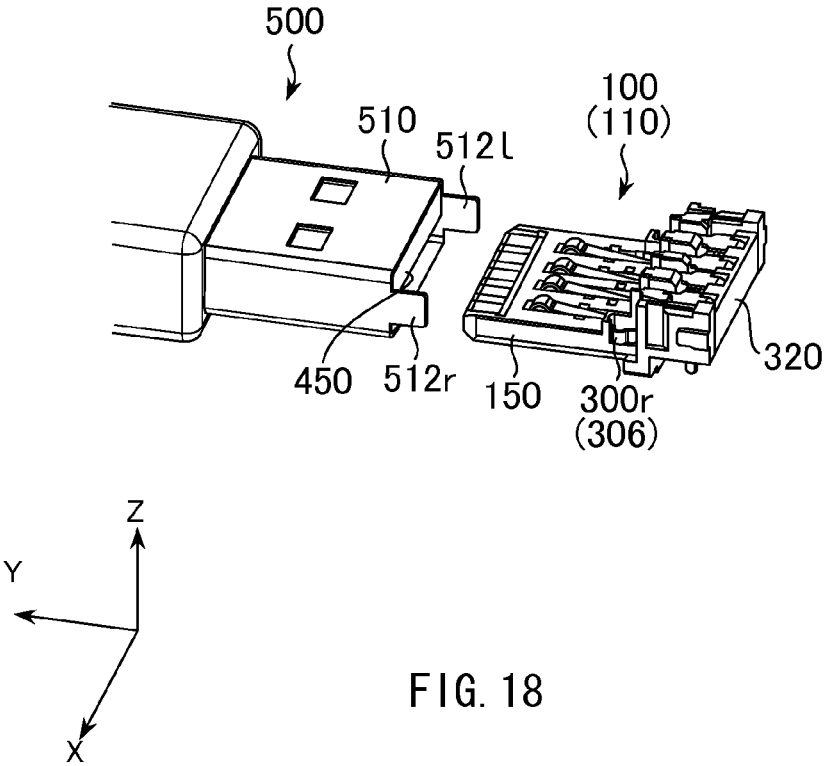
FIG. 18 is a perspective view showing the USB receptacle (the connector body) and the special USB plug of FIG. 16.
Figure 19:
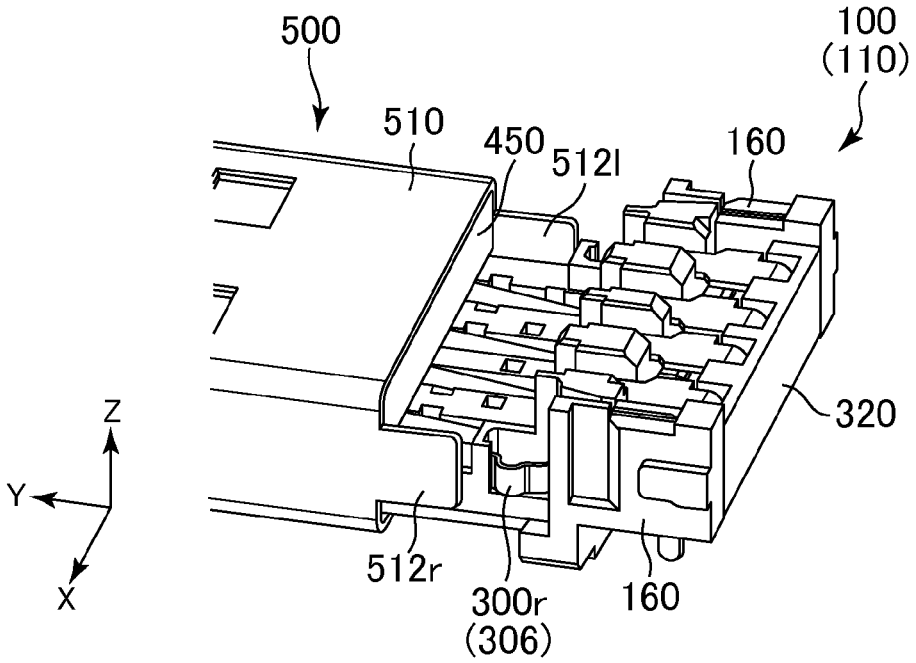
FIG. 19 is a perspective view showing the USB receptacle of FIG. 1 (the connector body of FIG. 9) and the special USB plug of FIG. 4 in a partially inserted state where the special USB plug is partially inserted in the USB receptacle while the USB receptacle and the special USB plug are unmated, wherein the shell of the USB receptacle is not illustrated.

As shown in FIGS. 9 to 12, the connector body 110 (i.e. the USB receptacle 100) comprises a plurality of contacts 130 each made of a conductive material, a plurality of contacts 140 each made of a conductive material, a holding member 150 made of an insulating material, a first detector (detector) 300*r* made of a conductive material and a second detector (detector) 300*l* made of a conductive material. The holding member 150 holds the contacts 130 and 140. The contacts 130 are for the USB 2.0 connection. Accordingly, the USB receptacle 100 has four contacts 130. The contacts 140 are for the USB 3.0 connection. Accordingly, the USB receptacle 100 has five contacts 140. Each of the contacts 130 has a held portion 132, a spring portion 134, a contact part 136 and a fixed portion 138. The held portion 132 is held by the holding member 150. The spring portion 134 extends obliquely forward from the held portion 132. The contact part 136 is provided at a leading end of the spring portion 134. The fixed portion 138 is configured to be fixed to the circuit board (not shown) on which the USB receptacle 100 is mounted (see FIGS. 9 and 17). According to the present embodiment, the holding member 150 holds the contacts 130 so that the contacts 130 are arranged in the X direction. In detail, as shown in FIGS. 9 to 11, the positioner 320 is provided with positioning holes 322 corresponding to the respective contacts 130. The fixed portions 138 are inserted in the respective positioning holes 322 so as to be arranged properly. Each of the contacts 140 has a contact part 146 and a fixed portion (not shown). According to the present embodiment, the holding member 150 holds the contacts 140 so that the contacts 140 are arranged in the X direction. In detail, the positioner 320 is provided with positioning holes (not shown) corresponding to the respective contacts 140. The fixed portions of the contacts 140 are inserted in the respective positioning holes so as to be arranged properly.

Referring to FIGS. 9 to 12, the holding member 150 comprises a body portion 152, a contact-holding portion 156 and side portions 160. The body portion 152 has a plate-like shape which extends in the Y-direction (predetermined direction) while having a thickness in the Z-direction (vertical direction). The contact-holding portion 156 is located at a rear side (i.e. negative Y-side) of the body portion 152. The side portions 160 are located at both ends of the holding member 150 in the X-direction (pitch direction).

Referring to FIGS. 9 to 11, the held portion 132 of the contact 130 is press-fitted downward (i.e. along the negative Z-direction) in the contact-holding portion 156 of the holding member 150 so that the contacts 130 are held and arranged by the holding member 150 in the X-direction. The body portion 152 has an upper surface 154. The contact parts 136 are arranged on the upper surface 154 of the body portion 152 so as to protrude partially. The spring portion 134 of the contact 130 is resiliently deformable so that the contact part 136 is movable mainly in the Z-direction (vertical direction).

Referring to FIGS. 9 to 11, the contacts 140 are insert-molded in the holding member 150 when the holding member 150 is formed. The contacts 140 are embedded in the holding member 150 so as to be held and arranged in the X-direction by the holding member 150. The contact parts 146 of the contacts 140 are arranged on the upper surface 154 of the body portion 152. As can be seen from FIG. 11, as compared with the contact part 136 of the contact 130, the contact part 146 of the contact 140 is located at a position nearer to a front end (i.e. positive Y-side end) of the body portion 152. In other words, the contact part 146 of the contact 140 is located between the contact part 136 of the contact 130 and the front end of the body portion 152 in the Y-direction.

Figure 12:
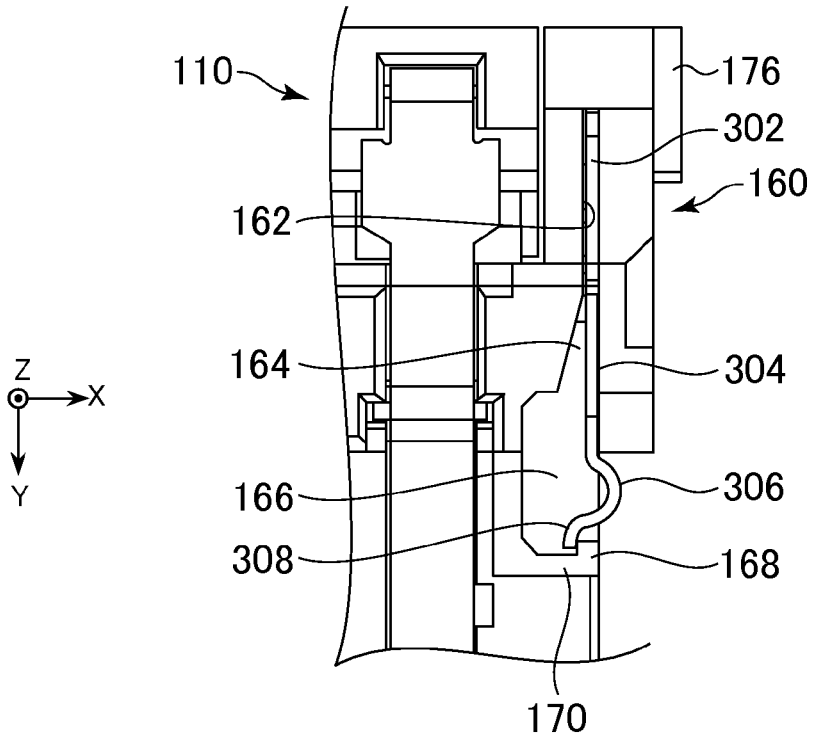
FIG. 12 is a partially enlarged, perspective view showing in the vicinity of a side portion of a holding member of the connector body of FIG. 11.

As shown in FIGS. 10 to 12, each of the side portions 160 of the holding member 150 is formed with a detector-holding portion 162, a deformable region 164, a movable region 166, a regulating portion 168, a guard portion 170 and an attaching portion 176. The detector-holding portion 162 is a ditch which extends in a direction perpendicular to the X-direction (i.e. in a vertical plane perpendicular to the X-direction) so as to be formed with an inside wall. The detector-holding portion 162 partially extends to a bottom surface of the holding member 150 so as to pierce the holding member 150. The deformable region 164 is located forward of the detector-holding portion 162 (i.e. extends in the positive Y-direction from the detector-holding portion 162). The movable region 166 is located forward of the deformable region 164 (i.e. extends in the positive Y-direction from the deformable region 164). In other words, the deformable region 164 is formed to be located between the detector-holding portion 162 and the movable region 166 in the Y-direction. A size in the X-direction of the deformable region 164 is designed so as to become larger as being nearer to the movable region 166. In detail, the deformable region 164 has a variable size in the X-direction. The deformable region 164 is formed so that the variable size at a predetermined position in the Y-direction becomes larger as the predetermined position is nearer to the movable region 166 (i.e. as the predetermined position moves from the detector-holding portion 162 toward the Y-side end of the holding member 150). As can be seen from FIG. 12, the deformable region 164 according to the present embodiment is defined by two walls. One of the two walls is oblique to both the X-direction and the Y-direction. The movable region 166 is a space which has a larger size than the deformable region 164 in the X-direction. The movable region 166 communicates with an outside of the holding member 150 in the X-direction. Each of the regulating portion 168 and the guard portion 170 is located in the vicinity of a front end (i.e. positive Y-side end) of the movable region 166. The regulating portion 168 is a wall slightly extending in the Y-direction. The regulating portion 168 is located outward in the X-direction of the front end (i.e. positive Y-side end) of the movable region 166. The guard portion 170 is a wall extending perpendicular to the Y-direction. The guard portion 170 is located forward of the movable region 166 (i.e. located at the positive Y-side edge of the movable region 166). According to the present embodiment, a part consisting of the regulating portion 168 and the guard portion 170 has an L-like shape in a plane perpendicular to the Z-direction.

As shown in FIG. 9, the attaching portion 176 is located at a rear end (i.e. negative Y-side end) of the side portion 160. The attaching portion 176 protrudes outward in the X-direction from the side portion 160. The attaching portion 176 has a plate-like shape extending forward (i.e. along the positive Y-direction). As shown in FIGS. 1 and 9, the attached portion 128 of the shell 120 is fitted with the attaching portion 176 rearward (i.e. along the negative Y-direction) so that the shell 120 is attached to the holding member 150.

Figure 13:
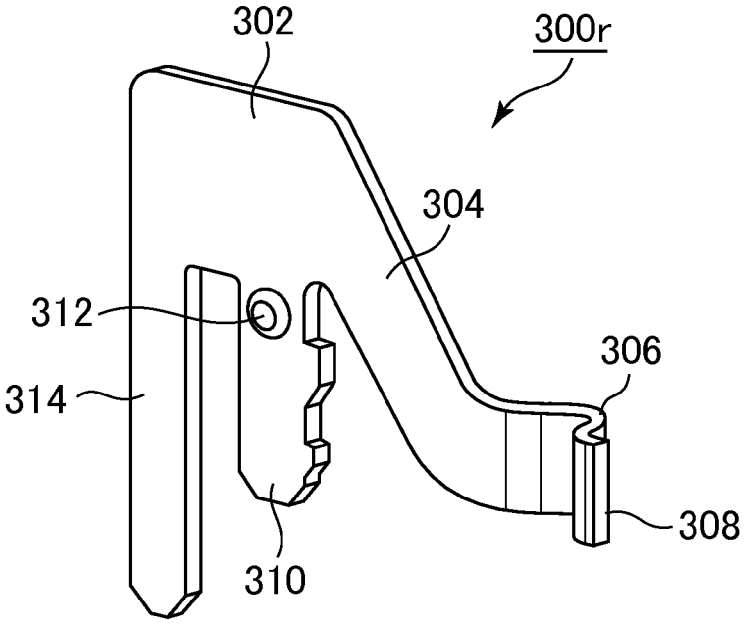
FIG. 13 is a perspective view showing the first detector included in the connector body of FIG. 9.
Figure 14:
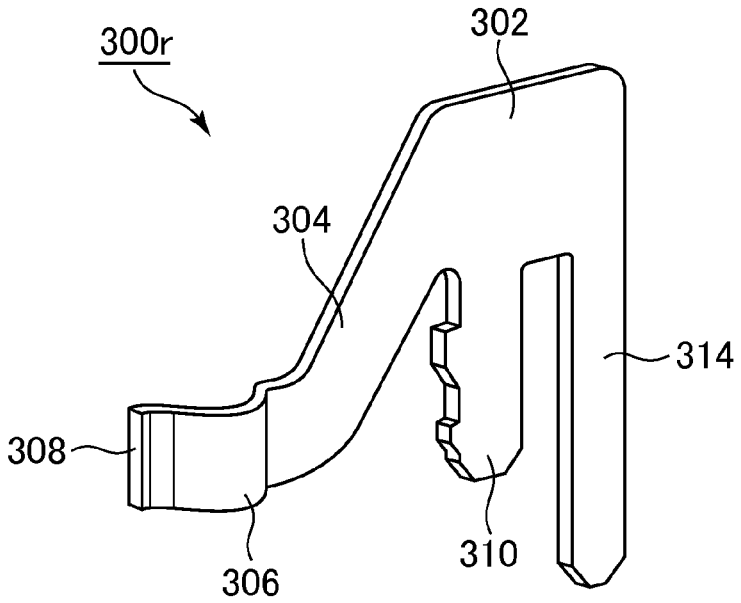
FIG. 14 is another perspective view showing the first detector of FIG. 13.
Figure 15:
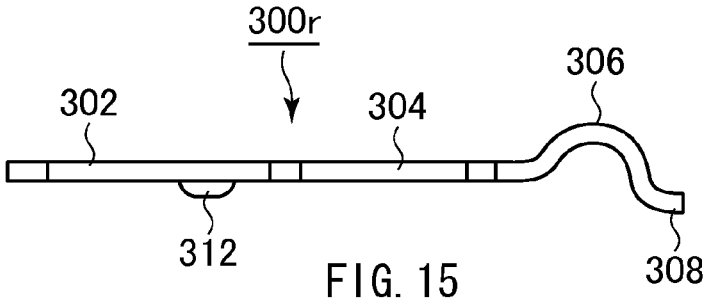
FIG. 15 is a top view showing the first detector of FIG. 13.
Figure 16:
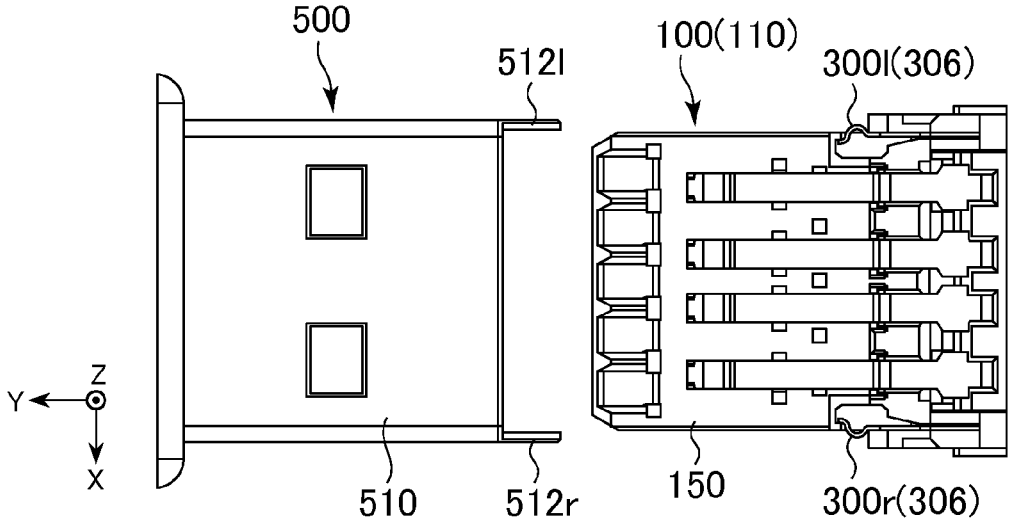
FIG. 16 is a top view showing the USB receptacle of FIG. 1 (the connector body of FIG. 9) and the special USB plug of FIG. 4 in an unmated state where the USB receptacle and the special USB plug are unmated, wherein a shell of the USB receptacle is not illustrated.

As shown in FIG. 10, the first detector 300*r* and the second detector 300*l* have shapes which are mirror images with each other in the X-direction. As shown in FIGS. 13 to 15, the first detector 300*r* has a held portion 302, a spring portion 304, a contact portion 306, a regulated portion 308, a press-fit post 310 and a mounted post (soldered portion) 314. The held portion 302 has a flat board-like shape. The spring portion 304 extends obliquely from the held portion 302 so as to be resiliently deformable. The contact portion 306 is formed on a leading end of the spring portion 304. The regulated portion 308 is formed on a leading end of the contact portion 306 of the spring portion 304. Each of the press-fit post 310 and the mounted post 314 extends from the held portion 302. The held portion 302, the spring portion 304, the press-fit post 310 and the mounted post 314 form a common plane. More specifically, each of the held portion 302, the spring portion 304, the press-fit post 310 and the mounted post 314 extends in the vertical plane (see FIG. 10). Accordingly, the first detector 300*r* is formed so as to have minimum curves. A thickness (i.e. a size in the X-direction) of each of the held portion 302 and the spring portion 304 according to the present embodiment is smaller than a size of the detector-holding portion 162 in the X-direction. The contact portion 306 has a curved surface which protrudes from the common plane formed by the held portion 302, etc. The mounted post 314 is soldered on a circuit board (not shown) to be connected to a conductive pattern (not shown) on the circuit board when the USB receptacle 100 is mounted on and fixed to the circuit board. The press-fit post 310 (i.e. the first detector 300*r*) is formed with a protrusion 312. The second detector 300*l* is configured similar to the first detector 300*r*.

As shown in FIGS. 10 to 12, the first detector 300*r* and the second detector 300*l* is held by the right side portion 160 (i.e. the side portion 160 located at the positive X-side of the holding member 150) and the left side portion 160 (i.e. the side portion 160 located at the negative X-side of the holding member 150) so that the contact portion 306 is movable mainly in the X-direction (i.e. in the horizontal plane perpendicular to the Z-direction).

In detail, as shown in FIGS. 9 to 12, the mounted post 314 and the press-fit post 310 of each of the first detector 300*r* and the second detector 300*l* are inserted into the side portion 160 along the negative Z-direction from above so that the held portion 302 is held in the detector-holding portion 162. In detail the press-fit post 310 is press-fitted in the side portion 160 of the holding member 150. The press-fit post 310 is provided with the protrusion 312 so that the held portion 302 is pressed against an inner wall of the detector-holding portion 162 when the press-fit post 310 is inserted. Accordingly, a fixed end of a spring of the detector (i.e. each of the first detector 300*r* and the second detector 300*l*) is fixed distinctly so that it is possible to obtain the spring force as designed. Especially, according to the present embodiment, the protrusion 312 is provided on the press-fit post 310. In other words, the protrusion 312 is provided in the vicinity of a press-fitted portion. According to the present embodiment, the detector (i.e. each of the first detector 300*r* and the second detector 300*l*) is positioned in the X-direction by the protrusion 312 almost at the same time that the detector (i.e. each of the first detector 300*r* and the second detector 300*l*) is press-fitted into the side portion 160 of the holding member 150. Therefore, it is possible to properly press the held portion 302 against the inner wall of the detector-holding portion 162.

As shown in FIG. 11, the deformable region 164 is located inward in the X-direction of the spring portion 304 in a state where the first detector 300*r* and the second detector 300*l* are attached to the respective side portions 160 (i.e. a state where the held portion 302 is properly pressed against the inner wall of the detector-holding portion 162). Accordingly, the spring portion 304 is resiliently deformable inward in the X-direction. In other words, the deformable region 164 is configured so that the spring portion 304 is deformable in the deformable region 164.

As can be seen from FIGS. 9 and 10, the spring portion 304 extends from the held portion 302 in a direction defined by the positive Y-direction and the negative Z-direction (i.e. extends forward and obliquely downward) in a state where the first detector 300*r* and the second detector 300*l* are attached to the respective side portions 160. In other words, the spring portion 304 extends in a direction oblique to both the Z-direction and the Y-direction. It is possible that the spring portion 304 has a long spring length by configuring as described above. In addition, as shown in FIGS. 11 and 12, the deformable region 164 is provided between the detector-holding portion 162 and the movable region 166 so that it is possible to form a part, which is able to function as the spring portion 304, to be long. Moreover, the deformable region 164 is formed so as to gradually become larger as nearer to the front end (i.e. positive Y-side end) thereof. Accordingly, a strength of the holding member 150 (especially, a strength of the side portion 160) is little lowered by forming the deformable region 164.

As shown in FIG. 12, the contact portion 306 of the first detector 300*r* protrudes to be exposed outward in the X-direction (pitch direction) in a state where the first detector 300*r* is attached to the side portion 160. The contact portion 306 of the second detector 300*l* is configured similarly. As can be seen from FIGS. 11 and 12, nothing is located forward of the exposed contact portion 306. Therefore, as shown in FIG. 2, when the USB receptacle 100 is seen from a mating end (i.e. positive Y-side or front side) thereof, the contact portion 306 is visible. As can be seen from the above description, the contact portions 306 are contactable with the first identified portion 512*r* and the second identified portion 512*l* which are inserted along the negative Y-direction, respectively (see FIG. 20). The contact portion 306 has the curved surface protruding outward in the X-direction in a plane defined by the X-direction and the Y-direction (i.e. the XY-plane). Accordingly, contact points of each of the contact portions 306 are distinct when the contact portions 306 are brought into contact with the first identified portion 512*r* and the second identified portion 512*l*.

As shown in FIG. 12, the movable region 166 is located inward in the X-direction (pitch direction) of the contact portion 306 so that the contact portion 306 is movable when the spring portion 304 is deformed. In other words, the movable region 166 is configured so that the contact portion 306 is movable in the movable region 166.

Figure 21:
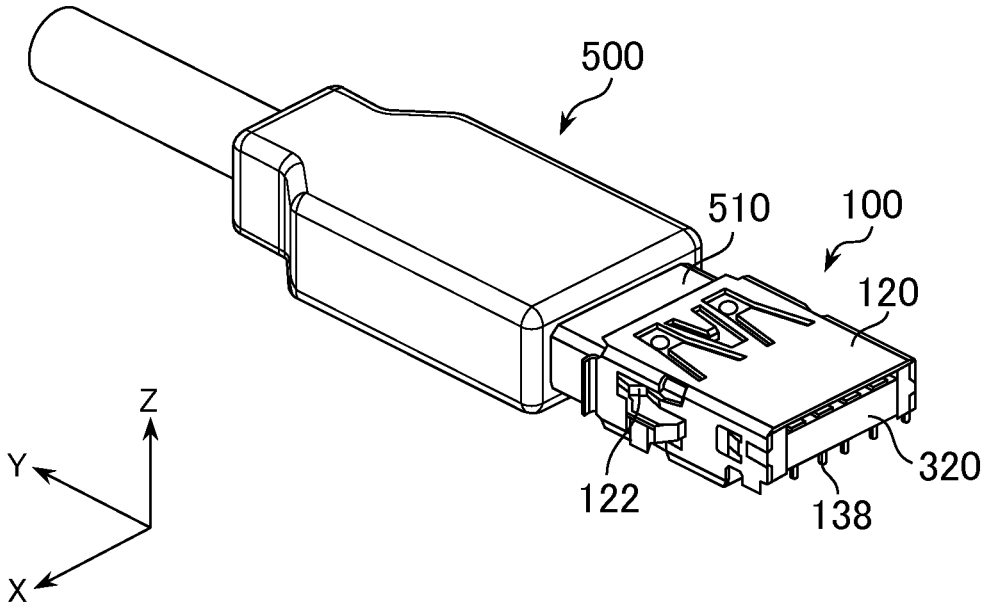
FIG. 21 is a perspective view showing the USB receptacle of FIG. 1 and the special USB plug of FIG. 4 in the partially inserted state.

As can be seen from FIG. 12, the regulating portion 168 is located outward in the X-direction (pitch direction) of the regulated portion 308. In other words, the regulating portion 168 is located between the regulated portion 308 and the contact portion 306 in the X-direction. Therefore, the regulating portion 168 is located inside of the special shell 510 in the X-direction when the USB receptacle 100 is mated with the special USB plug 500 (see FIGS. 21 and 22). The regulating portion 168 is configured to regulate an outward movement of the regulated portion 308 in the X-direction. For example, even when an unintentional outward force in the X-direction is applied to the contact portion 306, the regulated portion 308 is brought into abutment with the regulating portion 168 so that it is possible to prevent an unintentional movement of the contact portion 306. The regulating portion 168 has an outside surface in the X-direction. The body portion 152 has an end surface (i.e. side surface) in the X-direction. According to the present embodiment, the outside surface of the regulating portion 168 and the side surface of the body portion 152 are formed to be located in a common plane. However, for example, the outside surface of the regulating portion 168 may be located inward of the side surface of the body portion 152 in the X-direction.

As shown in FIG. 12, one of the guard portions 170 is located forward of a leading end of the first detector 300*r* (i.e. the regulated portion 308). As shown in FIG. 2, when the USB receptacle 100 is seen from the mating end (i.e. positive Y-side or front side) thereof, the regulated portion 308 is invisible. Therefore, it is possible to avoid that some members or portions are brought into unintentional contact with the regulated portion 308 from the positive Y-side along the negative Y-direction. The other one of the guard portions 170 is located forward of a leading end of the second detector 300*l*. The other one of the guard portions 170 and the second detector 300*l* are also configured as described above.

The guard portion 170 is provided at a position in the Y-direction where the standard shell 410 normally does not arrive when the USB receptacle 100 and the standard USB plug 400 are mated with each other. More specifically, the guard portion 170 is located between the standard shell 410 and the first detector 300*r* (or the second detector 300*l*) in the Y-direction when the USB receptacle 100 is mated with the standard USB plug 400. The guard portion 170 is located inward of both ends of the body portion 152 in the X-direction. In other words, the guard portions 170 are located between the both ends of the body portion 152 in the X-direction. As can be seen from the above description, the special shell 510 is not brought into contact with the guard portion 170 when the USB receptacle 100 and the special USB plug 500 are mated with each other. In other words, the guard portion 170 does not interfere the mating of the standard USB plug 400 or the special USB plug 500 with the USB receptacle 100.

Figure 20:
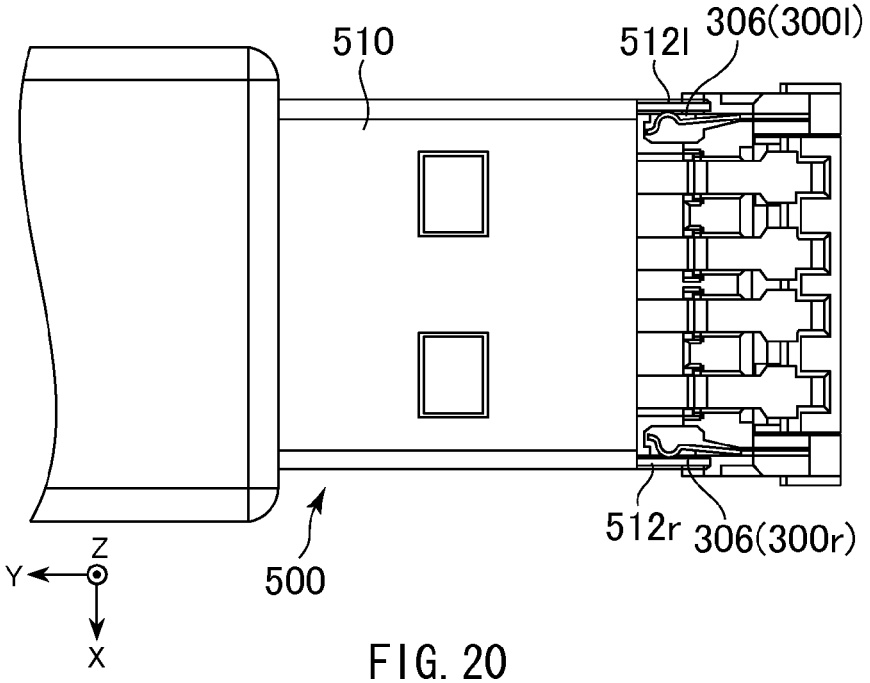
FIG. 20 is a top view showing the USB receptacle (the connector body) and the special USB plug of FIG. 19.
Figure 22:
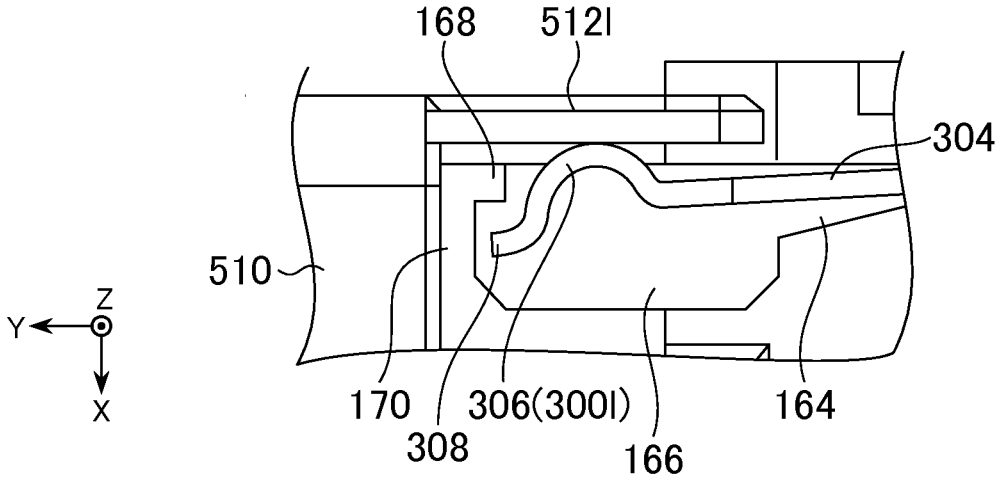
FIG. 22 is a partially enlarged, top view showing in the vicinity of the side portion of the holding member of the connector body of FIG. 20.
Figure 23:
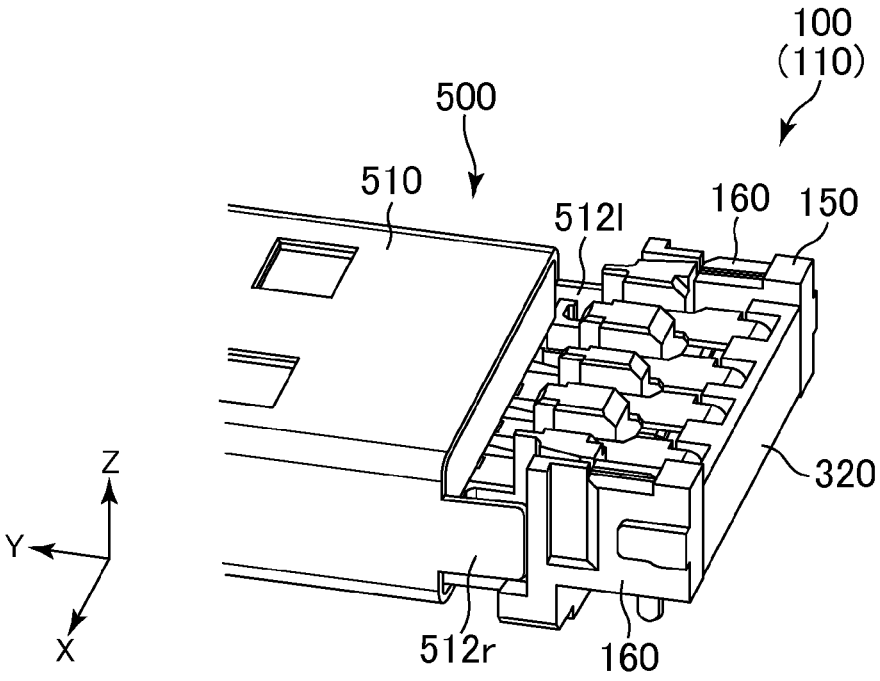
FIG. 23 is a perspective view showing the USB receptacle of FIG. 1 (the connector body of FIG. 9) and the special USB plug of FIG. 4 in a mated state where the USB receptacle and the special USB plug are mated with each other, wherein the shell of the USB receptacle is not illustrated.

As shown in FIGS. 16 to 23, when the special USB plug 500 is mated with the USB receptacle 100 along the negative Y-direction, the first identified portion 512*r* and the second identified portion 512*l* of the special shell 510 are brought into contact with the contact portions 306 of the first detector 300*r* and the second detector 300*l*, respectively. In other words, the first detector 300*r* and the second detector 300*l* according to the present embodiment are connectable to the first identified portion 512*r* and the second identified portion 512*l*, respectively. As shown in FIGS. 20 and 22, when the special USB plug 500 is mated with the USB receptacle 100, any parts of the special shell 510, except the first identified portion 512*r* and the second identified portion 512*l*, are unable to arrive at the back side (i.e. the rear side or the negative Y-side) of the USB receptacle 100 beyond the guard portion 170 in the Y-direction. As can be seen from the above description, when the standard USB plug 400 is mated with the USB receptacle 100, the standard shell 410 is not brought into contact with any parts (including the contact portion 306) which are located backward or rearward of the guard portion 170. In other words, the contact portion 306 is arranged at a position where the standard shell 410 does not arrive when the standard USB plug 400 is mated with the USB receptacle 100.

Each of the first detector 300*r* and the second detector 300*l* is formed separately from the shell 120. In other words, each of the first detector 300*r* and the second detector 300*l* is other than the shell 120. Moreover, as can be seen from FIGS. 2 and 11, the first detector 300*r* and the second detector 300*l* are not in contact with the shell 120. In other words, the first detector 300*r* and the second detector 300*l* are held by the holding member 150 so as not to be directly connected to the shell 120. The shell 120 is connected with the standard shell 410 or the special shell 510 via the shell-side connecting portion 122 when the USB receptacle 100 is mated with the standard USB plug 400 or the special USB plug 500. In other words, the shell 120 has a shape which is connectable to the standard shell 410 when the USB receptacle 100 is mated with the standard USB plug 400 and connectable to the special shell 510 when the USB receptacle 100 is mated with the special USB plug 500. As can be seen from the above description, the first detector 300*r* and the second detector 300*l* are electrically connected with the shell 120 upon the mating of the USB receptacle 100 with the special USB plug 500 while being electrically unconnected with the shell 120 upon the mating of the USB receptacle 100 with the standard USB plug 400.

According to the present embodiment, it is possible to detect whether the USB receptacle 100 is mated with the standard USB plug 400 or the special USB plug 500 by detecting whether the first detector 300*r* and the second detector 300*l* are electrically connected with the shell 120 or not. In other words, the USB receptacle 100 is provided with a detecting structure which is detectable the mating plug (i.e. the standard USB plug 400 or the special USB plug 500). Specifically, for example, it may be possible to detect whether the USB receptacle 100 is mated with the standard USB plug 400 or the special USB plug 500 by detecting whether an electric current flows between the shell 120 and each of the first detector 300*r* and the second detector 300*l* (i.e. by detecting the electric current). It also may be possible to detect whether the USB receptacle 100 is mated with the standard USB plug 400 or the special USB plug 500 by detecting whether the electric potential of each of the first detector 300*r* and the second detector 300*l* changes (i.e. is lowered to the ground potential) or not (i.e. by detecting the electric potential) under a state where the electric potential each of the first detector 300*r* and the second detector 300*l* is pulled up while the shell 120 is connected to the ground.

It is possible to perform a first detection for the first detector 300*r* and a second detection for the second detector 300*l* independently from each other when detecting the electric current or the electric potential. When the first detection and the second detection are performed independently, it is possible to detect not only the special USB plug 500 but also the special USB plug 500*x* and the special USB plug 500*y* shown in FIGS. 7 and 8, respectively. In detail, it may be assumed that the special USB plug 500 is connected to the USB receptacle 100 when it is detected that the first detector 300*r* and the second detector 300*l* are both electrically connected with the shell 120. It also may be assumed that the special USB plug 500*x* is connected to the USB receptacle 100 when it is detected that only the second detector 300*l* is electrically connected with the shell 120. It also may be assumed that the special USB plug 500*y* is connected to the USB receptacle 100 when it is detected that only the first detector 300*r* is electrically connected with the shell 120. It also may be assumed that the standard USB plug 400 is connected to the USB receptacle 100 when it is detected that neither the first detector 300*r* nor the second detector 300*l* is electrically connected with the shell 120.

The Second Embodiment

Figure 24:
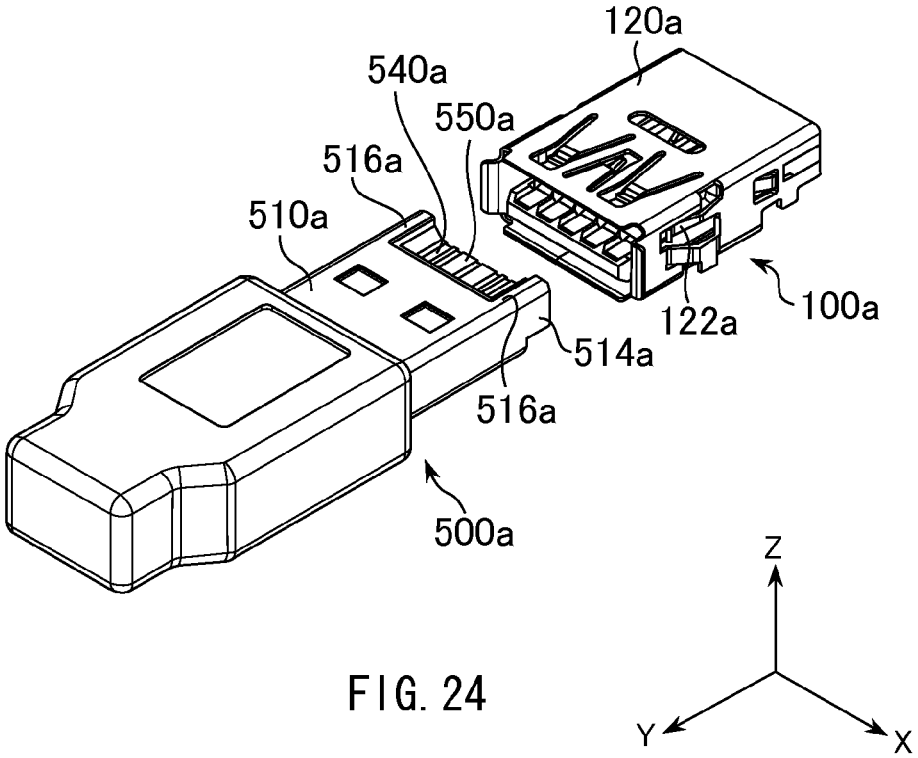
FIG. 24 is a perspective view showing a USB receptacle and a special USB plug according to a second embodiment of the present invention.
Figure 25:
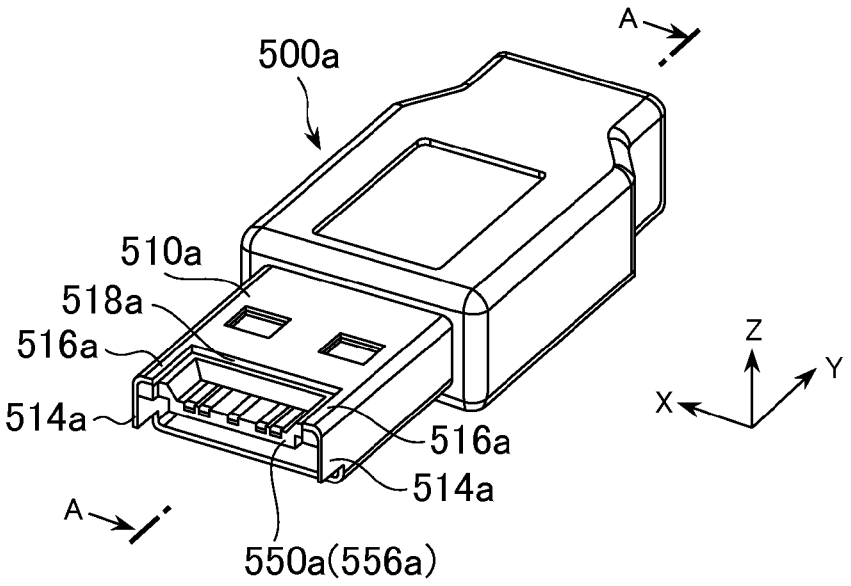
FIG. 25 is a perspective view showing the special USB plug of FIG. 24.
Figure 26:
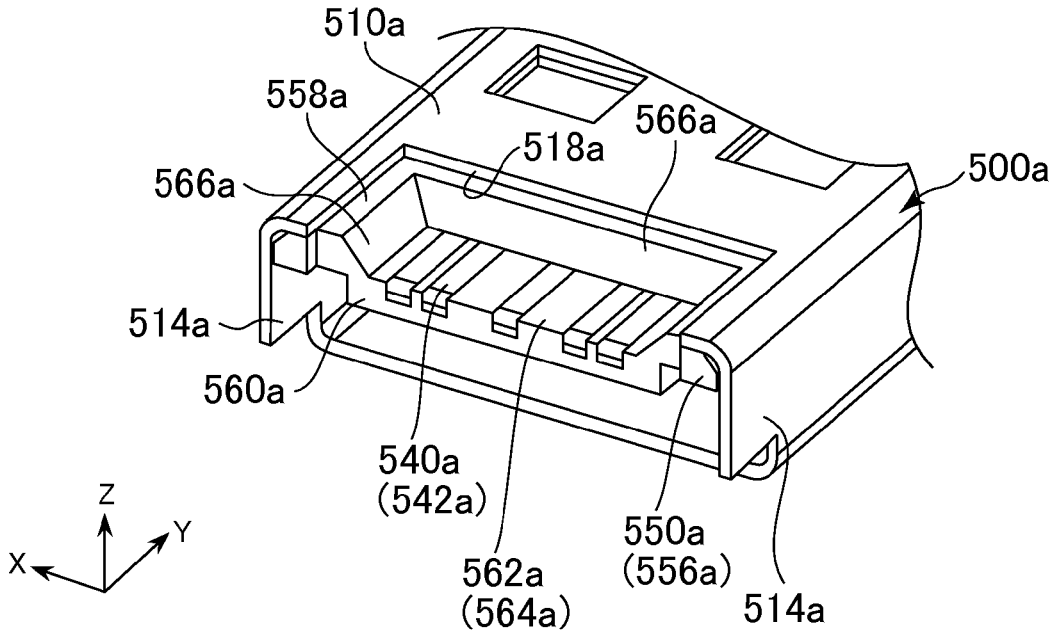
FIG. 26 is a partially enlarged, perspective view showing in the vicinity of a leading end of the special USB plug of FIG. 25.
Figure 27:
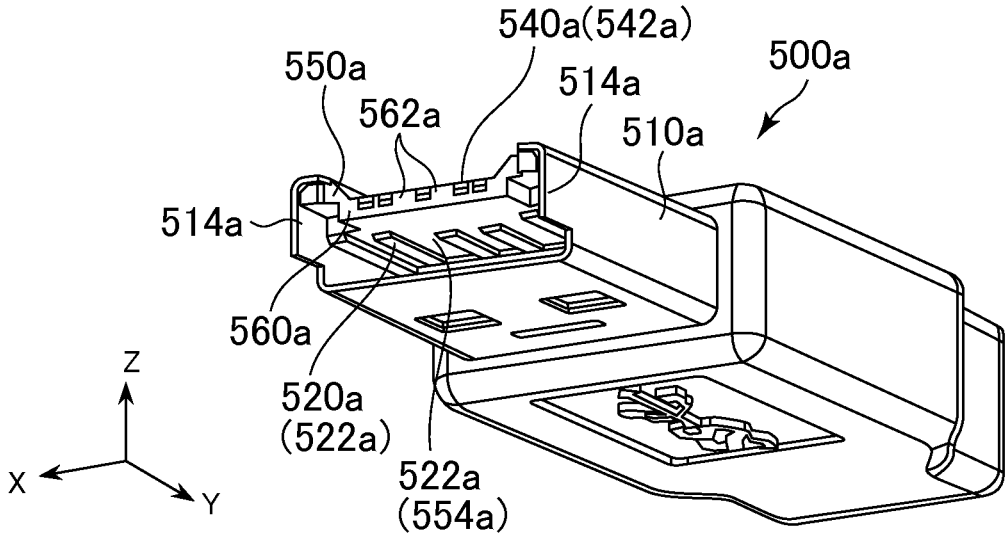
FIG. 27 is another perspective view showing the special USB plug of FIG. 25.
Figure 28:
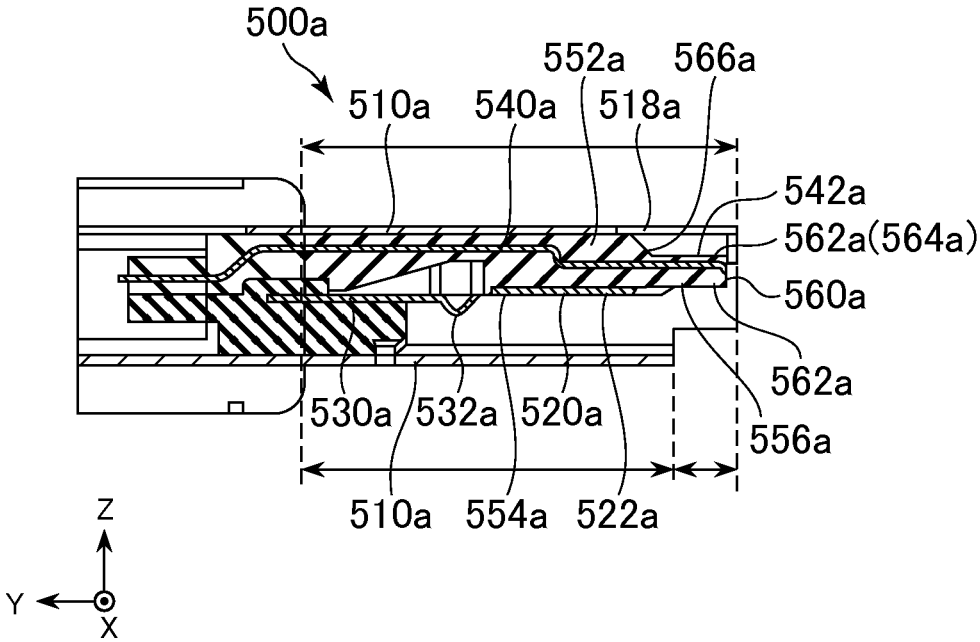
FIG. 28 is a cross-sectional view showing the special USB plug of FIG. 25, taken along lines A-A.
Figure 30:
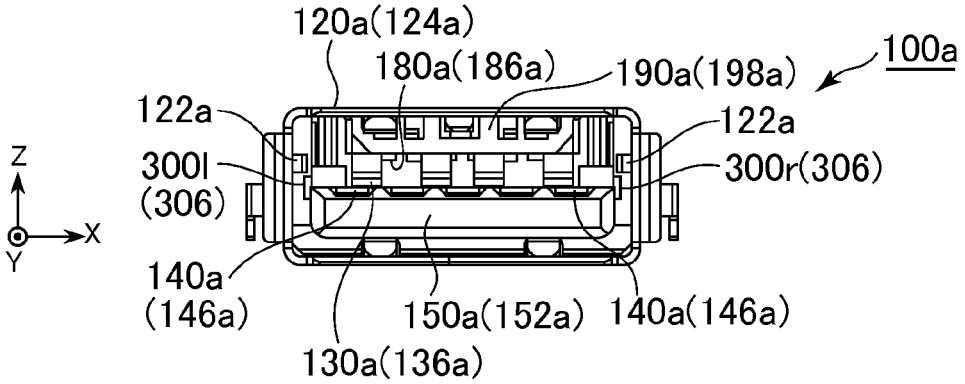
FIG. 30 is a front view showing the USB receptacle of FIG. 29.
Figure 33:
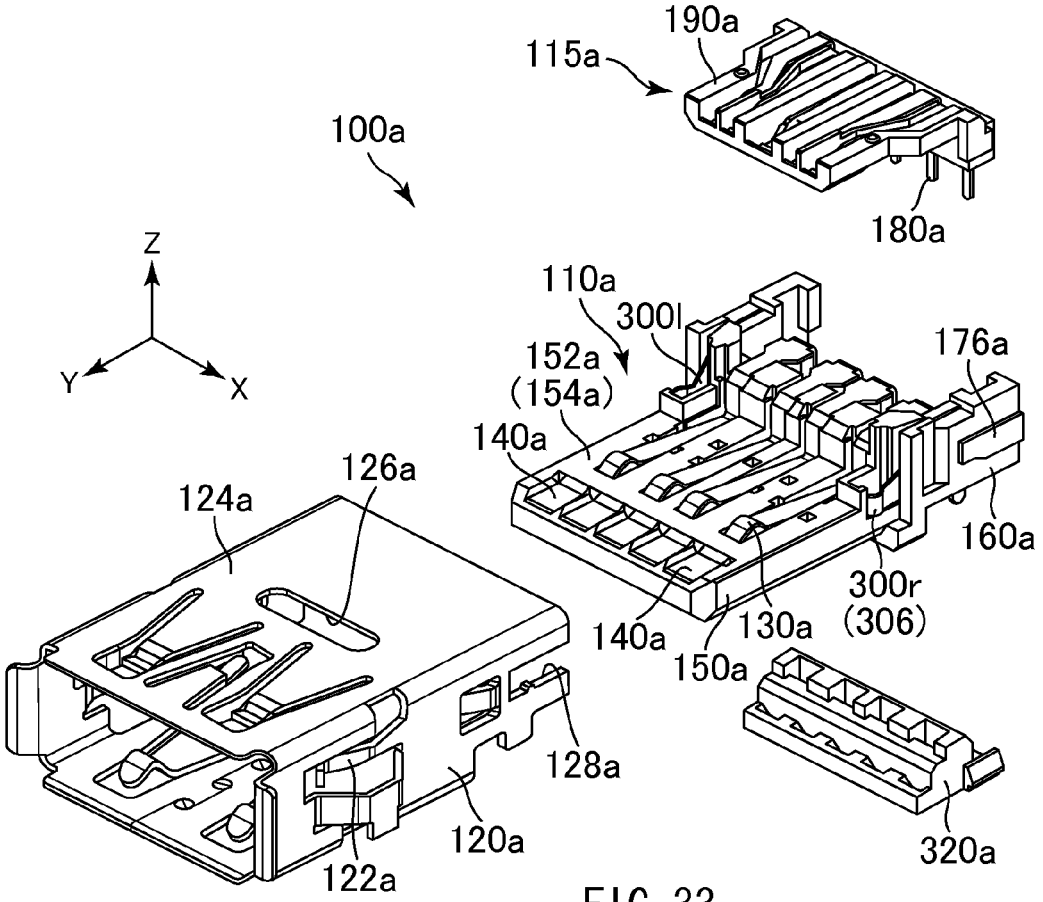
FIG. 33 is a partially exploded, perspective view showing the USB receptacle of FIG. 29.

Referring to FIG. 24, a USB receptacle 100*a* according to the second embodiment of the present invention is configured so that the standard USB plug 400 in accordance with the USB 3.0 standard (see FIG. 6) and a special USB plug 500*a* are selectively matable with and removal from the USB receptacle 100*a* along the Y-direction (predetermined direction). Referring to FIGS. 24 to 28, roughly speaking, the special USB plug 500*a* is configured by adding five special contacts 540*a* to the standard USB plug 400. Referring to FIGS. 30 and 33, The USB receptacle 100*a* comprises, in addition to contacts 130*a* and 140*a* which are configured to be connected to the standard USB plug 400, five additional contacts 180*a* corresponding to the respective special contacts 540*a* of the special USB plug 500*a*. The special contacts 540*a* of the special USB plug 500*a* and the additional contacts 180*a* of the USB receptacle 100*a* according to the present embodiment are used for a USB 3.0 signal transmission. As can be seen from the above description, each of the special USB plug 500*a* and the USB receptacle 100*a* according to the present embodiment comprises two sets of the contacts used for the USB 3.0 signal transmission. In short, each of the special USB plug 500*a* and the USB receptacle 100*a* is of so-called dual USB 3.0 type. As described in detail below, the USB receptacle 100*a* is incorporated with a detecting structure configured similar to the detecting structure which is provided in the USB receptacle 100 (see FIGS. 1 to 3) according to the aforementioned first embodiment. Therefore, the USB receptacle 100*a* is detectable whether the standard USB plug 400 is mated therewith or the special USB plug 500*a* is mated therewith.

As shown in FIGS. 25 to 28, the special USB plug 500*a* according to the present embodiment comprises a special shell 510*a* made of a conductive material, a plurality of standard contacts 520*a* each made of a conductive material, a plurality of standard contacts 530*a* each made of a conductive material, a plurality of the special contacts 540*a* each made of a conductive material and a special holding member 550*a* made of an insulating material. The standard contacts 520*a* are for the USB 2.0 connection. Accordingly, the special USB plug 500*a* has four standard contacts 520*a*. Each of the standard contacts 520*a* has a contact part 522*a*. The standard contacts 530*a* are for the USB 3.0 connection. Accordingly, the special USB plug 500*a* has five standard contacts 530*a*. Each of the standard contacts 530*a* has a contact part 532*a*. The contact part 532*a* is formed to have a curve. The standard contact 530*a* is resiliently deformable so that the contact part 532*a* is movable. The standard contacts 520*a* and the standard contacts 530*a* are also included in the standard USB plug 400 (see FIG. 6). The special contacts 540*a* are different from the standard contacts 520*a* and the standard contacts 530*a*. The special contacts 540*a* are particular to the special USB plug 500*a* according to the present embodiment. The special USB plug 500*a* has five special contacts 540*a*. Each of the special contacts 540*a* has a contact part 542*a*.

The special holding member 550*a* holds and arranges the standard contacts 520*a* in the X-direction. The special holding member 550*a* also holds and arranges the standard contacts 530*a* in the X-direction. The special holding member 550*a* also holds and arranges the special contacts 540*a* in the X-direction. The special holding member 550*a* has a modified holding portion 552*a* and an extended portion 556*a*. The modified holding portion 552*a* corresponds to the standard holding member 450 of the standard USB plug 400. The extended portion 556*a* has a plate-like shape projecting from the modified holding portion 552*a* in the Y-direction (predetermined direction). The extended portion 556*a* has an upper surface 558*a* in the Z-direction (vertical direction) and an end surface in the Y-direction. The extended portion 556*a* is provided with a thin portion 562*a*. The thin portion 562*a* has a small size (i.e. thickness) in the Z-direction (vertical direction). The thin portion 562*a* has an upper surface 564*a*. The upper surface 564*a* of the thin portion 562*a* according to the present embodiment is located below the upper surface 558*a* of the extended portion 556*a*. In detail, a middle part of the extended portion 556*a* in the X-direction is depressed downward (i.e. in the negative Z-direction) so that the thin portion 562*a* is formed. The thin portion 562*a* extends in the Y-direction to arrive at the end surface 560*a* of the extended portion 556*a*. The special holding member 550*a* is provided with a boundary portion 566*a*. The boundary portion 566*a* is formed between the upper surface 564*a* of the thin portion 562*a* and the upper surface 558*a* of the extended portion 556*a* so as to have a slope oblique to the Z-direction (vertical direction). According to the present embodiment, thus configured boundary portion 566*a* is provided so that it is possible to prevent the thin portion 562*a* from being damaged when a stress is applied to the thin portion 562*a*.

The standard contacts 520*a* are insert-molded in the special holding member 550*a* when the special holding member 550*a* is formed. In other words, the standard contacts 520*a* are embedded in and held by the special holding member 550*a*. The standard contacts 520*a* are configured to be connected to the contacts 130*a* of the USB receptacle 100*a* (see FIG. 33), respectively. More specifically, the contact parts 522*a* of the standard contacts 520*a* are arranged on a lower surface 554*a* of the modified holding portion 552*a* in the Z-direction. The contact parts 522*a* (i.e. the standard contacts 520*a*) are accommodated within the modified holding portion 552*a* in the Y-direction. In other words, the contact parts 522*a* (i.e. the standard contacts 520*a*) do not arrive at the extended portion 556*a* in the Y-direction. The standard contacts 530*a* are press-fitted in the special holding member 550*a* so as to be held by the special holding member 550*a*. The standard contacts 530*a* are configured to be connected to the contacts 140*a* of the USB receptacle 100*a* (see FIG. 33), respectively. More specifically, the contact parts 532*a* of the standard contacts 530*a* are arranged on the lower surface 554*a* of the modified holding portion 552*a* in the Z-direction. The contact parts 532*a* (i.e. the standard contacts 530*a*) are accommodated within the modified holding portion 552*a* in the Y-direction. In other words, the contact parts 532*a* (i.e. the standard contacts 530*a*) do not arrive at the extended portion 556*a* in the Y-direction.

The special contacts 540*a* according to the present embodiment are insert-molded in the special holding member 550*a* when the special holding member 550*a* is formed. In other words, the standard contacts 520*a* are embedded in and held by the special holding member 550*a*. The special contacts 540*a* are configured to be connected to the additional contacts 180*a* of the USB receptacle 100*a* (see FIG. 34), respectively. More specifically, the special contacts 540*a* are held and arranged by the special holding member 550*a* so that the contact parts 542*a* are exposed on the upper surface 564*a* of the thin portion 562*a*. The special contact 540*a* according to the present embodiment extends in the negative Y-direction to arrive at the end surface 560*a* of the extended portion 556*a* in the Y-direction (predetermined direction). In other words, the special contact 540*a* according to the present embodiment is continuously exposed on the upper surface 564*a* of the thin portion 562*a* and the end surface 560*a* of the extended portion 556*a*. The special contact 540*a* is configured as described above so that it is possible to lengthen a part which is available for contact.

The special shell 510*a* includes a part having the same shape as the standard shell 410 of the standard USB plug 400 (see FIG. 6), two side protrusions (identified portions) 514*a* projecting over the part in the Y-direction, and two upper-side protruding portion 516*a* projecting over the part in the Y-direction. In detail, the two side protrusions 514*a* protrude in the negative Y-direction so as to cover both ends (i.e. both side portions) in the X-direction (pitch direction) of the extended portion 556*a*. Each of the two upper-side protruding portion 516*a* protrudes in the negative Y-direction so as to cover the upper surface 558*a* of the extended portion 556*a*. As can be seen from the above description, the side protrusion 514*a* according to the present embodiment, similar to the first identified portion 512*r* or the second identified portion 512*l* according to the first embodiment, functions as an identified portion 514*a*. The upper-side protruding portions 516*a* are continuous with the respective side protrusions 514*a*. In detail, a part consisting of the side protrusion 514*a* and the upper-side protruding portion 516*a* has an L-like shaped cross-section in the plane (XZ-plane) perpendicular to the Y-direction. Accordingly, a necessary strength of the side protrusion 514*a* and the upper-side protruding portion 516*a* is ensured.

The two upper-side protruding portions 516*a* is provided so as to be apart from each other in the X-direction. The special shell 510*a* has a notch 518*a* provided between the two upper-side protruding portions 516*a* in the X-direction. The notch 518*a* is recessed along the positive Y-direction from the negative Y-side end of the special shell 510*a*. In other words, the notch 518*a* is cut forward (i.e. along the positive Y-direction). The notch 518*a* is located over (i.e. located at the positive Z-side of) the thin portion 562*a*. Accordingly, the thin portion 562*a* is visible from above (i.e. from the positive Z-side) through the notch 518*a*. In other words, the notch 518*a* is formed so that the thin portion 562*a* is visible from above in the Z-direction along the negative Z-direction.

As shown in FIGS. 29 to 34, the USB receptacle 100*a* according to the present embodiment comprises a standard body 110*a*, an additional body 115*a*, a positioner 320*a* made of an insulating material and a shell 120*a* made of a conductive material. The additional body 115*a* is installed on the standard body 110*a*. The shell 120*a* encloses the standard body 110*a*, the additional body 115*a* and the positioner 320*a* in a plane perpendicular to the Y-direction (predetermined direction).

Figure 31:
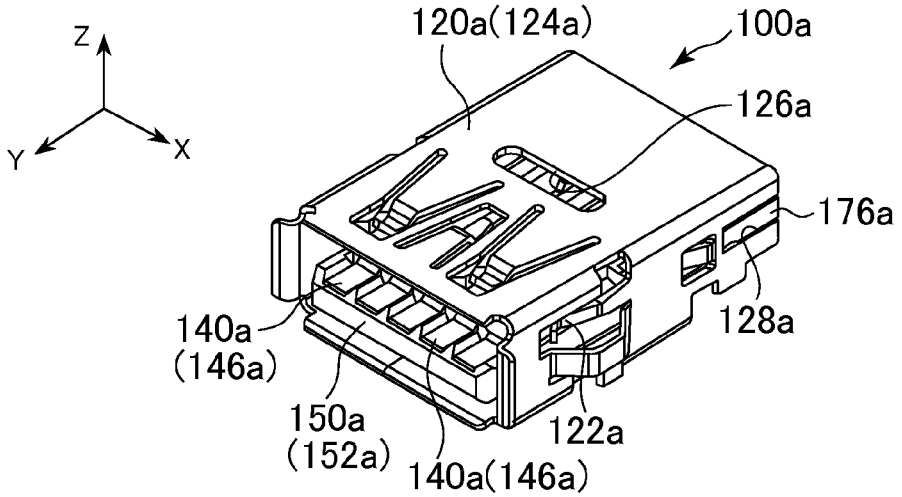
FIG. 31 is a perspective view showing the USB receptacle of FIG. 29.
Figure 32:
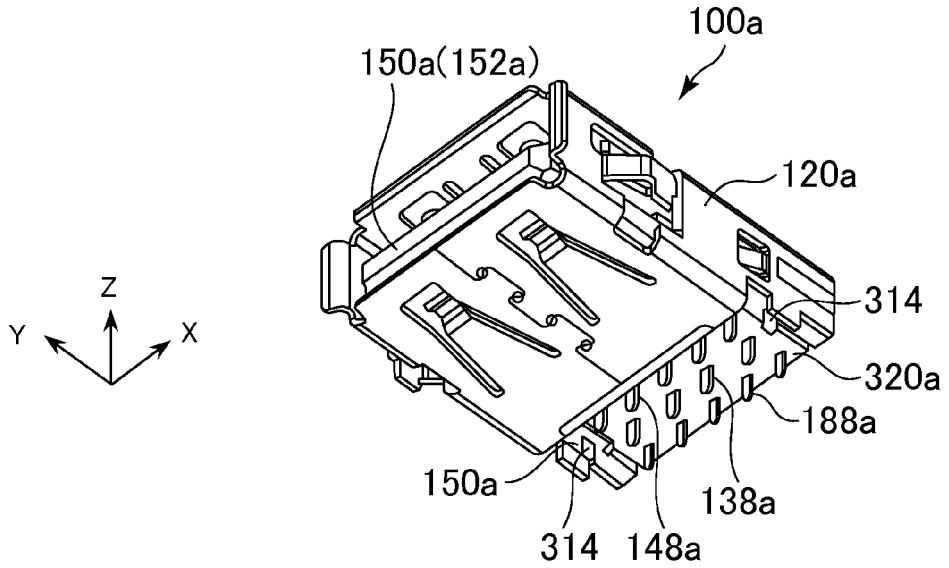
FIG. 32 is another perspective view showing the USB receptacle of FIG. 29.

As shown in FIGS. 29 to 33 and 52, the shell 120*a* according to the present embodiment roughly has a rectangular cube-like shape. More specifically, the shell 120*a* has a rectangular cross-section in a plane perpendicular to the Y-direction (predetermined direction). The rectangular cross-section of the shell 120*a* has a long side in the X-direction (pitch direction) and a short side in the Z-direction (vertical direction). The shell 120*a* is formed with shell-side connecting portions 122*a* on both side surfaces thereof, respectively. The shell-side connecting portion 122*a* is configured to be connected to the standard shell 410 or the special shell 510*a* when the USB receptacle 100*a* is mated with the standard USB plug 400 or the special USB plug 500*a*. In other words, the shell 120*a* is electrically connected with the standard shell 410 or the special shell 510*a* when the USB receptacle 100*a* is mated with the standard USB plug 400 or the special USB plug 500*a*. As shown in FIGS. 29, 31, 33 and 52, the shell 120*a* is formed with an opening 126*a* on an upper surface 124*a* thereof. The opening 126*a* pierces the upper surface 124*a* of the shell 120*a* in the Z-direction. The opening 126*a* is a long and narrow window extending long in the X-direction. As shown in FIGS. 31 and 33, the shell 120*a* is provided with attached portions 128*a* at rear ends (i.e. ends in the negative Y-direction) of the both side surfaces thereof, respectively. The attached portion 128*a* is a notch which is cut forward (i.e. cut along the positive Y-direction). As described later, the attached portion 128*a* is used when the shell 120*a* is attached to the standard body 110*a*.

As shown in FIGS. 33 to 43, the standard body 110*a* is configured to provide a function similar to the connector body 110 (see FIG. 9) which is in accordance with the USB 3.0 standard. In detail, the standard body 110*a* (i.e. the USB receptacle 100*a*) comprises a plurality of contacts 130*a* each made of a conductive material, a plurality of contacts 140*a* each made of a conductive material, a holding member 150*a* made of an insulating material, the first detector 300*r* made of a conductive material and the second detector 300*l* made of a conductive material. The holding member 150*a* holds the contacts 130*a* and 140*a*.

The contacts 130*a* are for the USB 2.0 connection. Accordingly, the USB receptacle 100*a* has four contacts 130*a*. Each of the contacts 130*a* has a held portion 132*a*, a spring portion 134*a*, a contact part 136*a* and a fixed portion 138*a* (see FIGS. 39, 40 and 43). The held portion 132*a* is held by the holding member 150*a*. The spring portion 134*a* extends obliquely forward (i.e. forward and upward) from the held portion 132*a*. The contact part 136*a* is provided at a leading end of the spring portion 134*a*. The fixed portion 138*a* is configured to be fixed to the circuit board (not shown) on which the USB receptacle 100*a* is mounted.

The contacts 140*a* are for the USB 3.0 connection. Accordingly, the USB receptacle 100*a* has five contacts 140*a*. Each of the contacts 140*a* has a contact part 146*a* and a fixed portion 148*a* (see FIGS. 39 and 41).

Figure 42:
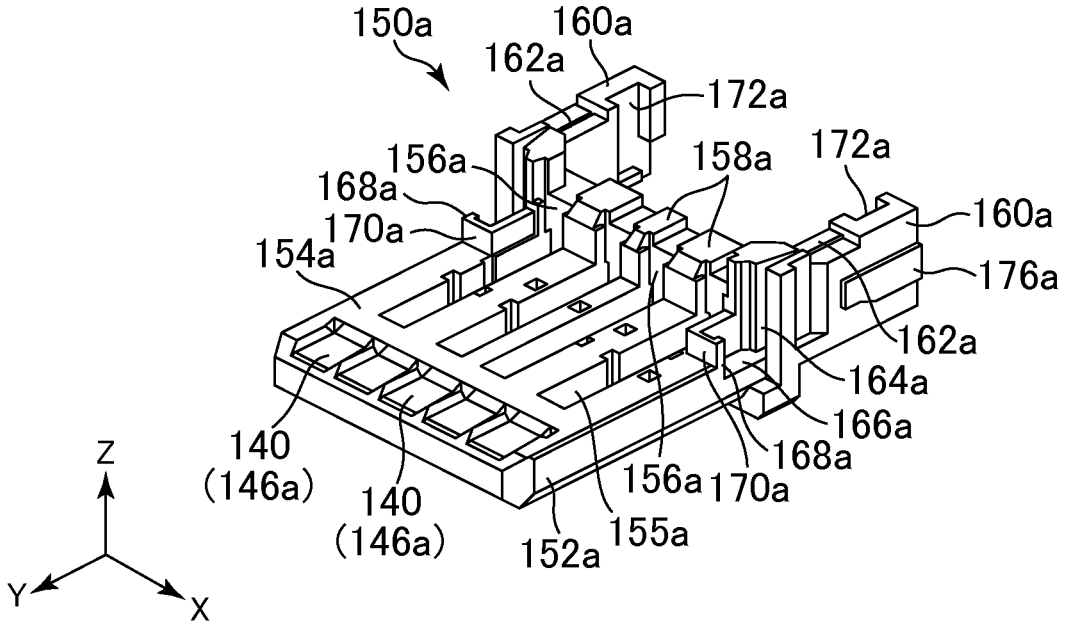
FIG. 42 is a perspective view showing a holding member included in the standard body of FIG. 35.
Figure 43:
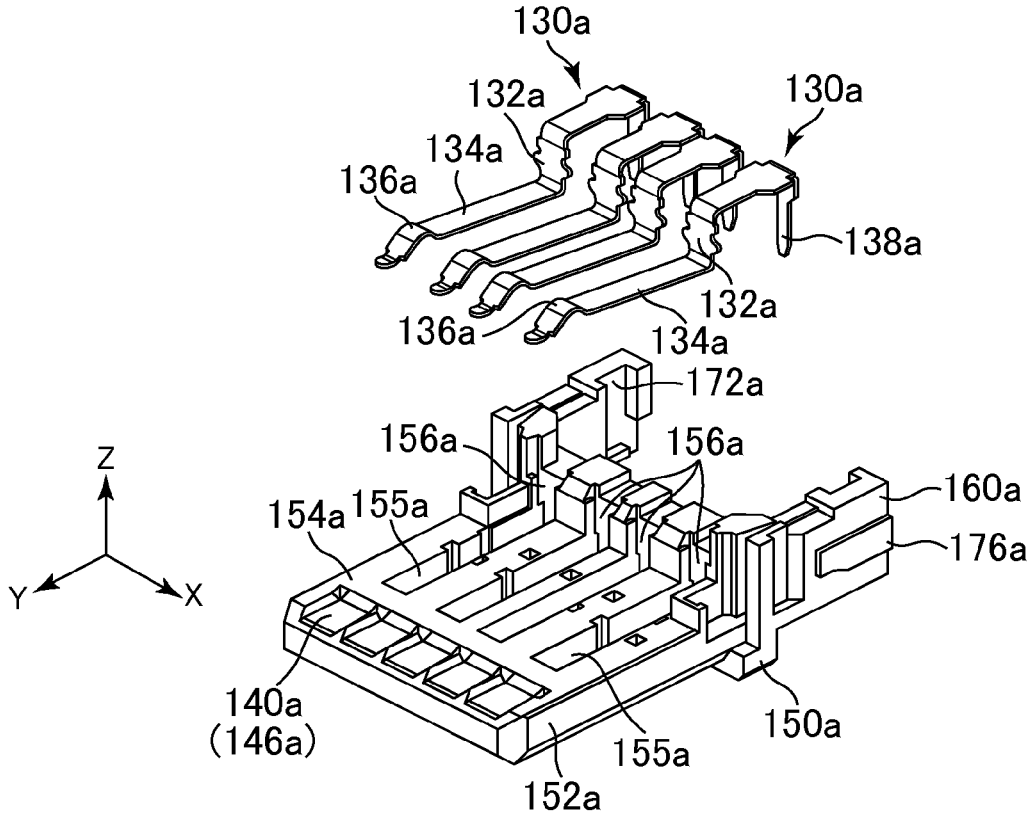
FIG. 43 is a perspective view showing USB 2.0 contacts, the USB 3.0 contacts and the holding member included in the standard body of FIG. 35, wherein the USB 2.0 contacts is not yet installed in the holding member.
Figure 44:
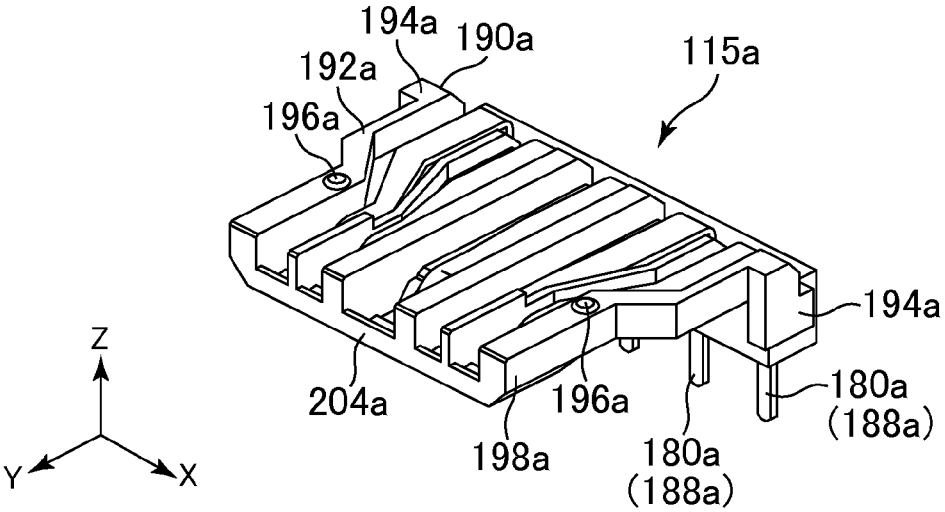
FIG. 44 is a perspective view showing an additional body included in the USB receptacle of FIG. 33.

Referring to FIGS. 39, 40, 42 and 43, the holding member 150*a* comprises a body portion 152*a*, a contact-holding portion 156*a* and two side portions 160*a*. The body portion 152*a* has a plate-like shape which extends in the Y-direction while having a thickness in the Z-direction. The contact-holding portion 156*a* is located at a rear side (i.e. negative Y-side) of the body portion 152*a*. The side portions 160*a* are located at both ends of the holding member 150*a* in the X-direction (pitch direction). The body portion 152*a* is formed with a spring-accommodation portion 155*a*. The spring-accommodation portion 155*a* extends in the Y-direction (predetermined direction) while depressed in the negative Z-direction (i.e. depressed downward). The contact-holding portion 156*a* according to the present embodiment is lower (i.e. has smaller size in the Z-direction) than the contact-holding portion 156 according to the first embodiment (see FIGS. 9 and 10). The contact-holding portion 156*a* is configured as described above so that it is possible to mount the additional body 115*a* on the contact-holding portion 156*a* while reducing a size of the USB receptacle 100*a*. As shown in FIG. 42, the contact-holding portion 156*a* has an upper surface 158*a* which functions as the mount portion 158*a*.

Referring to FIGS. 35, 38, 40 and 43, the held portion 132*a* of the contact 130*a* is press-fitted in the contact-holding portion 156*a* of the holding member 150*a* downward (i.e. along the negative Z-direction) so that the contacts 130*a* are held and arranged by the holding member 150*a* in the X-direction. The spring portion 134*a* is accommodated in the spring-accommodation portion 155*a* so as to be resiliently deformable. The body portion 152*a* has an upper surface 154*a*. The contact parts 136*a* are arranged on the upper surface 154*a* of the body portion 152*a* so as to protrude partially. The spring portion 134*a* of the contact 130*a* is resiliently deformable so that the contact part 136*a* is movable mainly in the Z-direction (vertical direction).

Referring to FIGS. 35 to 39, the contacts 140*a* are insert-molded in the holding member 150*a* when the holding member 150*a* is formed. The contacts 140*a* are embedded in the holding member 150*a* so as to be held and arranged by the holding member 150*a* in the X-direction. The contact parts 146*a* of the contacts 140*a* are arranged on the upper surface 154*a* of the body portion 152*a*. As can be seen from FIG. 37, as compared with the contact part 136*a* of the contact 130*a*, the contact part 146*a* of the contact 140*a* is located at a position nearer to a front end (i.e. positive Y-side end) of the body portion 152*a*. In other words, the contact part 146*a* of the contact 140*a* is located between the contact part 136*a* of the contact 130*a* and the front end (i.e. positive Y-side end) of the body portion 152*a* in the Y-direction.

As shown in FIGS. 35 to 37 and 42, each of the side portions 160*a* of the holding member 150*a* is formed with a detector-holding portion 162*a*, a deformable region 164*a*, a movable region 166*a*, a regulating portion 168*a*, a guard portion 170*a* and an attaching portion 176*a*. The detector-holding portion 162*a* is a ditch which extends in a direction perpendicular to the X-direction (i.e. in a vertical plane perpendicular to the X-direction) so as to be formed with an inside wall. The detector-holding portion 162*a* partially extends to a bottom surface of the holding member 150*a* so as to pierce the holding member 150*a*. The deformable region 164*a* is located forward of the detector-holding portion 162*a* (i.e. extends in the positive Y-direction from the detector-holding portion 162*a*). The movable region 166*a* is located forward of the deformable region 164*a* (i.e. extends in the positive Y-direction from the detector-holding portion 162*a*). In other words, the deformable region 164*a* is formed to be located between the detector-holding portion 162*a* and the movable region 166*a* in the Y-direction. A size in the X-direction of the deformable region 164*a* is designed so as to become larger as being nearer to the movable region 166*a*. In detail, the deformable region 164*a* has a variable size in the X-direction. The deformable region 164*a* is formed so that the variable size at a predetermined position in the Y-direction becomes larger as the predetermined position is nearer to the movable region 166*a* (i.e. as the predetermined position moves from the detector-holding portion 162*a* toward the Y-side end of the holding member 150*a*). As can be seen from FIG. 37, the deformable region 164*a* according to the present embodiment is defined by two walls. One of the two walls is oblique to both the X-direction and the Y-direction. The movable region 166*a* is a space which has a larger size than the deformable region 164*a* in the X-direction. The movable region 166*a* communicates with an outside of the holding member 150*a* in the X-direction. As shown in FIG. 42, each of the regulating portion 168*a* and the guard portion 170*a* is located in the vicinity of a front end (i.e. positive Y-side end) of the movable region 166*a*. The regulating portion 168*a* is a wall slightly extending in the Y-direction. The regulating portion 168*a* is located outward in the X-direction of the front end (i.e. positive Y-side end) of the movable region 166*a*. The guard portion 170*a* is a wall extending perpendicular to the Y-direction. The guard portion 170*a* is located forward of the movable region 166*a* (i.e. located at the positive Y-side edge of the movable region 166*a*). According to the present embodiment, a part consisting of the regulating portion 168*a* and the guard portion 170*a* has an L-like shape in a plane perpendicular to the Z-direction.

As shown in FIGS. 31 to 33 and 35 to 38, the attaching portion 176*a* is located at a rear end (i.e. negative Y-side end) of the side portion 160*a*. The attaching portion 176*a* protrudes outward in the X-direction from the side portion 160*a*. The attaching portion 176*a* has a plate-like shape extending forward (i.e. along the positive Y-direction).

Figure 35:
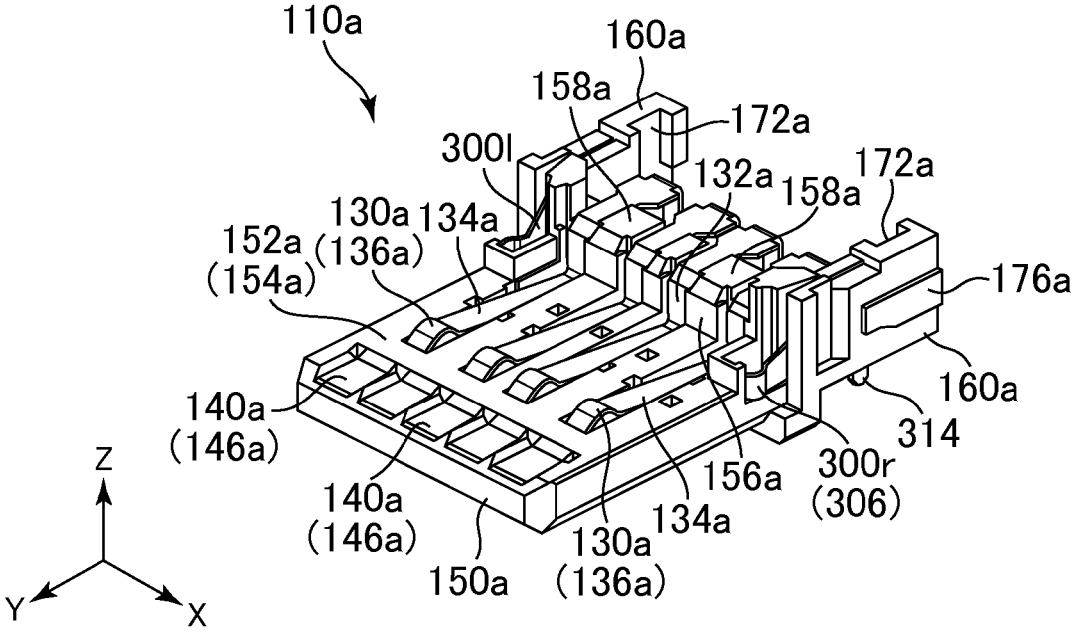
FIG. 35 is a perspective view showing a standard body included in the USB receptacle of FIG. 33.
Figure 36:
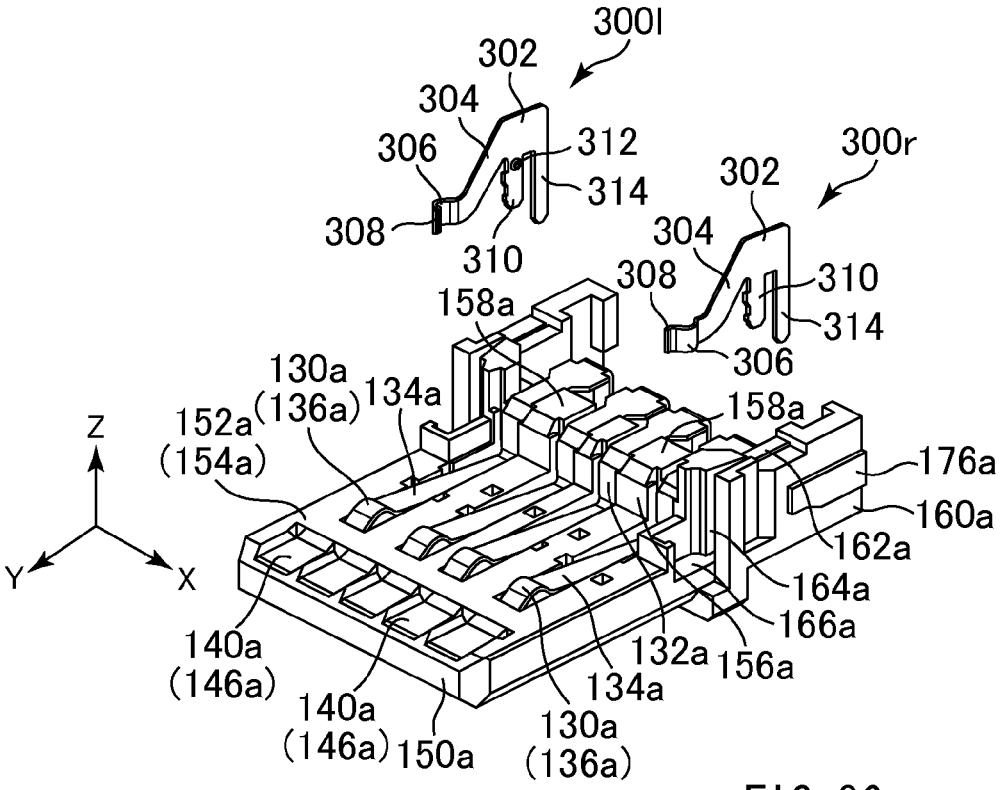
FIG. 36 is a perspective view showing the standard body of FIG. 35, wherein a first detector and a second detector are detached from the standard body.
Figure 37:
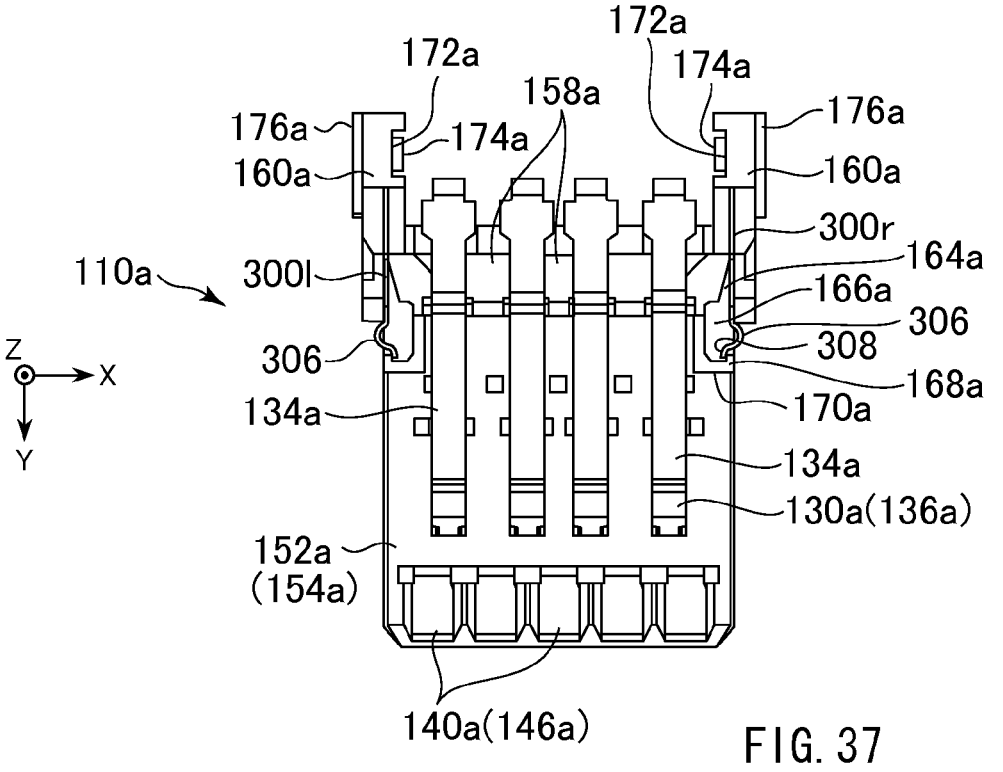
FIG. 37 is a top view showing the standard body of FIG. 35.
Figure 38:
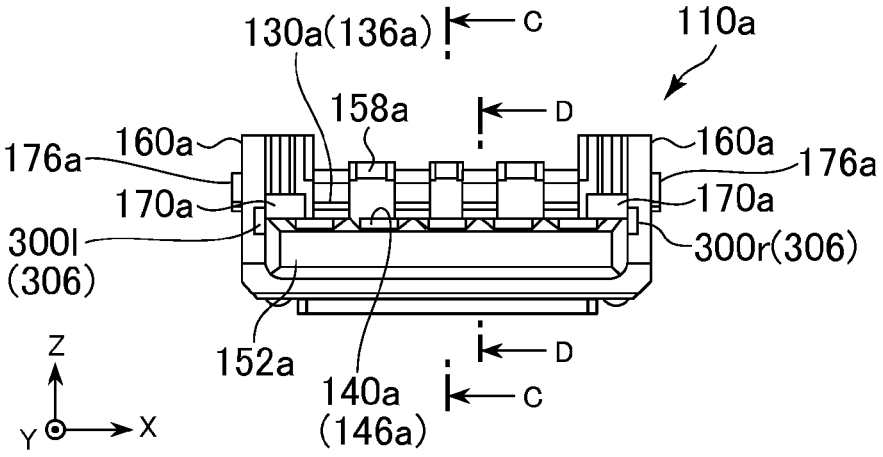
FIG. 38 is a front view showing the standard body of FIG. 35.
Figure 39:
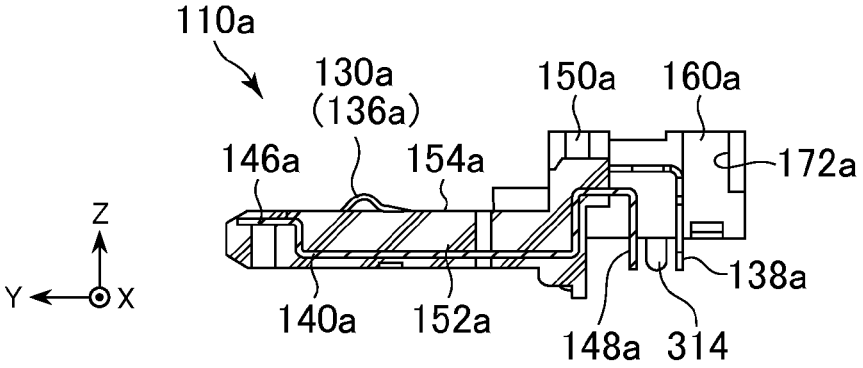
FIG. 39 is a cross-sectional view showing the standard body of FIG. 38, taken along lines C-C.
Figure 40:
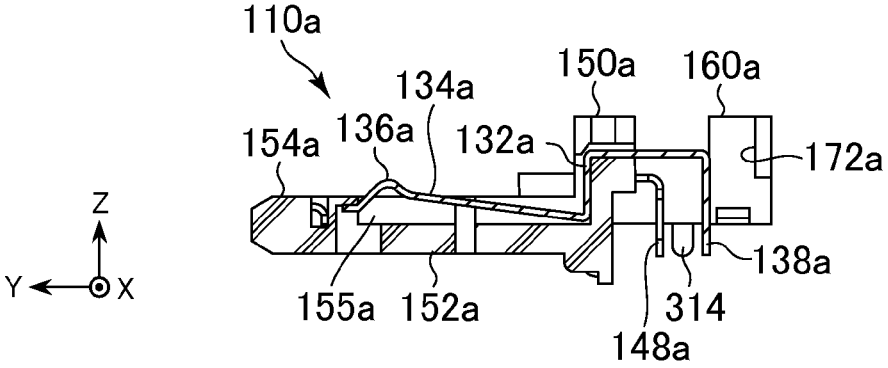
FIG. 40 is a cross-sectional view showing the standard body of FIG. 38, taken along lines D-D.
Figure 41:
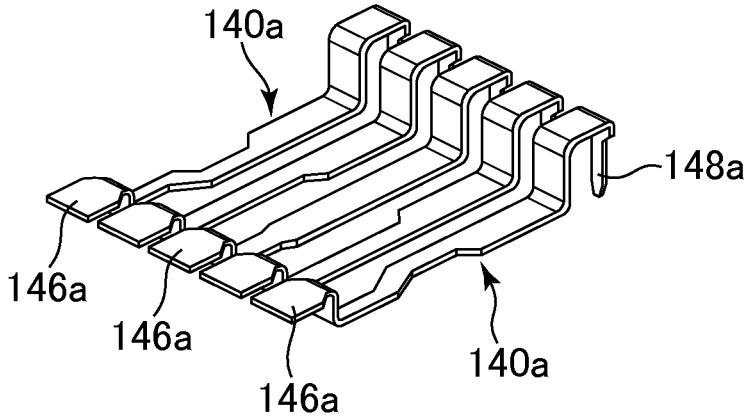
FIG. 41 is a perspective view showing USB 3.0 contacts included in the standard body of FIG. 35.

As shown in FIGS. 35, 37 and 42, the two side portions 160*a* are formed with respective recesses (fit portions) 172*a* inward thereof in the X-direction. The recess 172*a* is located in the vicinity of a rear end (i.e. negative Y-side end) of the holding member 150*a*. The recess 172*a* is recessed outward in the X-direction. The recesses 172*a* are used when the additional body 115*a* is installed on the standard body 110*a*. As shown in FIG. 37, each of the two recesses 172*a* is formed with an engaged portion 174*a* on the negative Z-side (i.e. lower side) thereof. The engaged portion 174*a* protrudes inward in the X-direction. As described later, the engaged portions 174*a* are uses when the positioner 320*a* is attached to the holding member 150*a*.

The first detector 300*r* and the second detector 300*l* according to the present embodiment have the same structures as the first detector 300*r* and the second detector 300*l* according to the first embodiment, respectively (see FIGS. 13 to 15). However, according to the present embodiment, the first detector 300*r* and the second detector 300*l* are attached to the holding member 150*a*. As can be seen from FIGS. 36 and 37, similar to the first embodiment, the first detector 300*r* and the second detector 300*l* is held by the right side portion 160*a* and the left side portion 160*a*, respectively, so that the contact portion 306 is movable mainly in the X-direction (i.e. in the horizontal plane perpendicular to the Z-direction).

As shown in FIGS. 33, 44 to 51, the additional body 115*a* (i.e. the USB receptacle 100*a*) comprises a plurality of the additional contacts 180*a* each made of a conductive material and an additional holding member 190*a* made of an insulating material.

Figure 45:
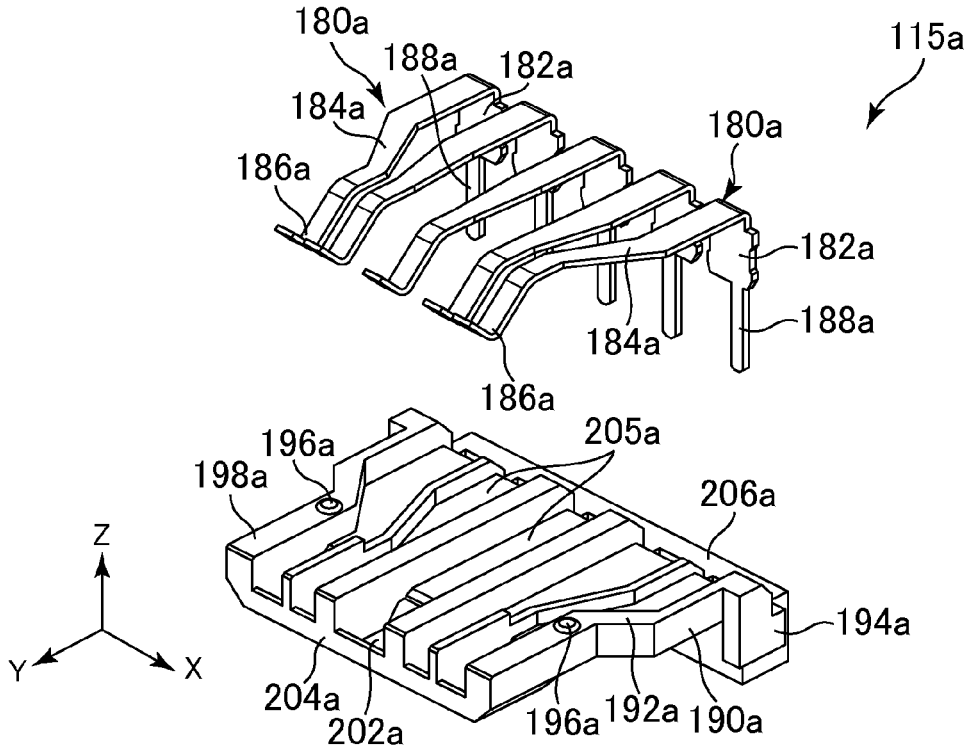
FIG. 45 is a partially exploded, perspective view showing the additional body of FIG. 44.

As shown in FIG. 45, the additional contacts 180*a* correspond to the special contacts 540*a*, respectively. Accordingly, the USB receptacle 100*a* has five additional contacts 180*a*. Each of the additional contacts 180*a* has a held portion 182*a*, a spring portion 184*a*, an additional contact part 186*a* and a fixed portion 188*a*. The held portion 182*a* extends in the negative Z-direction (i.e. downward). The spring portion 184*a* extends in the positive Y-direction (i.e. forward) from the positive Z-side end (i.e. upper end) of the held portion 182*a*. The additional contact part 186*a* is formed at a leading end of the spring portion 184*a*. In detail, the additional contact part 186*a* is formed to have a curve so that a part of the additional contact part 186*a* protrudes in the negative Z-direction. The additional contact part 186*a* has a bracket-like shape curving toward the negative Z-side. In other words, the additional contact 180*a* is bent so as to be formed with the additional contact part 186*a*. The fixed portion 188*a* further extends in the negative Z-direction (i.e. downward) from the held portion 182*a*. The held portion 182*a* is provided with press-fit projections projecting in the X-direction. The additional contact 180*a* is resiliently deformable. In detail, the spring portion 184*a* is resiliently deformable so that the additional contact part 186*a* is movable.

Figure 46:
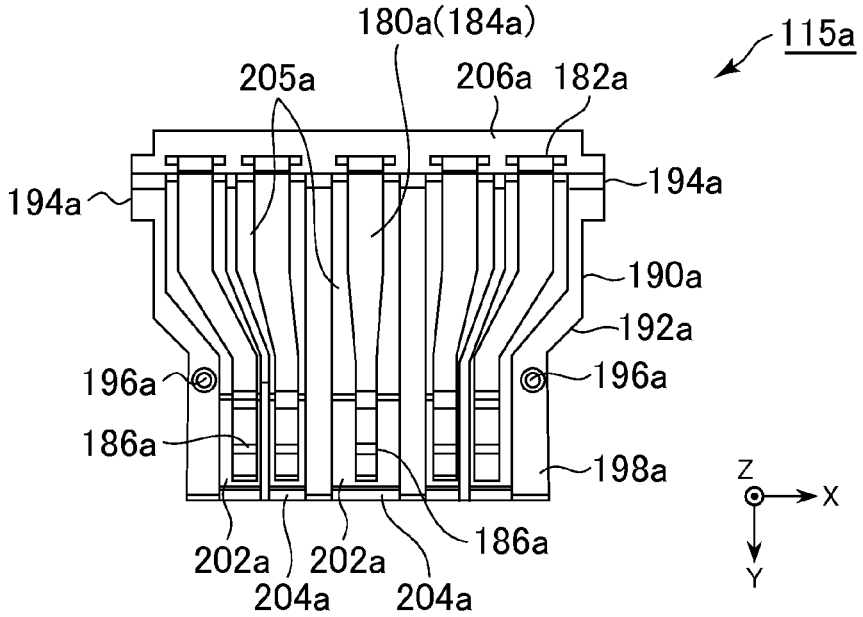
FIG. 46 is a top view showing the additional body of FIG. 44.

As shown in FIGS. 45 and 46, the additional holding member 190*a* has a support portion 198*a* and a contact-holding portion 206*a*. The support portion 198*a* has a plate-like shape extending in the Y-direction. In other words, the additional holding member 190*a* is installed on the holding member 150*a* so that the support portion 198*a* has the plate-like shape extending in the Y-direction. The contact-holding portion 206*a* is located rearward of the support portion 198*a*.

As can be seen from FIGS. 45, 46, 47 and 50, the support portion 198*a* is formed with five spring-accommodation portions 205*a*. The spring-accommodation portion 205*a* according to the present embodiment is a ditch having a bottom portion. Each of the spring-accommodation portions 205*a* is formed with a hole 202*a* in the vicinity of the positive Y-side end (i.e. front end) thereof. The hole 202*a* pierces the support portion 198*a* in the Z-direction. As can be seen from the above description, when the support portion 198*a* is seen upward from the negative Z-side thereof, the spring-accommodation portion 205*a* is invisible except the hole 202*a*.

Figure 50:
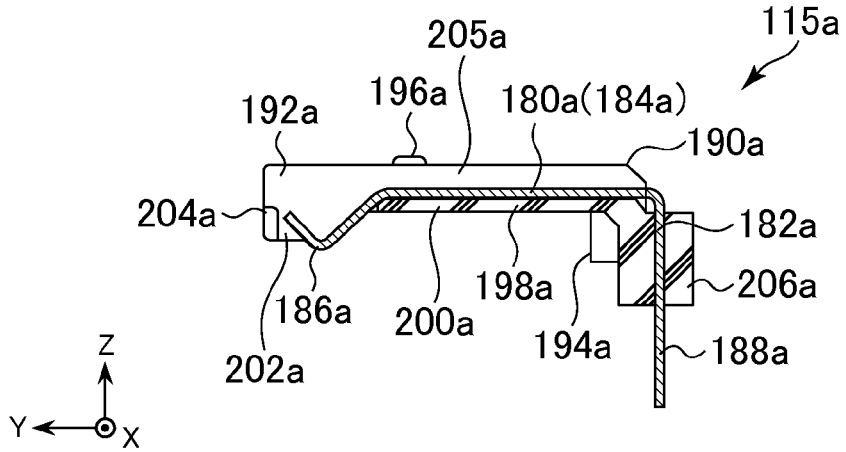
FIG. 50 is a cross-sectional view showing the additional body of FIG. 47, taken along lines E-E.
Figure 51:
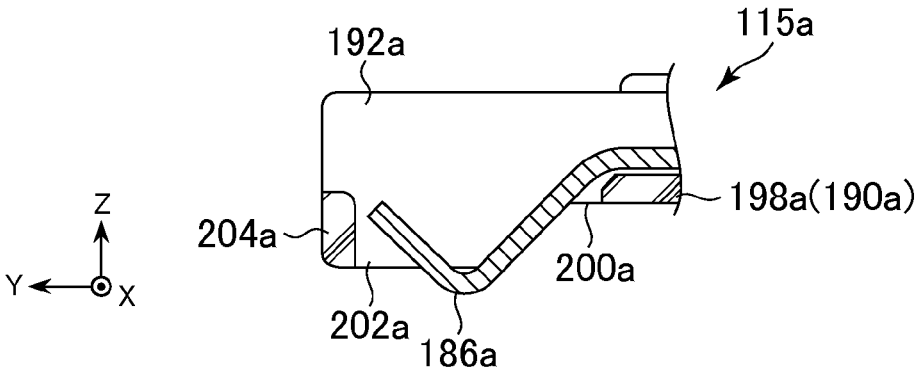
FIG. 51 is a partially enlarged, cross-sectional view showing in the vicinity of a leading end of the additional body of FIG. 50.
Figure 52:
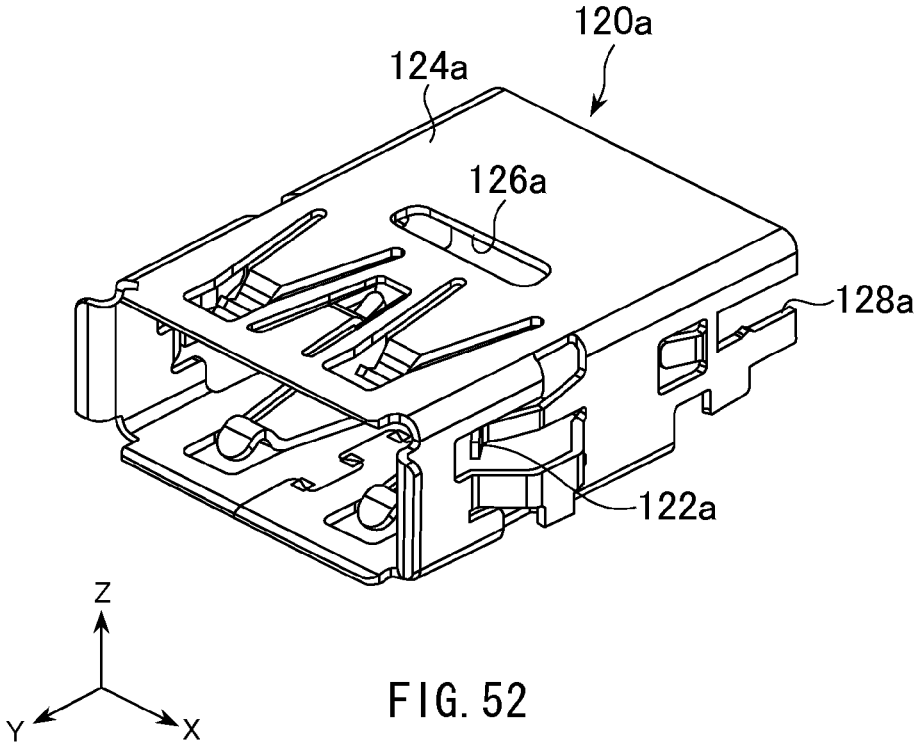
FIG. 52 is a perspective view showing a shell included in the USB receptacle of FIG. 33.

As can be seen from FIGS. 50 and 51, although the hole 202*a* extends in the Y-direction, the hole 202*a* does not arrive at the positive Y-side edge (i.e. front edge) of the support portion 198*a*. The support portion 198*a* is formed with an additional guard portion 204*a*. The additional guard portion 204*a* is provided at the positive Y-side end (i.e. front end) of the hole 202*a*.

As shown in FIGS. 44 to 47, 49 and 50, the additional holding member 190*a* has additional protrusions 196*a* formed on an upper surface 192*a* thereof. The additional protrusion 196*a* protrudes in the positive Z-direction (i.e. protrudes upward). As shown in FIGS. 44 to 48, the additional holding member 190*a* is formed with protruding portions (fit portions) 194*a* on both ends in the X-direction, respectively. The protruding portion 194*a* protrudes outward in the X-direction. The protruding portion 194*a* is configured to be engaged with the recess 172*a* of the holding member 150*a* (see FIGS. 33 and 35).

Figure 47:
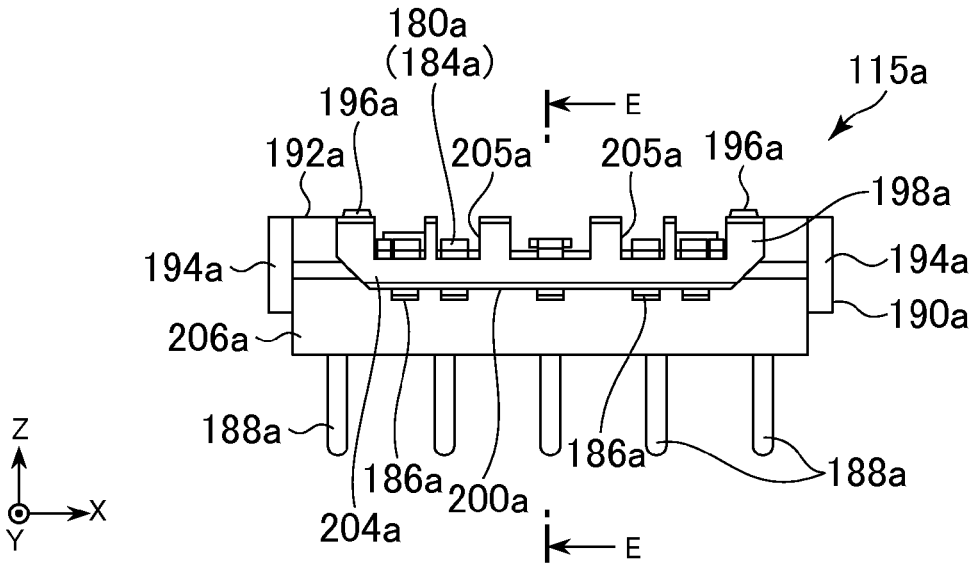
FIG. 47 is a front view showing the additional body of FIG. 44.
Figure 48:
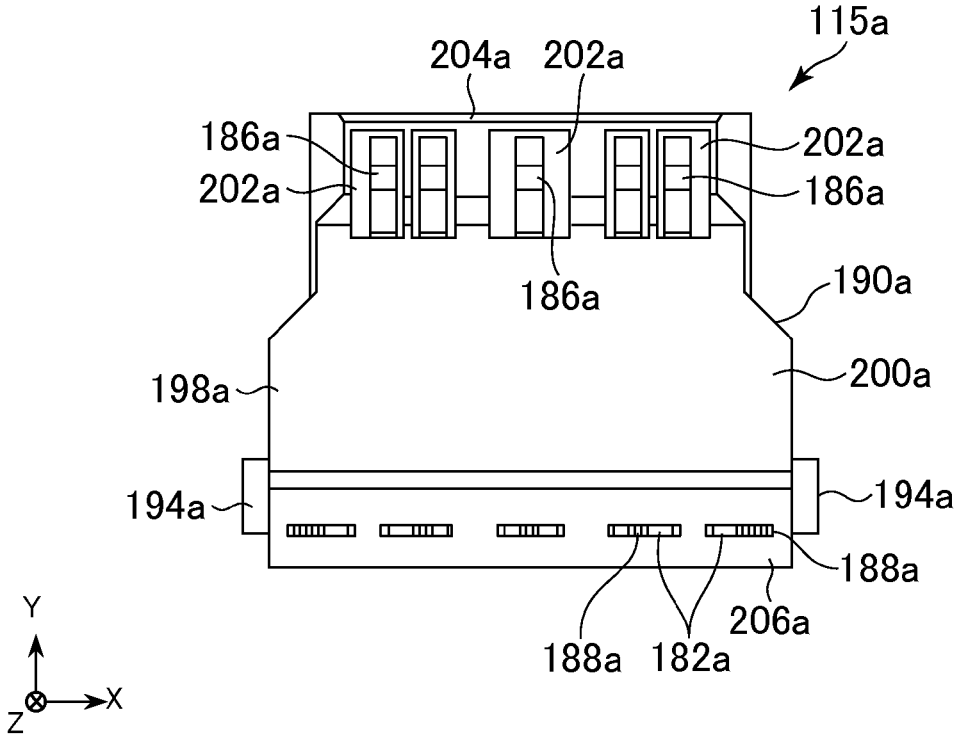
FIG. 48 is a bottom view showing the additional body of FIG. 44.
Figure 49:
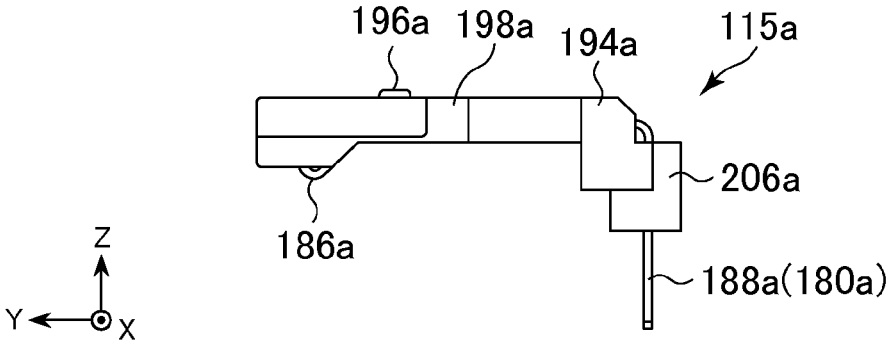
FIG. 49 is a side view showing the additional body of FIG. 44.

As can be seen from FIG. 45, the held portion 182*a* of the additional contact 180*a* is press-fitted in the contact-holding portion 206*a* so that the additional contact 180*a* is attached to the additional holding member 190*a*. As shown in FIGS. 47 and 50, the spring portion 184*a* is accommodated in the spring-accommodation portion 205*a* so as to be resiliently deformable. The additional contact part 186*a* partially passes through the hole 202*a* so that a part of the additional contact part 186*a* is located below a lower surface 200*a* of the support portion 198*a*. In other words, the additional contact 180*a* is held by the additional holding member 190*a* so that the additional contact part 186*a* partially projects through the hole 202*a* below the support portion 198*a*. As sown in FIG. 48, when the lower surface 200*a* of the support portion 198*a* is seen from the negative Z-side along the positive Z-direction in a holding state where the additional holding member 190*a* holds the additional contacts 180*a*, the additional contacts 180*a* are invisible except the additional contact parts 186*a*. As shown in FIG. 47, when the additional holding member 190*a* is seen along the negative Y-direction under the holding state, the additional contacts 180*a*, except parts which protrude from the lower surface 200*a* of the support portion 198*a*, are covered by the additional guard portion 204*a*. Therefore, it is possible to avoid that some members or portions are brought into unintentional contact with the additional contact 180*a* from the positive Y-side along the negative Y-direction.

As can be seen from FIG. 33, the additional body 115*a* is installed on the standard body 110*a* after the additional contacts 180*a* are attached to the additional body 115*a* (i.e. after the additional body 115*a* is assembled) as described above. More specifically, as can be seen from FIGS. 34, 35, 44 and 50, a part of the lower surface 200*a* of the support portion 198*a* of the additional holding member 190*a* is mounted on the mount portion 158*a* while the protruding portion 194*a* of the additional holding member 190*a* is engaged with the recess 172*a* of the holding member 150*a* so that the additional body 115*a* is attached to the standard body 110*a*.

As shown in FIG. 30, in a state where the additional body 115*a* is attached to the standard body 110*a*, the support portion 198*a* is arranged so as to be apart from the body portion 152*a* in the Z-direction (vertical direction). When seen upwardly along the positive Z-direction from a space interposed between the support portion 198*a* and the body portion 152*a*, the additional contact 180*a* is invisible except the additional contact part 186*a* protruding from the hole 202*a*. In other words, each of the additional contacts 180*a* is contactable only through the hole 202*a* of the support portion 198*a* in the space interposed between the support portion 198*a* and the body portion 152*a*. By configuring as described above, the risk that the additional contact 180*a* is brought into contact with the contact 130*a* may be lowered as possible.

As can be seen from FIGS. 31, 33 and 35, the shell 120*a* is attached to the holding member 150*a* after the additional body 115*a* is attached to the standard body 110*a*. In detail, the attached portions 128*a* of the shell 120*a* are mated rearward (i.e. along the negative Y-direction) with the respective attaching portions 176*a* of the holding member 150*a* so that the shell 120*a* is attached to the holding member 150*a*.

Figure 29:
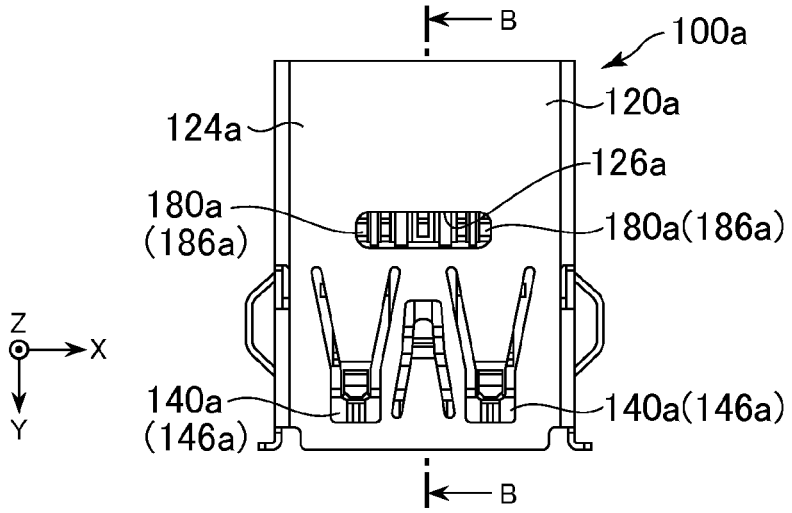
FIG. 29 is a top view showing the USB receptacle of FIG. 24.

As can be seen from FIGS. 29 and 31, the opening 126*a* of the shell 120*a* is located above the additional contact parts 186*a* of the additional contacts 180*a* in a state where the shell 120*a* is attached to the holding member 150*a*. Therefore, the additional contact part 186*a* is visible through the opening 126*a*. Moreover, the opening 126*a* is provided as described above so that the additional contact 180*a* is not brought into contact with the shell 120*a* even when the additional contact part 186*a* moves upward in the Z-direction (i.e. even when the additional contact 180*a* is resiliently deformed).

When the shell 120*a* is attached to the holding member 150*a* (i.e. attached to the standard body 110*a* and the additional body 115*a*), the additional protrusions 196*a* of the additional holding member 190*a* is brought into abutment with the shell 120*a* so as to press the additional holding member 190*a* against the holding member 150*a*. In detail, the additional protrusions 196*a* is brought into abutment with the shell 120*a* so that the additional body 115*a* (especially, the additional holding member 190*a*) receives a reaction force from the shell 120*a*. The additional holding member 190*a* is pressed against the standard body 110*a* (especially, against the holding member 150*a*) along the negative Z-direction (i.e. downward) by the aforementioned reaction force. In other words, the additional holding member 190*a* according to the present embodiment is (at least) partially interposed between the holding member 150*a* and the shell 120*a* in the Z-direction (vertical direction) to be fixed.

As can be seen from FIGS. 31 and 33, the positioner 320*a* is attached to the holding member 150*a* after the shell 120*a* is attached to the holding member 150*a* so that the USB receptacle 100*a* is formed.

Figure 53:
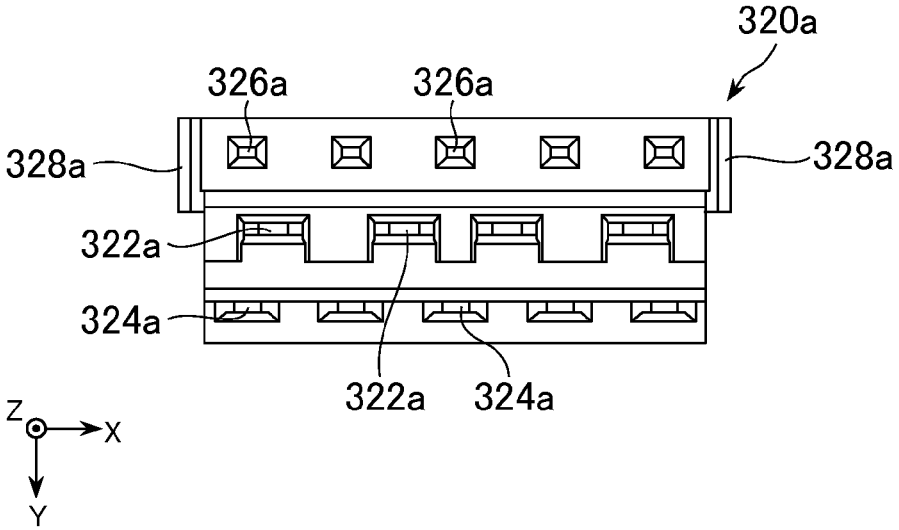
FIG. 53 is a top view showing a positioner included in the USB receptacle of FIG. 33.
Figure 54:
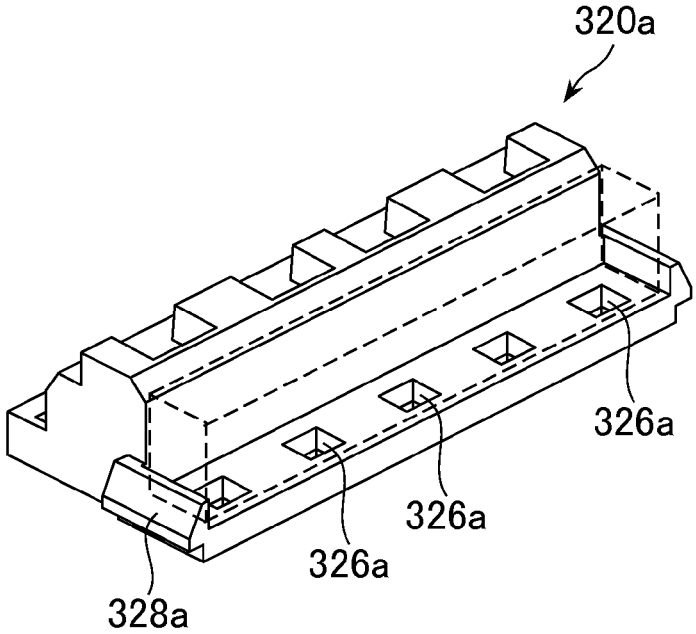
FIG. 54 is a perspective view showing the positioner of FIG. 53.

As shown in FIGS. 53 and 54, the positioner 320*a* is formed with three sets of positioning holes, namely a group of positioning holes 322*a*, a group of positioning holes 324*a* and a group of positioning holes 326*a*. The positioner 320*a* is further formed with engaged portions 328*a*. The positioning holes 322*a* correspond to the fixed portions 138*a* of the contacts 130*a*, respectively. The positioning holes 324*a* correspond to the fixed portions 148*a* of the contacts 140*a*, respectively. The positioning holes 326*a* correspond to the fixed portions 188*a* of the additional contacts 180*a*, respectively. The fixed portions 138*a*, 148*a* and 188*a* are inserted into the corresponding positioning holes 322*a*, 324*a* and 326*a*, respectively, so that the positions of the fixed portions 138*a*, 148*a* and 188*a* in the XY-plane are properly adjusted. Then, the positioner 320*a* is moved in the positive Z-direction (i.e. upward) so that the engaged portions 328*a* of the positioner 320*a* are engaged with the respective engaged portions 174*a* of the holding member 150*a*. Accordingly, the positioner 320*a* is attached and fixed to the holding member 150*a*.

When the special USB plug 500*a* is mated with the USB receptacle 100*a* configured as described above, the thin portion 562*a* of the special USB plug 500*a* is inserted between the body portion 152*a* of the holding member 150*a* and the support portion 198*a* of the additional holding member 190*a*. Accordingly, the contact parts 542*a* of the special contacts 540*a* are connected to the respective additional contact parts 186*a* of the additional contacts 180*a*. Meanwhile, the additional contact part 186*a* is moved in the positive Z-direction by the contact part 542*a*. The upper surface 124*a* of the shell 120*a* according to the present embodiment is provide with the opening 126*a* so that it is possible to avoid that the shell 120*a* is brought into contact with the additional contacts 180*a*.

Figure 34:
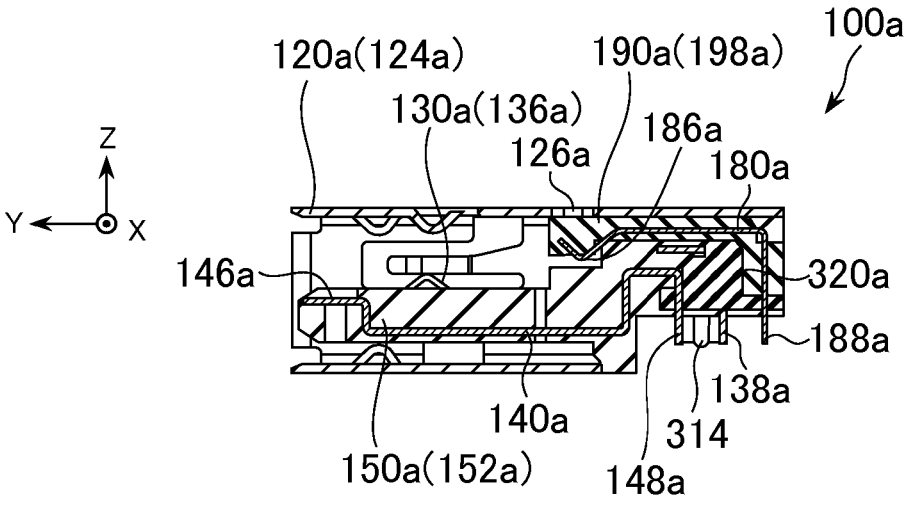
FIG. 34 is a cross-sectional view showing the USB receptacle of FIG. 29, taken along lines B-B.

As can be seen from FIGS. 34, 35 and 37, a leading end in the positive Y-direction (i.e. front end) of the support portion 198*a* of the additional holding member 190*a* is located at nearly the same position as the guard portion 170*a*. When the standard USB plug 400 is mated with the USB receptacle 100*a*, the standard USB plug 400 is not brought into abutment with the additional body 115*a* (i.e. additional holding member 190*a*). In other words, according to the present embodiment, a length of the additional holding member 190*a* in the Y-direction (predetermined direction) is designed so that the additional holding member 190*a* does not overlap the standard USB plug 400 when the USB receptacle 100*a* is mated with the standard USB plug 400.

As can be seen from FIGS. 24, 26, 30 and 33 to 37, when the special USB plug 500*a* is mated with the USB receptacle 100*a* along the negative Y-direction, the side protrusions (identified portions) 514*a* of the special USB plug 500*a* are brought into contact with (i.e. are connected to) the contact portion 306 of the first detector 300*r* and the contact portion 306 of the second detector 300*l*, respectively. On the other hand, when the standard USB plug 400 is mated with the USB receptacle 100*a*, the standard shell 410 is not brought into contact with the contact portions 306. In detail, the guard portion 170*a* is located between the standard shell 410 and the first detector 300*r* (or the second detector 300*l*) in the Y-direction when the USB receptacle 100*a* is mated with the standard USB plug 400. Moreover, according to the present embodiment, the additional guard portion 204*a* is located between the standard shell 410 and the additional contacts 180*a* in the Y-direction when the USB receptacle 100*a* is mated with the standard USB plug 400.

As can be seen from FIGS. 30 and 37, the first detector 300*r* and the second detector 300*l* is not in contact with the shell 120*a*. In other words, the first detector 300*r* and the second detector 300*l* are held by the holding member 150*a* so as not to be directly connected to the shell 120*a*. The shell 120*a* is connected with the standard shell 410 or the special shell 510*a* via the shell-side connecting portion 122*a* when the USB receptacle 100*a* is mated with the standard USB plug 400 or the special USB plug 500*a*. Accordingly, the first detector 300*r* and the second detector 300*l* are electrically connected with the shell 120*a* upon the mating of the USB receptacle 100*a* with the special USB plug 500*a* while being electrically unconnected with the shell 120*a* upon the mating of the USB receptacle 100*a* with the standard USB plug 400.

According to the present embodiment, it is possible to detect whether the USB receptacle 100*a* is mated with the standard USB plug 400 or the special USB plug 500*a* by detecting whether the first detector 300*r* and the second detector 300*l* are electrically connected with the shell 120*a* or not. Specifically, similar to the first embodiment, it may be possible to detect the mating plug (i.e. the standard USB plug 400 or the special USB plug 500*a*) by detecting electric current or electric potential. In other words, the USB receptacle 100*a* includes the detecting structure similar to the first embodiment.

Each of the USB receptacle 100*a* and the special USB plug 500*a* (i.e. the connector according to the second embodiment) has various structural features in addition to the detecting structure which uses the detector 300*r* and 300*l*. Therefore, it is possible to provide a plurality of signal lines, in addition to signal lines defined by the USB 3.0 standard, within the connector having a limited size. When the present invention is worked, it is possible to use the aforementioned structural features instead of the detecting structure. In other words, only one of the structural features and the detecting structure may be used. On the other hand, the structural features together with the detecting structure may be used.

According to the first embodiment or the second embodiment, regarding the special shell (i.e. the special shell 510, 510*x*, 510*y* or 510*a*), only the identified portion (i.e. the identified portion 512*r*, 512*l* or 514*a*) protrudes in the negative Y-direction. However, a part other than the identified portion may protrude in the negative Y-direction. For example, an upper edge or a lower edge of the special shell may protrude in the negative Y-direction. More specifically, the special shell may be configured so that a part of the special shell, which should be prevented from being brought into contact with the detector (i.e. the detector 300*r* or 300*l*), is depressed from an edge portion of the special shell along the positive Y-direction. The mating USB receptacle may also be modified so as to correspond to the shape of the special shell.

Figure 55:
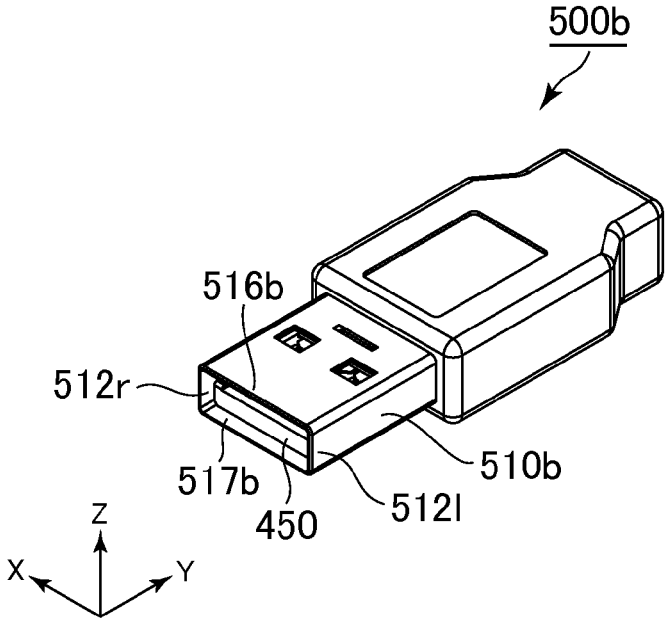
FIG. 55 is a perspective view showing a modification of the special USB plug.

As can be seen from FIGS. 6 and 55, a special shell 510*b* of a special USB plug 500*b* shown in FIG. 55 has a similar, but different, shape to the standard shell 410 of the standard USB plug 400 shown in FIG. 6. Specifically, regarding the standard USB plug 400, a leading end in the negative Y-direction of the standard shell 410 and a leading end in the negative Y-direction of the standard holding member 450 are located on the substantially same plane perpendicular to the Y-direction. Regarding the special USB plug 500*b*, a leading end in the negative Y-direction of the special shell 510*b* protrudes forward of a leading end (i.e. front end) in the negative Y-direction of the standard holding member 450. In detail, as shown in FIG. 55, the special shell 510*b* of the special USB plug 500*b* has the first identified portion 512*r*, the second identified portion 512*l*, an upper-side protruding portion 516*b* and a lower-side protruding portion 517*b*. The first identified portion 512*r*, the second identified portion 512*l*, the upper-side protruding portion 516*b* and the lower-side protruding portion 517*b* protrude forward of the front end of the standard holding member 450 in the Y-direction by the same length.

Figure 56:
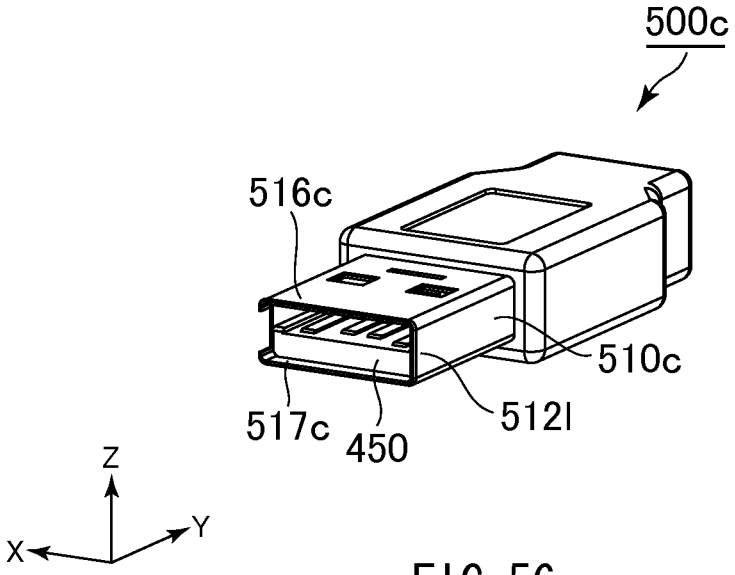
FIG. 56 is a perspective view showing another modification of the special USB plug.

Referring to FIG. 56, a special shell 510*c* of a special USB plug 500*c* has the second identified portion 512*l*, an upper-side protruding portion 516*c* and a lower-side protruding portion 517*c*. As can be seen from FIGS. 55 and 56, a part of the special shell 510*c* shown in FIG. 56, which corresponds to the first identified portion 512*r* of the special shell 510*b* shown in FIG. 55, is depressed in the positive Y-direction. In other words, the second identified portion 512*l*, the upper-side protruding portion 516*c* and the lower-side protruding portion 517*c* protrude forward of the front end of the standard holding member 450 in the Y-direction by the same length.

Similarly, the second identified portion 512*l* of the special shell 510*b* shown in FIG. 55 may be depressed in the positive Y-direction.

The Third Embodiment

Figure 57:
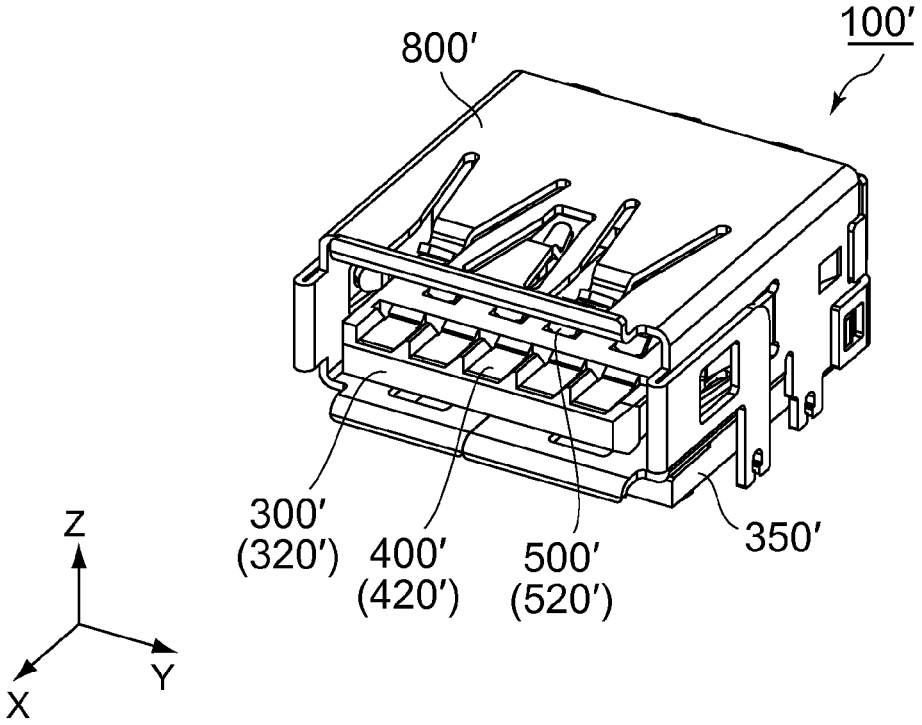
FIG. 57 is a perspective view showing a USB receptacle (special receptacle) according to a third embodiment of the present invention.

As shown in FIG. 57, a special receptacle (USB receptacle) 100' according to the third embodiment of the present invention is matable with a mating plug, which is any one of a plurality types of plugs, along the X-direction (predetermined direction). Hereinafter, a mating side of the special receptacle 100' in the X-direction (predetermined direction) is also described as a "front side" and the opposite side to the mating side is described as a "rear side". In other words, the positive X-side is the front side and the negative X-side is the rear side. The special receptacle 100' according to the present embodiment is configured to be mated with the mating plug which is inserted along the negative X-direction (i.e. inserted rearward). According to the present embodiment, the insert direction along which the mating plug is inserted into the special receptacle 100' is the negative X-direction while the removing direction along which the mating plug is removed from the special receptacle 100' is the positive X-direction.

According to the present embodiment, the mating plugs matable with the special receptacle 100' include at least three types of plugs, namely a USB 3.0 plug (standard USB plug) 10' in accordance with the USB 3.0 standard, a USB 2.0 plug (standard USB plug) 30' in accordance with a USB 2.0 standard (i.e. the USB standard) and a special plug (special USB plug) 20' formed by modifying the USB 3.0 plug 10' or the USB 2.0 plug 30'. Therefore, the special receptacle 100' according to the present embodiment is matable with any one of the USB 3.0 plug 10', the USB 2.0 plug 30' and the special USB plug 20' along the X-direction. In other words, the special receptacle 100' is configured so that the standard USB plugs 10' and 30' and the special USB plug 20' are selectively matable therewith and removable therefrom along the X-direction.

Figure 58:
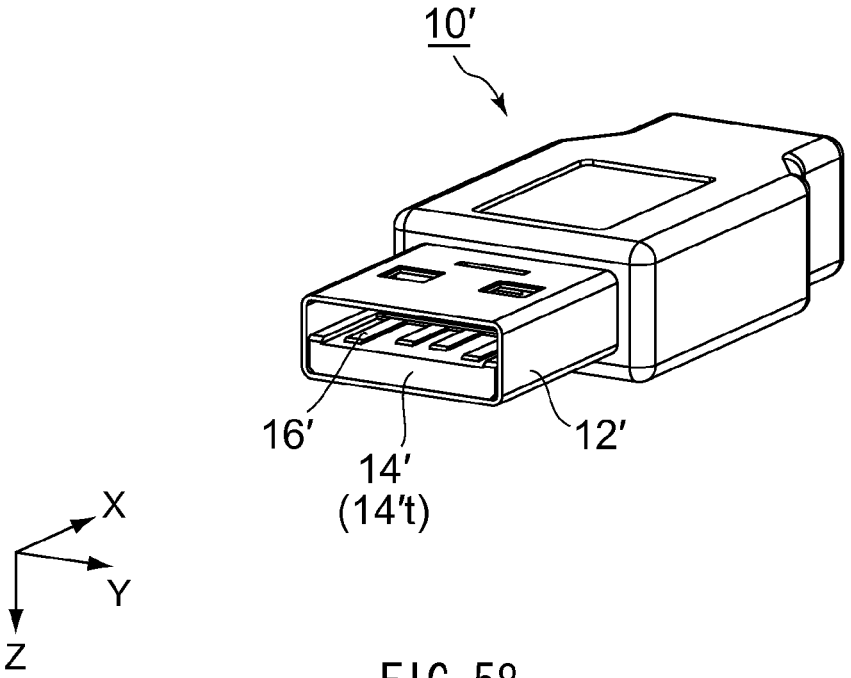
FIG. 58 is a perspective view showing a USB 3.0 plug in accordance with a USB 3.0 standard, wherein the USB 3.0 plug is matable with the special receptacle of FIG. 57.

Referring to FIG. 58, the USB 3.0 plug 10' comprises a standard shell 12' made of a metal (i.e. conductive material), a holding member 14' made of an insulating material and a plurality of contacts 16'. The standard shell 12' has sizes and shapes in accordance with the USB 3.0 standard. The holding member 14' is covered by the standard shell 12'. The contacts 16' are held by the holding member 14'. The contacts 16' are for the USB 2.0 connection. Each of the contacts 16' has a plate-like contact part. The USB 3.0 plug 10' is further provided with a plurality of contacts (not shown) for the USB 3.0 connection. The contacts for the USB 3.0 connection are held by the holding member 14'.

Figure 73:
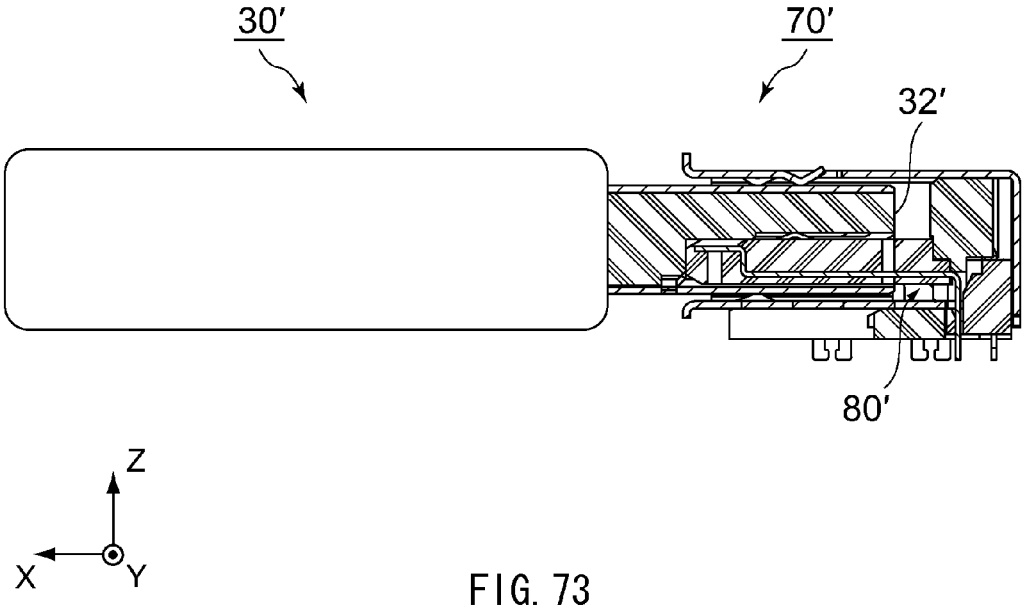
FIG. 73 is a cross-sectional view showing a USB 3.0 receptacle in accordance with the USB 3.0 standard and a USB 2.0 plug in accordance with a USB 2.0 standard, wherein the USB 3.0 receptacle and the USB 2.0 plug are mated with each other.

As shown in FIG. 73, the USB 2.0 plug 30' has an outline similar to the USB 3.0 plug 10'. In detail, the USB 2.0 plug 30', similar to the USB 3.0 plug 10', comprises a shell, a holding member and a plurality of contacts. The contacts of the USB 2.0 plug 30' are for the USB 2.0 connection. As shown in FIG. 73, the USB 2.0 plug 30' is matable with a USB 3.0 receptacle 70' in accordance with the USB 3.0 standard. The USB 3.0 plug 10' is also matable with the USB 3.0 receptacle 70'. Under a state where the USB 2.0 plug 30' is mated with the USB 3.0 receptacle 70', because of standard tolerance, the USB 2.0 plug 30' may arrive at a deeper position in the USB 3.0 receptacle 70' than a position where the USB 3.0 plug 10' arrives when being mated with the USB 3.0 receptacle 70'. As shown in FIG. 73, the USB 3.0 receptacle 70' has a space 80' formed therewithin. The space 80' is designed so that a leading end 32' of the USB 2.0 plug 30' does not arrive even when the USB 2.0 plug 30' is mated with the USB 3.0 receptacle 70'. As can be seen from the above description, even if the standard shell 12' of the USB 3.0 plug 10' is modified so that a leading end of the standard shell 12' is extended in the negative X-direction (i.e. extended rearward), the modified USB 3.0 plug 10' is matable with USB 3.0 receptacle 70', provided that a length of the extended part in the X-direction (predetermined direction) is smaller than a size of the space 80' in the X-direction. The special plug 20' according to the present embodiment is configured in consideration with the aforementioned space 80'.

Figure 59:
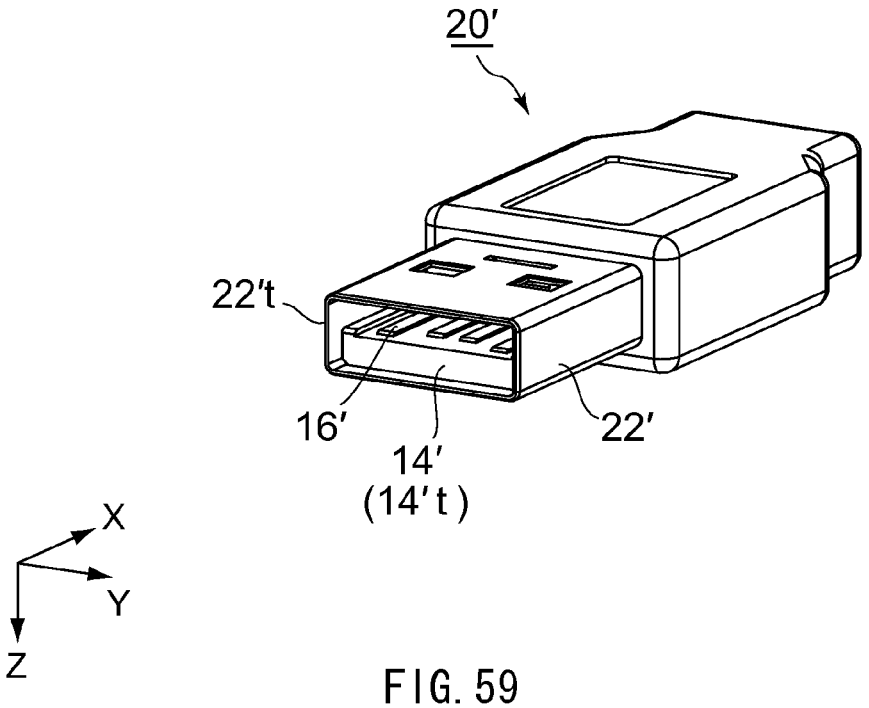
FIG. 59 is a perspective view showing a special USB plug (special plug) configured by modifying the USB 3.0 plug of FIG. 58, wherein the special plug is matable with the special receptacle of FIG. 57.
Figure 71:
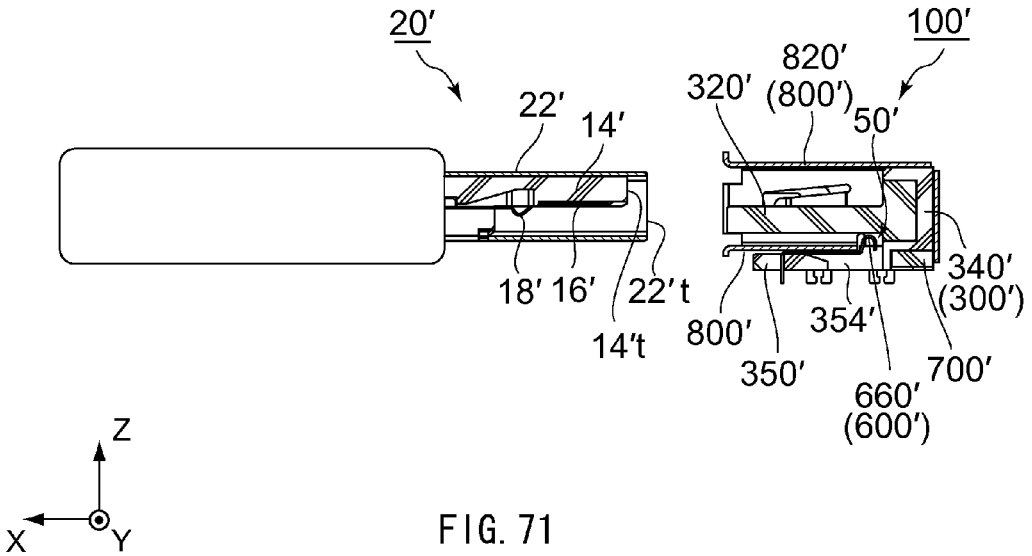
FIG. 71 is a cross-sectional view showing the special receptacle of FIG. 57 and the special plug of FIG. 59, wherein the special receptacle and the special plug are not yet mated with each other.
Figure 72:
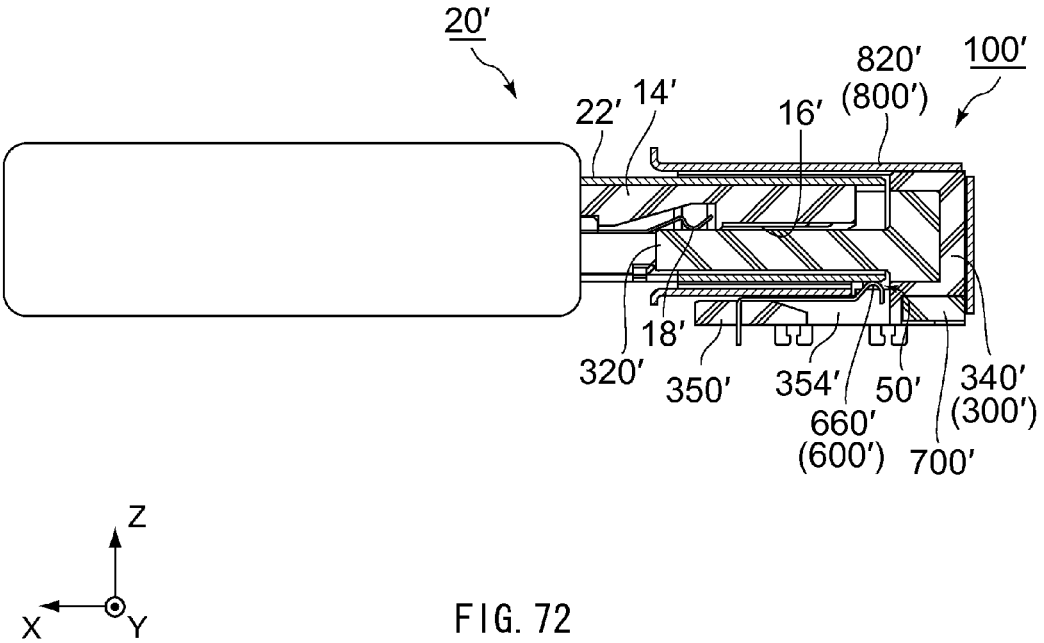
FIG. 72 is a cross-sectional view showing the special receptacle of FIG. 57 and the special plug of FIG. 59, wherein the special receptacle and the special plug are mated with each other.

Referring to FIGS. 59, 71 and 72, the special plug 20' according to the present embodiment has a special shell 22' made of a conductive material. The special shell 22' has a leading end (end surface) 22'*t* in the X-direction. The special shell 22' is configured by modifying the standard shell 12' so that the special shell 22' extends longer in the negative X-direction than the standard shell 12'. More specifically, the special shell 22' includes a part having the same shape as the standard shell 12' and a projecting part projecting over the part in the X-direction so that the special plug 20' has a different structure from the USB 3.0 plug 10'. The special shell 22' constitutes the detecting structure as described later. The special shell 22' according to the present embodiment is gold-plated (i.e. plated by Au) so as to enhance the reliability of the electrical connection. The special plug 20' comprises the same portions as the USB 3.0 plug 10' except the special shell 22'. More specifically, the special plug 20' comprises the holding member 14' and a plurality of the contacts 16' and a plurality of contacts 18'. The holding member 14' has a leading end (end surface) 14'*t* in the X-direction. The contacts 16' and the contacts 18' are held by the holding member 14'. The contacts 16' are for the USB 2.0 connection while the contacts 18' are for the USB 3.0 connection.

As can be seen from FIG. 58, regarding the USB 3.0 plug 10', a leading end of the standard shell 12' and the leading end 141 of the holding member 14' are located at the substantially same position in the X-direction. On the other hand, as shown in FIG. 71, regarding the special plug 20', the leading end 22'*t* of the special shell 22' protrudes in the negative X-direction over the leading end 14'*t* of the holding member 14'. In other words, the special shell 22' has a projecting part which projects beyond the leading end 141 of the holding member 14'. A size of the projecting part of the special shell 22' is designed in consideration with the aforementioned space 80' (see FIG. 73) in the USB 3.0 receptacle 70'. In detail, the projecting part of the special shell 22' has a predetermined size so as to be accommodated in the space 80' when the special plug 20' is inserted in and mated with the USB 3.0 receptacle 70'. Specifically, the predetermined size (i.e. the difference between a length of the special shell 22' in the X-direction and a length of the standard shell 12' in the X-direction) according to the present embodiment is 1.3 mm.

Figure 60:
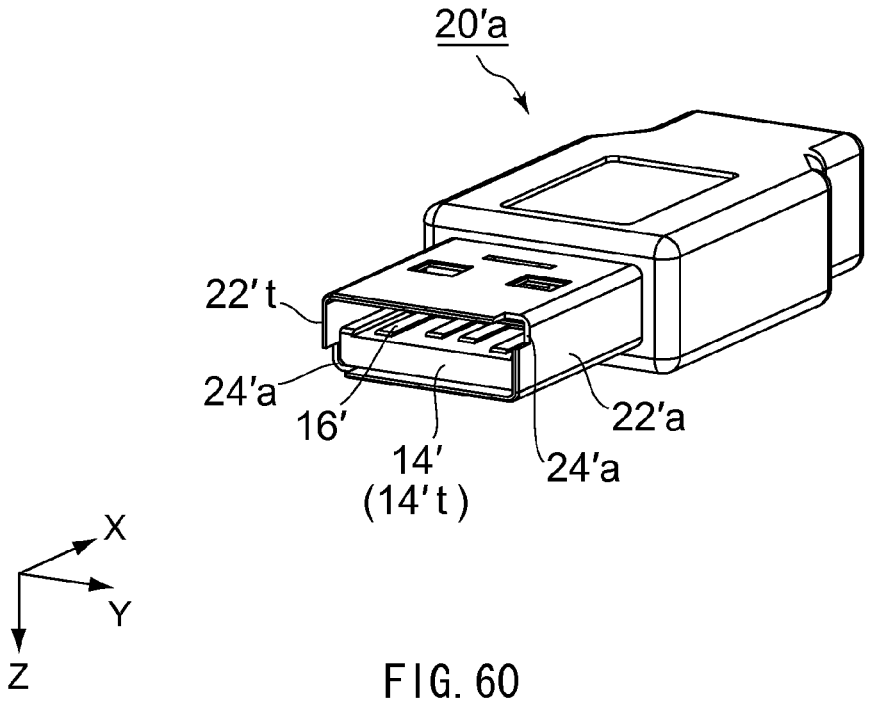
FIG. 60 is a perspective view showing other special USB plug (special plug) configured by modifying the USB 3.0 plug of FIG. 58, wherein the other special plug is matable with the special receptacle of FIG. 57.
Figure 61:
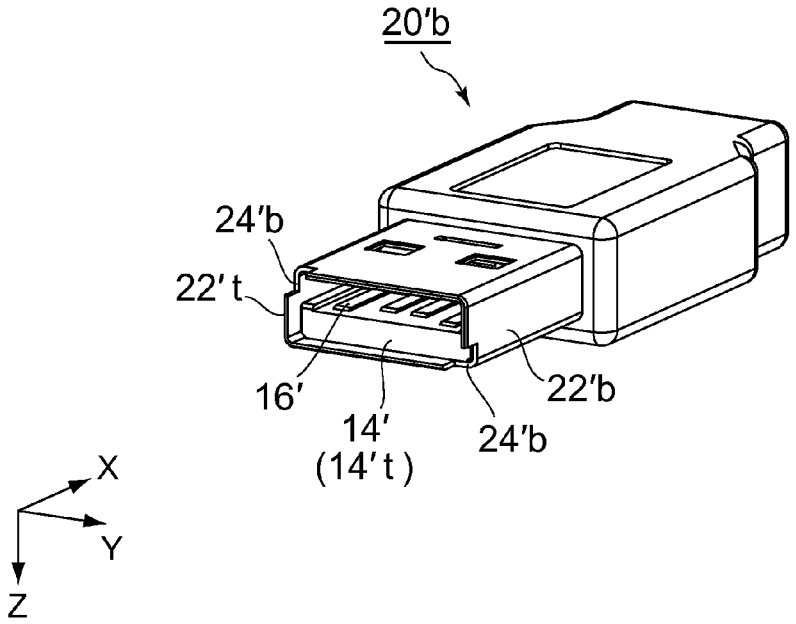
FIG. 61 is a perspective view showing yet other special USB plug (special plug) configured by modifying the USB 3.0 plug of FIG. 58, wherein the yet other special plug is matable with the special receptacle of FIG. 57.

Referring to FIGS. 60 and 61, each of a special plug (special USB plug) 20'*a* and a special plug (special USB plug) 20'*b* is configured, similar to the special plug 20', so as to be matable and connectable to the special receptacle 100'. As can be seen from FIGS. 59 to 61, each of the special plug 20'*a* and the special plug 20'*b* basically has the same structure as the special plug 20'. For example, the special plugs 20'*a* and 20'*b* comprise special shells 22'*a* and 22'*b*, respectively. Each of the special plugs 20'*a* and 20'*b* further comprises the holding member 14'. Each of the special shells 22'*a* and 22'*b* has a projecting part projecting in the negative X-direction from the holding member 14'. A size of the projecting part of each of the special shells 22'*a* and 22'*b* in the X-direction is same as a size of the projecting part of the special shells 22' in the X-direction. In other words, a maximum projecting size of the projecting part of each of the special shells 22'*a* and 22'*b* is same as the projecting size of the projecting part of the special shells 22'. Each of the special shells 22'*a* and 22'*b*, similar to the special shells 22', has the leading end (end surface) 22'*t* in the X-direction. The special shells 22'*a* and 22'*b* have two notches 24'*a* and two notches 24'*b*, respectively, so that each of the special shells 22'*a* and 22'*b* is different from the special shell 22'. As can be seen from FIG. 60, when the mating end of the special plugs 20'*a* is seen along the positive X-direction, the two notches 24'*a* of the special shells 22'*a* are located on opposite corners of a rectangle, respectively. Similarly, as can be seen from FIG. 61, when the mating end of the special plugs 20'*b* is seen along the positive X-direction, the two notches 24'*b* of the special shells 22'*b* are located on opposite corners of a rectangle, respectively. The corner on which the notch 24'*a* is located is different from the corner on which the notch 24'*b* is located.

As shown in FIGS. 59 to 61, only the special shell 22', 22'*a* or 22'*b* of the special plug 20', 20'*a* or 20'*b* is a different portion from the USB 3.0 plug 10'. In other words, the holding member 14' of each of the special plugs 20', 20'*a* and 20'*b* is same as the holding member 14' of the USB 3.0 plug 10' while each of the special shells 22', 22'*a* and 22'*b* is different from the standard shell 12'. The leading end 14'*t* of the holding member 14' of the special plug 20', 20'*a* and 20'*b* are located rearward (i.e. inward) of the leading end 22'*t* of the special shell 22', 22'*a* and 22'*b* in the X-direction (predetermined direction), respectively. However, the present invention is not limited to the aforementioned structure. For example, the leading end 14'*t* of the holding member 14' of the special plug 20', 20'*a* and 20'*b* may be located at the same position as the leading end 22'*t* of the special shell 22', 22'*a* and 22'*b* in the X-direction (predetermined direction), respectively. Moreover, the leading end 14'*t* of the holding member 14' of the special plug 20', 20'*a* and 20'*b* may be located between the positions illustrated in FIGS. 59 to 61 and the leading end 22'*t* of the special shell 22', 22'*a* and 22'*b*, respectively. In other words, the leading end 141 of the holding member 14' of the special plug 20', 20'*a* and 20'*b* may extend so as to be nearer to the leading end 22'*t* of the special shell 22', 22'*a* and 22'*b*, respectively.

Figure 62:
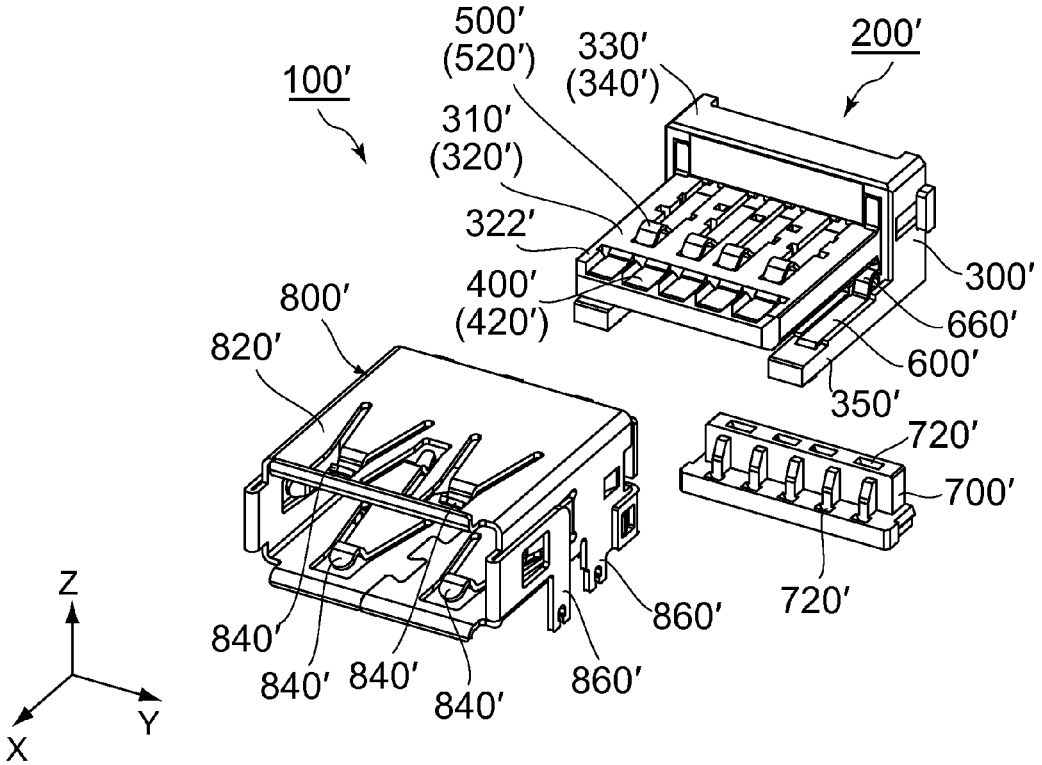
FIG. 62 is a partially exploded, perspective view showing the special receptacle of FIG. 57.
Figure 63:
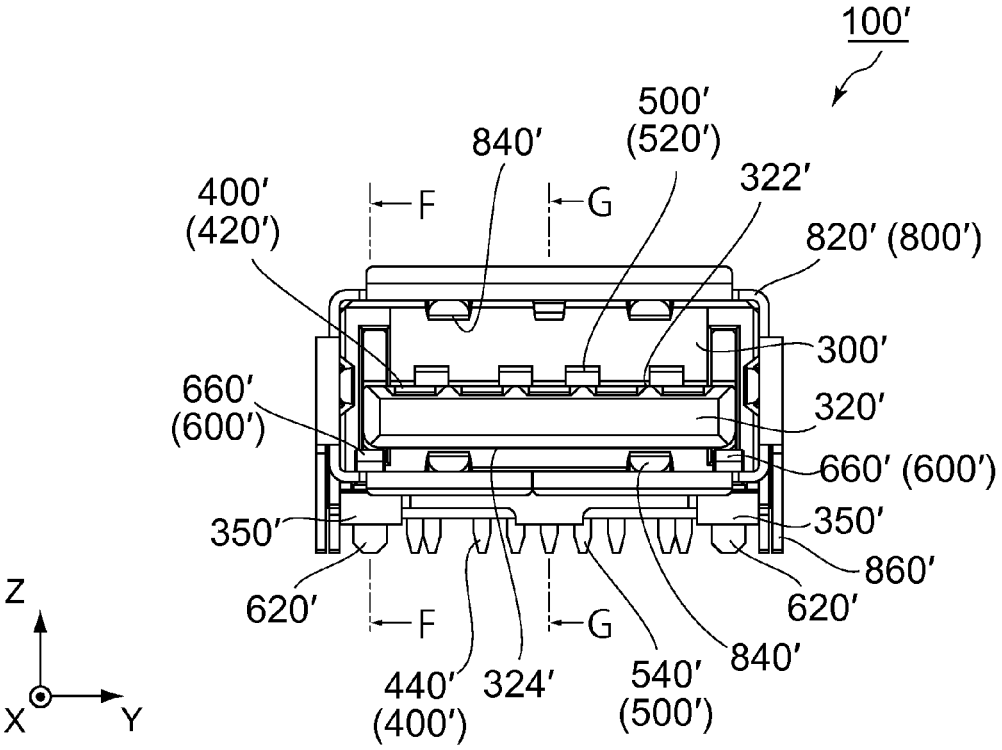
FIG. 63 is a front view showing the special receptacle of FIG. 57.
Figure 64:
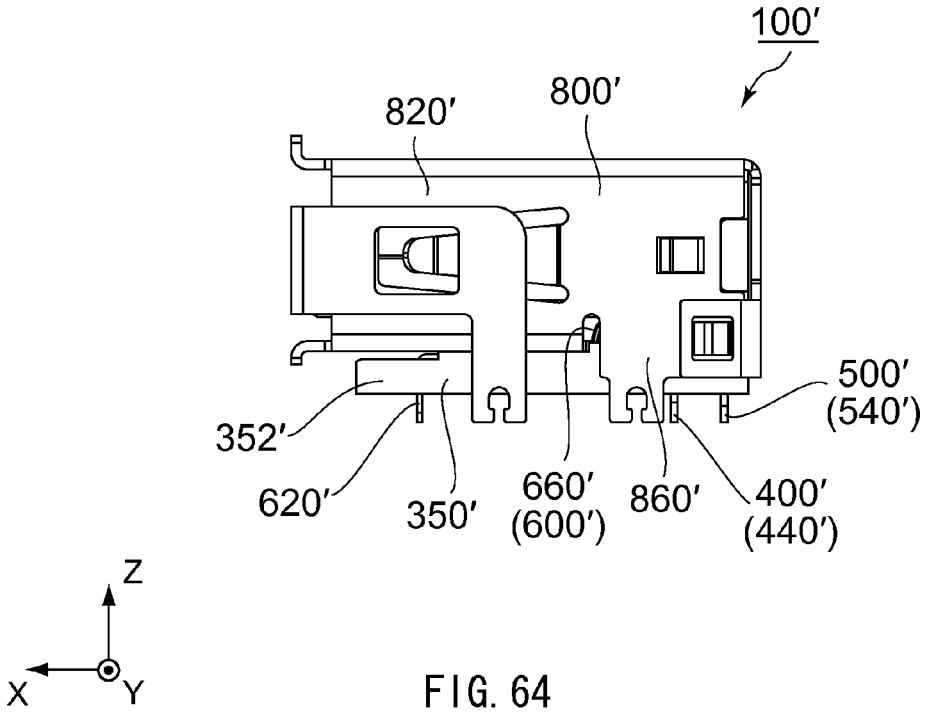
FIG. 64 is a side view showing the special receptacle of FIG. 57.

Referring to FIGS. 57 and 62, the special receptacle 100' according to the present embodiment roughly comprises a body structure 200', a positioner 700' and a shell 800'.

As shown in FIGS. 62 and 67 to 69, the body structure 200' comprises a holding member 300' made of an insulating material, a plurality of (specifically, five) first contacts (contacts) 400', a plurality of (specifically, four) second contacts (contacts) 500' and two detectors 600'. The first contacts 400' are in accordance with the USB 3.0 standard. Each of the first contacts 400' has a first contact part (contact part) 420' and a fixed portion 440'. The second contacts 500' are in accordance with the USB 2.0 standard. Each of the second contacts 500' has a second contact part (contact part) 520' and a fixed portion 540'.

The holding member 300' holds the first contacts 400' and the second contacts 500'. In detail, the holding member 300' according to the present embodiment comprises a first member (member) 310' and a second member (member) 330'. The first member 310' mainly holds the first contacts 400'. The second member 330' mainly holds the second contacts 500'. As described above, the holding member 300' according to the present embodiment is formed with two (i.e. a plurality of) members 310' and 330'. According to the present embodiment, the plurality of members 310' and 330' of the holding member 300' consist of the first member 310' and the second member 330'. However, the holding member 300' may comprise three or more members. On the contrary, the holding member 300' may be formed integrally.

The first member 310' has a plate portion 320' and two inserted portions 315'. The plate portion 320' extends forward in the X-direction (i.e. extends in the positive X-direction) so as to have an upper surface 322' and a lower surface 324'. The inserted portions 315' project in the negative X-direction (i.e. project rearward) from opposite ends in the Y-direction (lateral direction or pitch direction) of the plate portion 320', respectively. The first contacts 400' according to the present embodiment are insert-molded in the first member 310' (i.e. the holding member 300') so that the first contact parts 420' of the first contacts 400' are arranged (i.e. are located) on the upper surface 322' of the plate portion 320'. The first contacts 400' according to the present embodiment are embedded in the first member 310' when the first member 310' is formed. However, for example, the first contacts 400' may be press-fitted in the first member 310' to be held.

The second member 330' has a base portion 340' and two arm portions 350'. The base portion 340' constitutes a rear wall portion of the holding member 300'. The second contacts 500' according to the present embodiment are press-fitted in and held by the base portion 340' of the second member 330' (i.e. the holding member 300'). The fixed portion 540' of the second contact 500' is configured to be attached and fixed to a circuit board (not shown) on which the special receptacle 100' is mounted. In detail, the fixed portion 540' is bent to extend in the negative Z-direction (i.e. downward) after the second contact 500' is press-fitted in the base portion 340' of the second member 330'. However, the present invention is not limited to the aforementioned structure. For example, the second member 330' may be modified so that the second contacts 500' may be insert-molded in the second member 330' to be embedded. As can be seen from FIGS. 62 and 68, the positioner 700' is formed with positioning holes 720'. The fixed portions 540' are inserted in the respective positioning holes 720' so as to be arranged and held by the positioner 700'.

Figure 69:
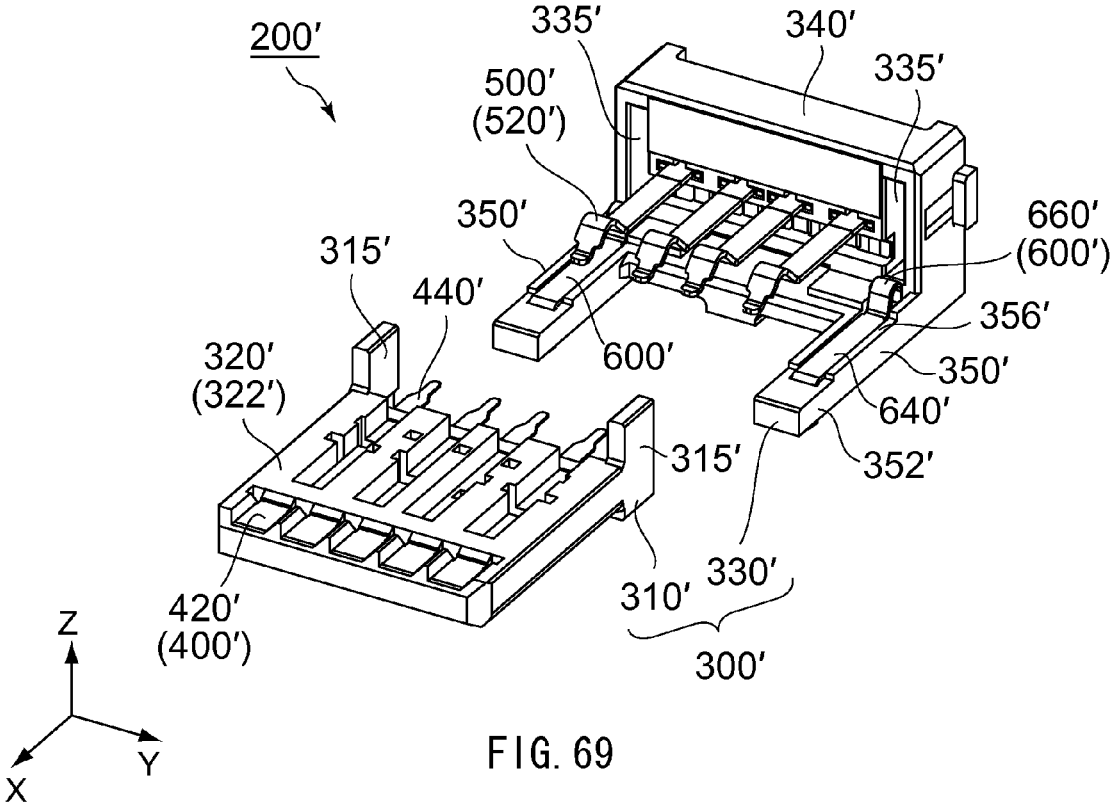
FIG. 69 is a partially exploded, perspective view showing the body structure of FIG. 67.

Referring to FIG. 69, the base portion 340' is formed with receiving portions 335' on both ends in the Y-direction thereof, respectively. The receiving portion 335' is a recess recessed in the negative X-direction. The inserted portions 315' are inserted in the respective receiving portions 335' (see FIG. 65) so that the first member 310' and the second member 330' are coupled to each other. The arm portion 350' extends long in the positive X-direction from in the vicinity of a lower end in the Z-direction (vertical direction) of the receiving portions 335'.

As can be seen from FIGS. 65 to 68, the plate portion 320' of the arm portion 350' extend in the positive X-direction (i.e. forward) from the base portion 340' under a state where the first member 310' and the second member 330' are coupled to each other. In other words, the plate portion 320' and the arm portion 350' extend in the same direction. The plate portion 320' and the arm portion 350' are located to be apart from each other in the Z-direction (vertical direction). In other words, the arm portion 350' is located apart from the plate portion 320' in the Z-direction. Especially, the arm portion 350' according to the present embodiment is located below the plate portion 320'.

As can be seen from FIGS. 62, 63, 66 and 67, when the first member 310' and the second member 330' are coupled to each other, the second contact parts 520' of the second contacts 500' are located (i.e. arranged) on the upper surface 322' of the plate portion 320'. In detail, the five first contact parts 420' are arranged in a row in the Y-direction in the vicinity of the positive X-side end (i.e. front end) of the upper surface 322' of the plate portion 320'. The four second contact parts 520' are located rearward of the five first contact parts 420'. In other words, the first contact parts 420' are located between a mating end of the special receptacle 100' and the second contact parts 520' in the X-direction. The four second contact parts 520' arranged in a row in the Y-direction. As can be seen from FIGS. 62, 66, 68 and 69, the fixed portion 440' of the first contact 400' is configured to be attached and fixed to a circuit board (not shown) on which the special receptacle 100' is mounted. In detail, the fixed portion 440' is bent to extend in the negative Z-direction (i.e. downward) after the first member 310' and the second member 330' are coupled to each other. As can be seen from FIGS. 62 and 68, the fixed portions 440' are inserted in the respective positioning holes 720' of the positioner 700' so as to be arranged and held by the positioner 700'.

Each of the arm portions 350' has a fixing portion 352' and a ditch portion 354'. The fixing portion 352' is formed with a slit-like slot. The ditch portion 354' is formed to be located rearward of the fixing portion 352'. The ditch portion 354' extends long in the X-direction while piercing the arm portion 350' in the Z-direction. However, the ditch portion 354' may be formed differently. For example, the ditch portion 354' may not be a through hole piercing the arm portion 350'. In other words, the ditch portion 354' may have a bottom portion.

Figure 70:
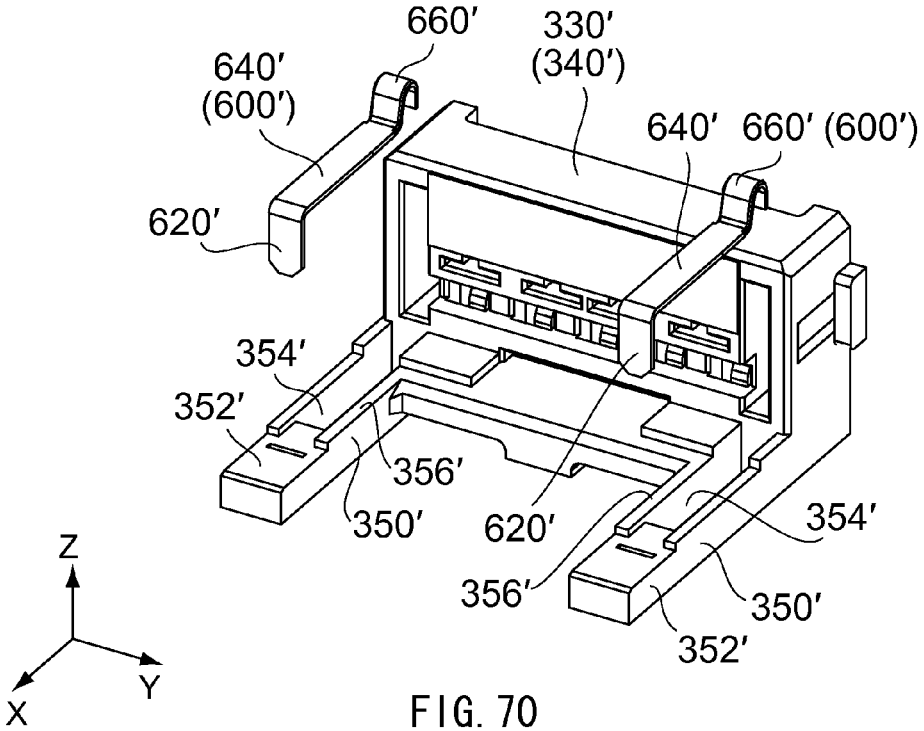
FIG. 70 is a perspective view showing a detector and a second member included in the body structure of FIG. 69.

As shown in FIG. 70, each of the detectors 600' has a fixed portion 620', a support portion 640' and a contact portion 660'. The fixed portion 620' extends in the negative Z-direction (i.e. downward). The support portion 640' extends in the negative X-direction (i.e. rearward) from the fixed portion 620' so as to have a narrow and long plate-like shape. The contact portion 660' is supported by the support portion 640'. In detail, the contact portion 660' is provided at the negative X-side end (i.e. rear end) of the support portion 640'. The detector 600' according to the present embodiment is gold-plated (Au plated) so as to enhance the reliability of the electrical connection.

Figure 65:
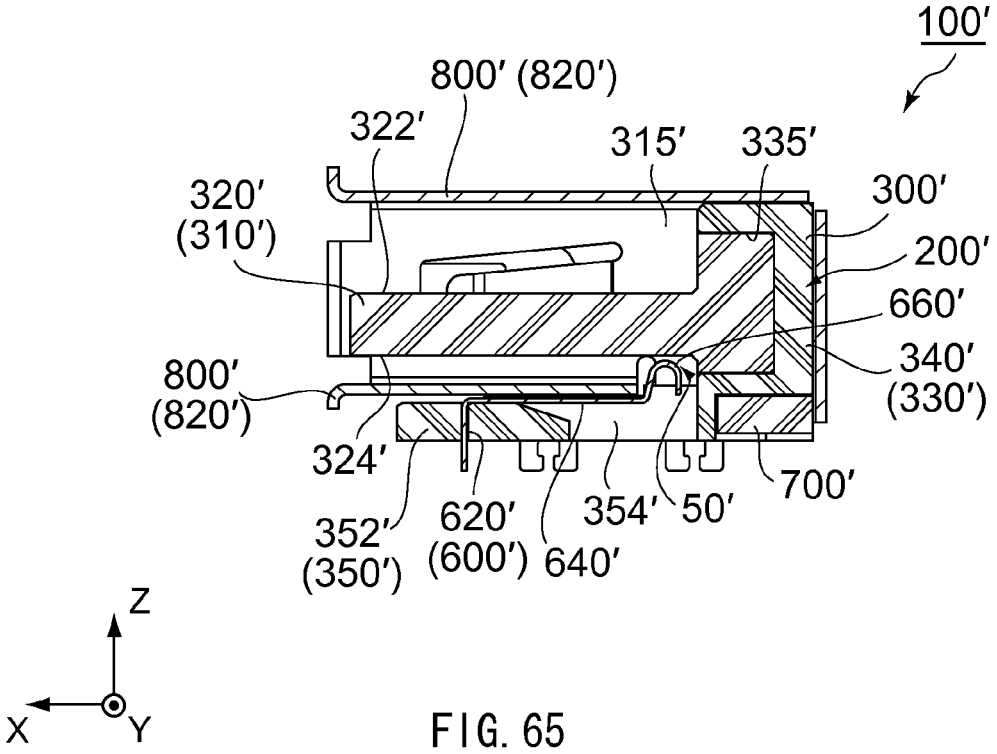
FIG. 65 is a cross-sectional view showing the special receptacle of FIG. 63, taken along lines F-F.
Figure 66:
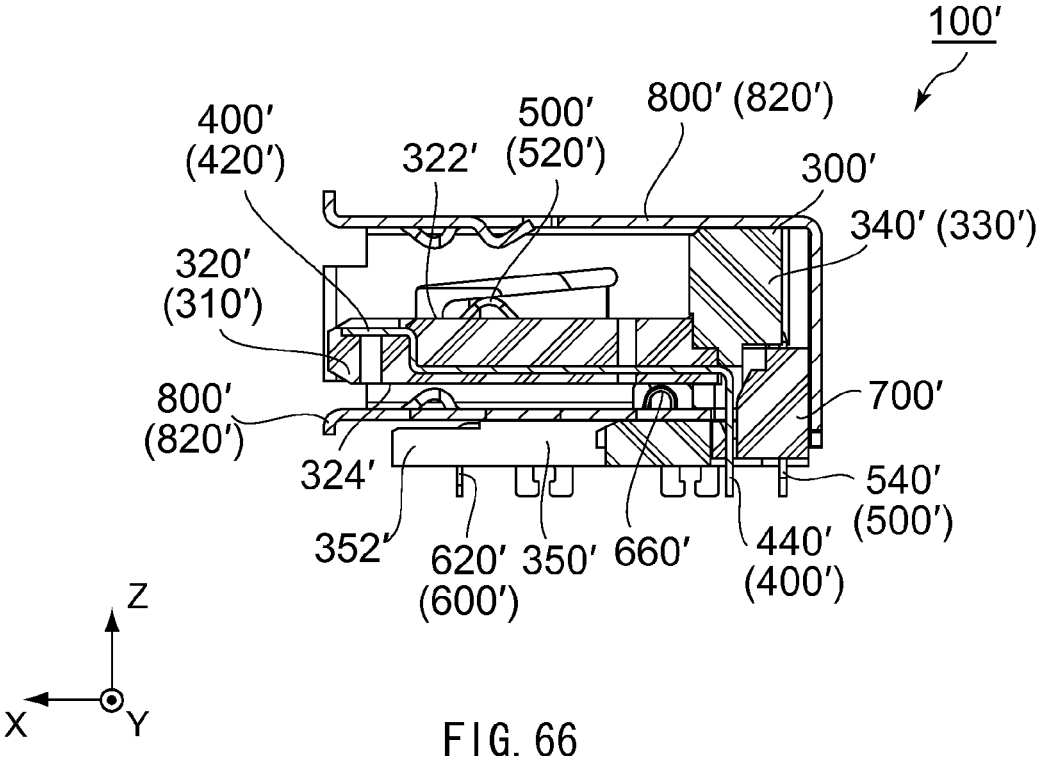
FIG. 66 is a cross-sectional view showing the special receptacle of FIG. 63, taken along lines G-G.
Figure 67:
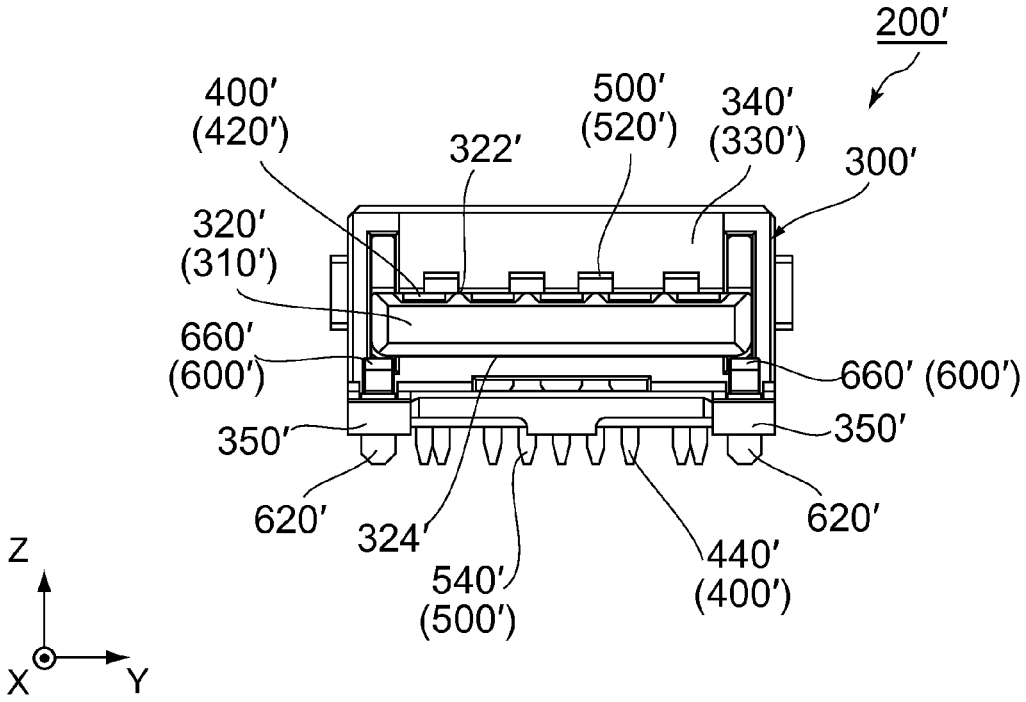
FIG. 67 is a front view showing a body structure included in the special receptacle of FIG. 62.
Figure 68:
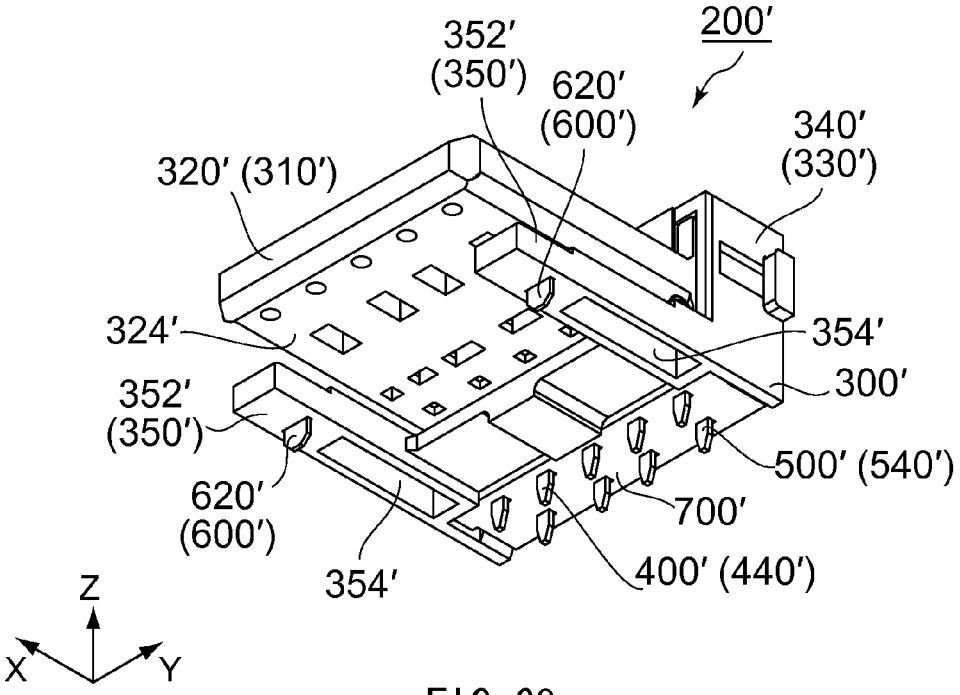
FIG. 68 is a bottom, perspective view showing the body structure of FIG. 67.

As can be seen from FIGS. 65 and 70, the fixed portion 620' is fixed to the arm portion 350'. According to the present embodiment, the fixed portion 620' is press-fitted in the slot formed in the fixing portion 352' so that the detector 600' is held by the arm portions 350'. In other words, the detector 600' according to the present embodiment is press-fitted in and held by the arm portion 350' of the second member 330' (i.e. the holding member 300'). However, the detector 600' may be insert-molded in the arm portion 350'. The ditch portion 354' according to the present embodiment corresponds to the support portion 640'. More specifically, the fixed portion 620' is held by the fixing portion 352' so that the support portion 640' extends in the ditch portion 354'. As can be seen from the above description, the support portion 640' is located slightly below an upper surface (upper-end surface) 356' of the arm portion 350'. According to the present embodiment, a part consisting of the fixed portion 620' and the support portion 640' has an L-like shaped cross-section in the XZ-plane. The support portion 640' configured as described above (especially, a part of the support portion 640', which is located rearward of a boundary portion between the fixing portion 352' and the ditch portion 354') is resiliently deformable. In other words, the support portion 640' is resiliently deformable in the ditch portion 354'.

The contact portion 660' is located below the plate portion 320' so as to protrude in the positive Z-direction (i.e. upward). The contact portion 660' has an upside-down U-like shaped cross-section in the XZ-plane. According to the present embodiment, only the contact portion 660' of the detector 600' protrudes upward over the upper surface 356'. As described later, the contact portion 660' is configured to be brought into abutment with the leading end 22'*t* of the special shell 22' and a part in the vicinity of the leading end 22'*t*. The fixed portion 620' of the detector 600' according to the present embodiment is fixed to the fixing portion 352' at a position forward of the contact portion 660'. Accordingly, the detector 600' may not be buckled when the special shell 22' is brought into abutment with the contact portion 660'.

As shown in FIGS. 62 to 66, the shell 800' has a body portion 820', a plurality of elastic contact portions 840' and a plurality of mounted portions 860'. The body portion 820' has a rectangular tube-like shape. The elastic contact portions 840' are provided on the body portion 820'. The mounted portions 860' are used so as to install the special receptacle 100' on a circuit board (not shown). In detail, the mounted portions 860' are configured so as to be soldered to respective through holes (not shown) of the circuit board. The body portion 820' encloses most of the body structure 200' so that the body structure 200' is protected by the body portion 820'. Especially, the body portion 820' encloses the plate portion 320' in the YZ-plane (i.e. a vertical plane perpendicular to the predetermined direction).

As can be seen from FIGS. 62 and 65, under a state where the shell 800' is attached to the body structure 200', the arm portion 350' is located outside of the body portion 820' of the shell 800' in the YZ-plane. As shown in FIG. 65, the fixed portion 620' and the support portion 640' of the detector 600' are also located outside of the body portion 820' of the shell 800' in the YZ-plane. As previously described, the support portion 640' according to the present embodiment is located below the upper surface 356' of the arm portion 350'. Accordingly, the fixed portion 620' and the support portion 640' are not brought into contact with the shell 800'. Only the contact portion 660' of the detector 600' protrudes inside of the body portion 820' in the YZ-plane. However, as can be seen from FIG. 65, the contact portion 660' is not in contact with the shell 800'. In other words, the detector 600' and the shell 800' are arranged so as not to be directly brought into contact with each other.

Referring to FIGS. 65 and 71 to 73, the special receptacle 100' comprises a predetermined space 50'. The predetermined space 50' is formed within the special receptacle 100'. The predetermined space 50' corresponds to the space 80' provided in the USB 3.0 receptacle 70'. More specifically, the predetermined space 50' and the space 80' have the same size as each other. The contact portion 660' according to the present embodiment is arranged in the aforementioned predetermined space 50'. The special receptacle 100' may further comprise a space which extends in the negative X-direction (i.e. rearward) from the predetermined space 50'. In other words, the special receptacle 100' may comprise a space which includes the predetermined space 50' and is larger than the predetermined space 50'. However, considering effective use of the design asset related to the existing USB 3.0 receptacle, it is preferable to provide a space having the same size as the predetermined space 50' in the special receptacle 100'. As described above, the special receptacle 100' according to the present embodiment is provided with the predetermined space 50' having the same size as the space 80'. Accordingly, a distance in the X-direction between the mating end of the special receptacle 100' and the base portion 340' of the holding member 300' is same as a distance in the X-direction between a mating end of the USB 3.0 receptacle 70' and a portion corresponding to the base portion 340'.

The special shell 22', 22'*a* and 22'*b* are configured to be accommodated in the predetermined space 50' when the special plugs 20', 20'*a* and 20'*b* are mated with the special receptacle 100', respectively. Therefore, any one of the USB 2.0 plug 30', the USB 3.0 plug 10' and the special plugs 20', 20'*a* and 20'*b* is matable with the special receptacle 100'. As describe above, the contact portion 660' is provided in the predetermined space 50'. Accordingly, any parts of the USB 2.0 plug 30' or the USB 3.0 plug 10' do not arrive at the contact portion 660' when the USB 2.0 plug 30' or the USB 3.0 plug 10' is inserted in and mated with the special receptacle 100'. On the other hand, when the special plug 20' is inserted in and mated with the special receptacle 100', the special shell 22' is brought into abutment with the contact portion 660' (i.e. is connected to the contact portion 660') in the predetermined space 50' (i.e. at a position where the contact portion 660' is located). In other words, the contact portion 660' is configured to be brought into contact with the special shell 22' under a mated state where the special receptacle 100' is mated with the special shell 22'. According to the present embodiment, the detector 600' and the special shell 22' are gold-plated. Accordingly, even if a contact pressure between the detector 600' and the special shell 22' is insufficient, it is possible to electrically connect the detector 600' and the special shell 22' with each other more securely. According to the present embodiment, when the special plug 20' is mated with the special receptacle 100', both the two detectors 600' are brought into contact with the special shell 22'. On the other hand, when the special plug 20'*a* or 20'*b* shown in FIG. 60 or 61 is mated with the special receptacle 100', only one of the two detectors 600' is brought into contact with the special shell 22'*a* or 22'*b*. According to the present embodiment, the shell 800' is grounded when the special receptacle 100' is mounted on a circuit board (not shown). Moreover, when the special plug 20', 20'*a* or 20'*b* is mated with the special receptacle 100', the shell 800' is electrically connected with the special shell 22', 22'*a* or 22'*b* through the elastic contact portion 840'. Therefore, it is possible to pull up the electric potential of the detectors 600' to detect whether the special receptacle 100' is mated with one of the special plug 20', 20'*a* and 20'*b* or mated with one of the USB 2.0 plug 30' and the USB 3.0 plug 10' by monitoring whether the electric potential of each of the detectors 600' changes (i.e. is lowered to the ground potential) or not (i.e. by detecting the electric potential). Moreover, it is possible to detect which of the special plug 20', 20'*a* and 20'*b* is mated with the special receptacle 100' by the combination of the grounded detectors 600'. In other words, the detectors 600' are configured to detect that the special plug 20', 20'*a* or 20'*b* is mated with the special receptacle 100' when the special shell 22', 22'*a* or 22'*b* is brought into contact with the contact portion 660'. In short, the special receptacle 100' is configured to detect the type of the mating plug.

Various modifications are possible to the aforementioned third embodiment. For example, the holding member 300' according to the third embodiment is configured by coupling the two members 310' and 330' (the first member 310' and the second member 330'). However, the holding member 300' may be configured differently.

The First Modification of the Third Embodiment

Figure 74:
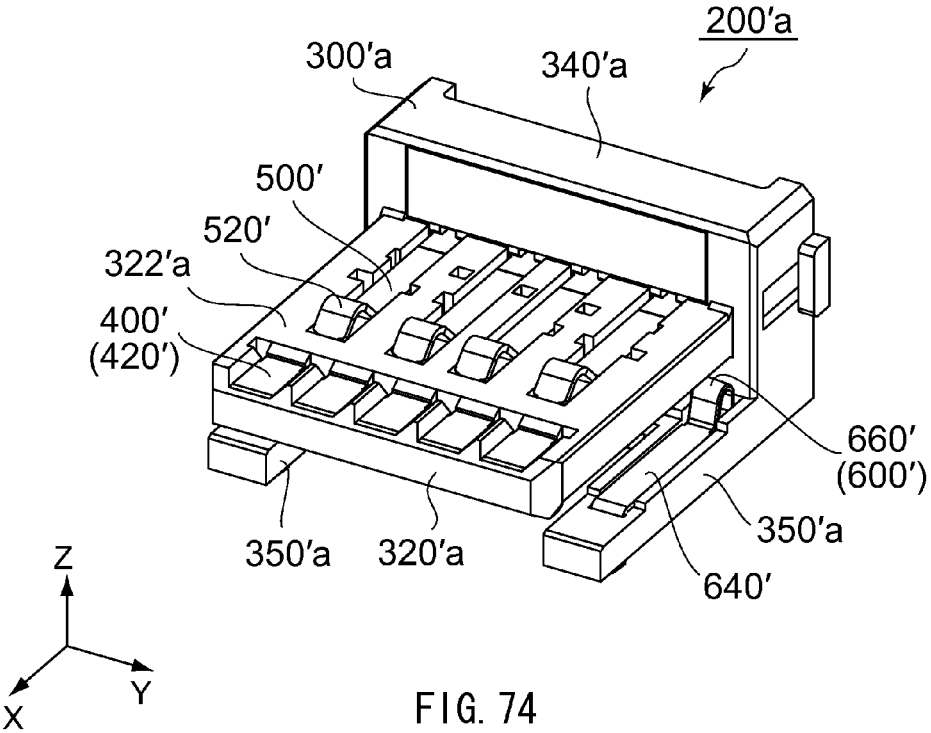
FIG. 74 is a perspective view showing a modification of the body structure of FIG. 67.

Referring to FIG. 74, a body structure 200'*a* of a special receptacle (USB receptacle) according the first modification comprises a holding member 300'*a*. The holding member 300'*a* is formed integrally. In other words, the body structure 200'*a* consists of a one-block member (i.e. one-piece member). The holding member 300'*a* has a shape similar to the holding member 300' (see FIG. 62) according to the third embodiment. In detail, the holding member 300'*a* has a plate portion 320'*a*, a base portion 340'*a* and two arm portions 350'*a*. The plate portion 320'*a* extends in the positive X-direction from the base portion 340'*a*. The first contacts 400' and the second contacts 500' are held by the holding member 300'*a* so that the first contact parts 420' and the second contact parts 520' are located on an upper surface 322'*a* of the plate portion 320'*a*. The first contacts 400' and the second contacts 500' may be press-fitted or insert-molded in the holding member 300'*a*. The two detectors 600' are held by the respective arm portions 350'*a*. The detectors 600' may be press-fitted or insert-molded in the arm portions 350'*a*.

The arm portion 350' and 350'*a* according to the aforementioned third embodiment (including the first modification) are integrally formed with the second member 330' and the holding member 300'*a*, respectively. However, the arm portion 350' and 350'*a* may be separated from the second member 330' and the holding member 300'*a*, respectively.

The Second Modification of the Third Embodiment

Figure 75:
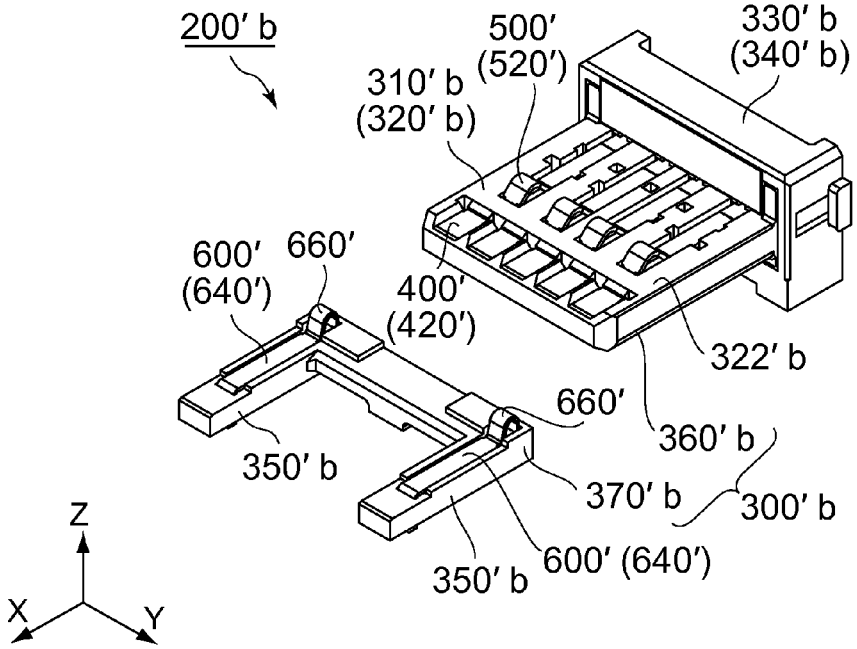
FIG. 75 is a top, perspective view showing another modification of the body structure of FIG. 67.
Figure 76:
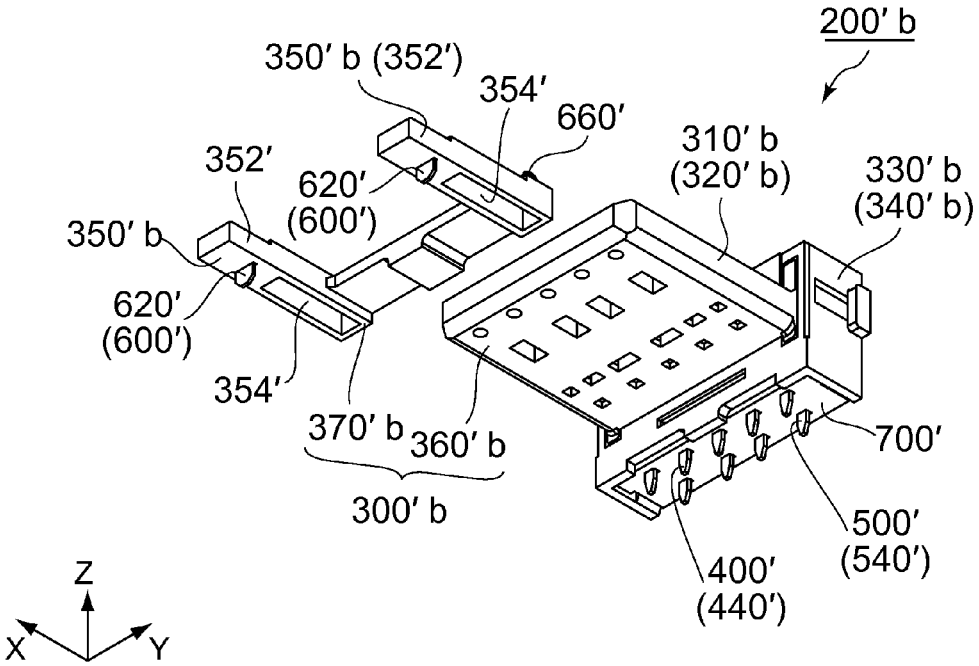
FIG. 76 is a bottom, perspective view showing the body structure of FIG. 75, wherein the illustrated body structure is attached with a positioner.

Referring to FIGS. 75 and 76, a body structure 200'*b* of a special receptacle (USB receptacle) according the second modification comprises a holding member 300'*b*. The holding member 300'*b* comprises a contact-holding member (member) 360'*b* and a detector-holding member (member) 370'*b*. The contact-holding member 360'*b* is configured by combining (i.e. coupling) a first member (member) 310'*b* and a second member (member) 330'*b* with each other. The first member 310'*b* includes a plate portion 320'*b*. The second member 330'*b* includes a base portion 340'*b*.

The contact-holding member 360'*b* holds the first contacts 400' and the second contacts 500'. In detail, the first contacts 400' are held by the first member 310'*b* while the second contacts 500' are held by the second member 330'*b*. When the first member 310'*b* and the second member 330'*b* are combined (i.e. coupled) with each other, the plate portion 320'*b* extends in the positive X-direction from the base portion 340'*b*, and the first contact parts 420' and the second contact parts 520' are located on an upper surface 322'*b* of the plate portion 320'*b*.

The detector-holding member 370'*b* holds the two detectors 600'. In detail, the detectors 600' are press-fitted or insert-molded in the detector-holding member 370'*b*. The detector-holding member 370'*b* consists of a one-piece member. The detector-holding member 370'*b* has an angular C-like shape (i.e. square bracket-like shape). In detail, the detector-holding member 370'*b* has two arm portions 350'*b*. The arm portions 350'*b* hold the respective detectors 600'.

The contact-holding member 360'*b* according to the second modification is an assembly comprising the first member 310'*b* and the second member 330'*b*. However, the first member 310'*b* and the second member 330'*b* may be formed integrally. In other words, the contact-holding member 360'*b* may consist of a one-block member (i.e. one-piece member).

The detector-holding member 370'*b* according to the second modification consist of a one-piece member. However, the detector-holding member 370'*b* may comprise two or more members.

The Third Modification of the Third Embodiment

Figure 77:
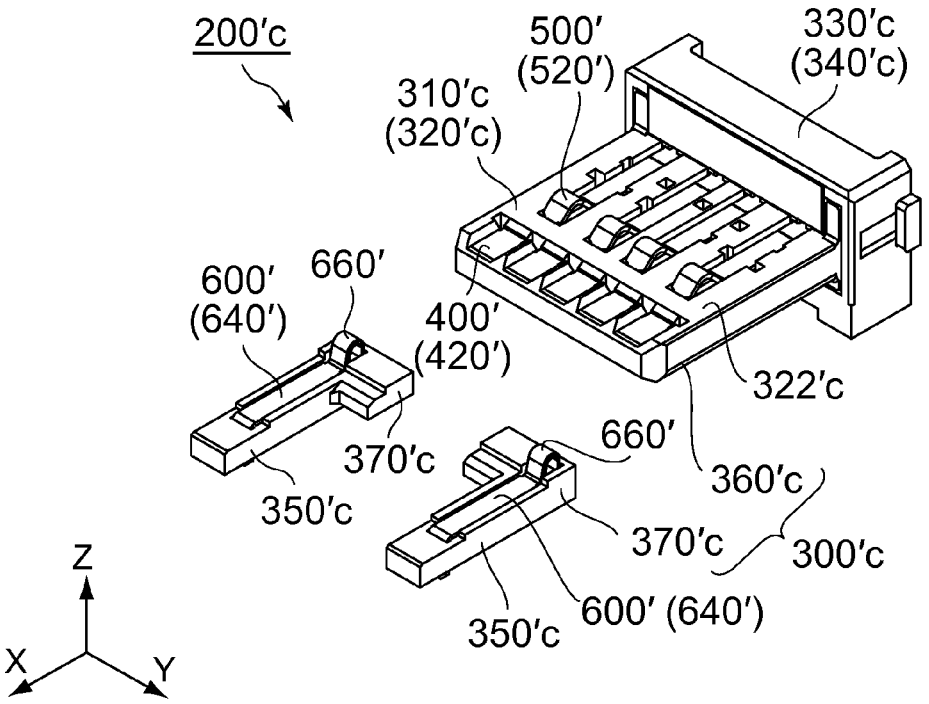
FIG. 77 is a top, perspective view showing yet another modification of the body structure of FIG. 67.
Figure 78:
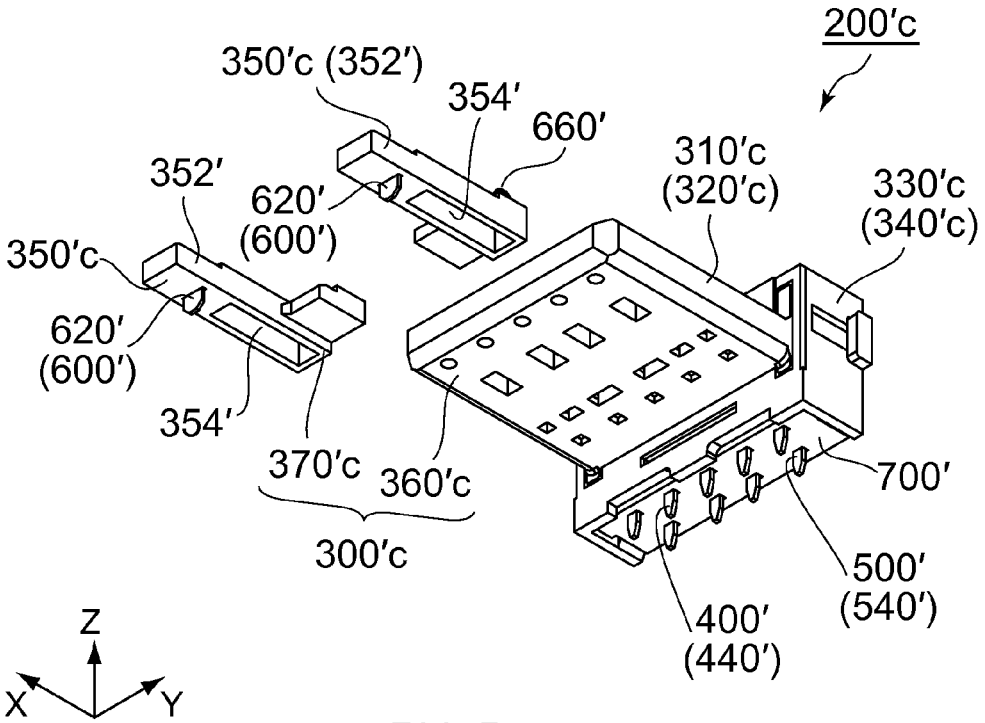
FIG. 78 is a bottom, perspective view showing the body structure of FIG. 77, wherein the illustrated body structure is attached with a positioner.
Figure 79:
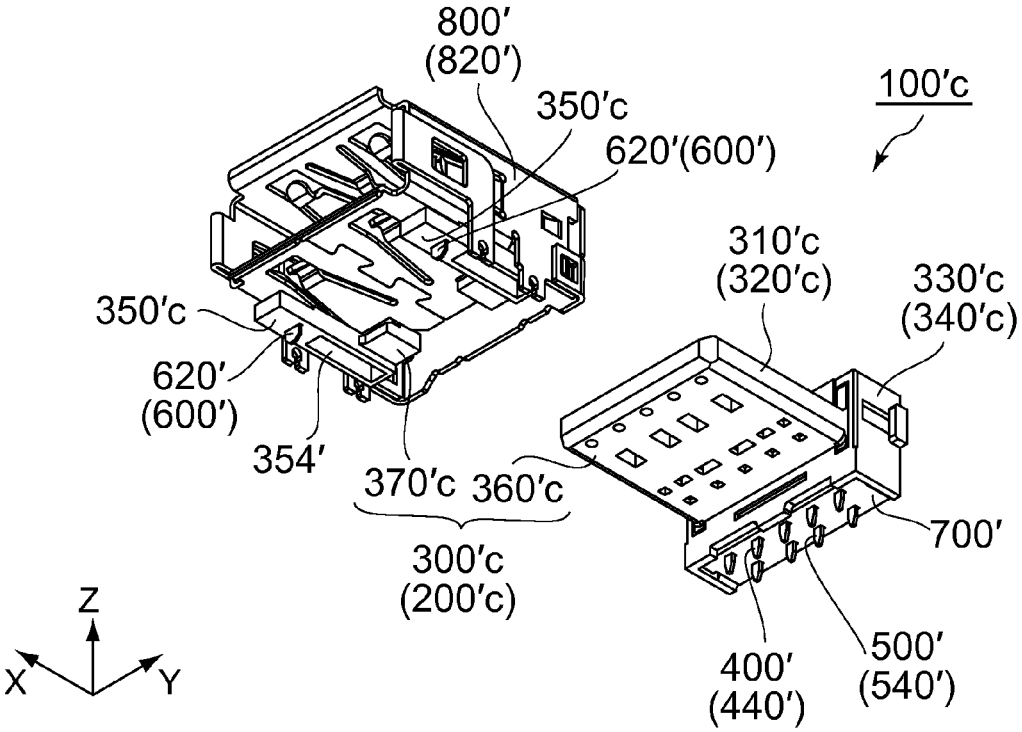
FIG. 79 is a partially exploded, perspective view showing a special receptacle comprising the body structure of FIG. 77.

Referring to FIGS. 77 to 79, a special receptacle (USB receptacle) 100'*c* according to the third modification comprises a body structure 200'*c* and the shell 800'. The body structure 200'*c* comprises a holding member 300'*c*. The holding member 300'*c* comprises a contact-holding member (member) 360'*c* and two detector-holding members (members) 370'*c*. The contact-holding member 360'*c* is configured by combining a first member (member) 310'*c* and a second member (member) 330'*c* with each other. The first member 310'*c* includes a plate portion 320'*c*. The second member 330'*c* includes a base portion 340'*c*.

The contact-holding member 360'*c* holds the first contacts 400' and the second contacts 500'. In detail, the first contacts 400' are held by the first member 310'*c* while the second contacts 500' are held by the second member 330'*c*. When the first member 310'*c* and the second member 330'*c* are combined with each other, the plate portion 320'*c* extends in the positive X-direction from the base portion 340'*c*, and the first contact parts 420' and the second contact parts 520' are located on an upper surface 322'*c* of the plate portion 320'*c*.

Each of the detector-holding members 370'*c* has an arm portion 350'*c*. The arm portions 350'*c* hold the respective detectors 600'.

As shown in FIG. 79, the detector-holding members 370'*c* according to the third modification is attached to the shell 800' separately from the contact-holding member 360'*c*. It is also possible to configure so that the detector-holding member 370'*b* according to the second modification is attached to the shell 800' separately from the contact-holding member 360'*b*.

The contact-holding member 360'*c* according to the third modification is an assembly comprising the first member 310'*c* and the second member 330'*c*. However, the first member 310'*c* and the second member 330'*c* may be formed integrally. In other words, the contact-holding member 360'*c* may consist of a one-block member (i.e. one-piece member).

According to the aforementioned third embodiment, the first contact parts 420' of the first contacts 400' and the second contact parts 520' of the second contacts 500' are located on the upper surface 322' of the plate portion 320'. However, the first contact parts 420' and the second contact parts 520' may be located on the lower surface 324' of the plate portion 320'. In other words, the first contact parts 420' and the second contact parts 520' may be located on one of the upper surface 322' and the lower surface 324' of the plate portion 320'. As can be seen from the above description, the special receptacle 100' may be a reverse type receptacle. The special receptacle according to the first modification, the second modification or the third modification also may be configured similarly. As shown in FIGS. 60 and 61, the corners on which the notches 24'*a* of the special plug 20'*a* are located is different from the corners on which the notches 24'*b* of the special plug 20'*b* are located. Therefore, it is possible to identify and detect the special plug 20'*a* and 20'*b* even if the special receptacle 100' is a reverse type receptacle.

Each of the detector-holding member 370'*b* according to the second modification and the detector-holding member 370'*c* according to the third modification is formed separately from the positioner 700'. However, each of the detector-holding members 370'*b* and 370'*c* may be formed integrally with the positioner 700'.

The Fourth Modification of the Third Embodiment

Referring to FIGS. 80 to 83, a special receptacle (USB receptacle) 100'*d* according to the fourth modification comprises a body structure 200'*d* and a shell 800'*d*. The body structure 200'*d* according to the fourth modification comprises a holding member 300'*d*. The holding member 300'*d* consists of a contact-holding member (member) 360'*d* and a detector-holding member (member) 370'*d*.

Figure 80:
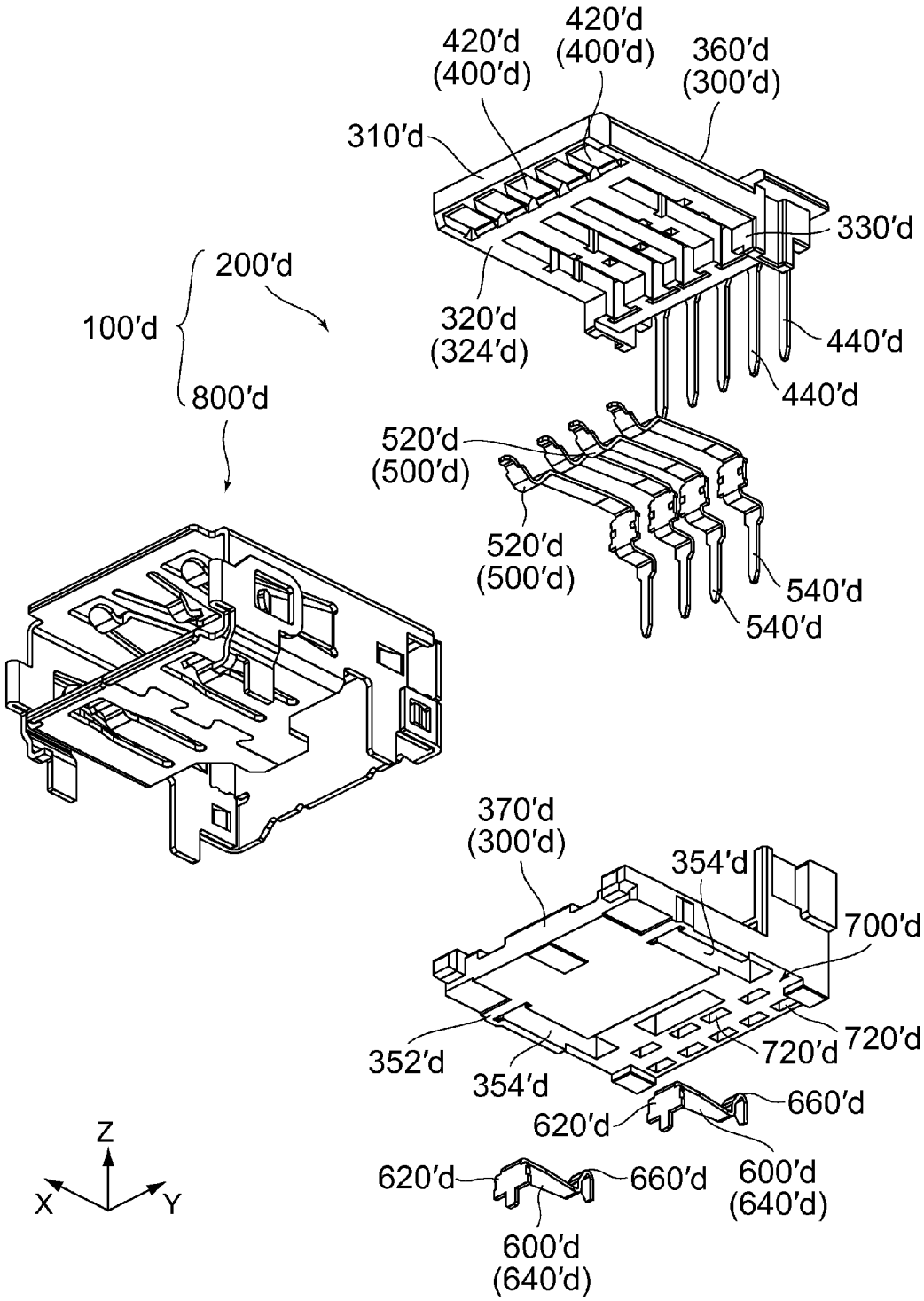
FIG. 80 is a partially exploded, perspective view showing another modification of the special receptacle of FIG. 57.
Figure 81:
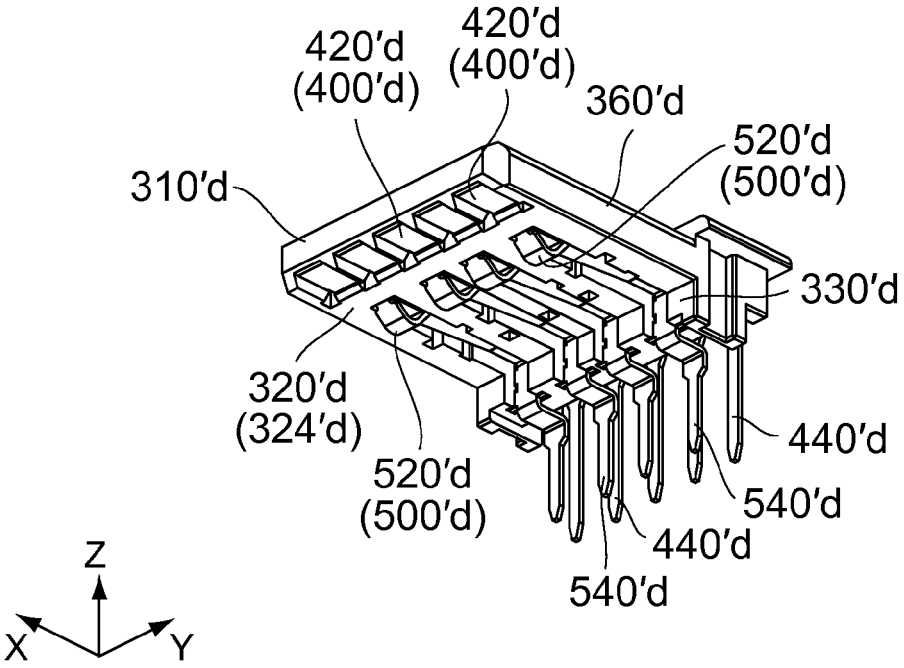
FIG. 81 is a perspective view showing a structure comprised of first contacts, second contacts and a holding member included in the special receptacle of FIG. 80.

As shown in FIGS. 80 and 81, the contact-holding member 360'*d* of the body structure 200'*d* is configured by combining a first member (member) 310'*d* and a second member (member) 330'*d* with each other. The first member 310'*d* includes a plate portion 320'*d*. The first member 310'*d* holds five first contacts (contacts) 400'*d*. The first contacts 400'*d* are, similar to the first contacts 400', for the USB 3.0 connection. The second member 330'*d* holds four second contacts (contacts) 500'*d*. The second contacts 500'*d* are, similar to the second contacts 500', for the USB 2.0 connection. Each of the first contacts 400'*d* has a first contact part (contact part) 420'*d* and a fixed portion 440'*d*. The first contacts 400'*d* are insert-molded in the contact-holding member 360'*d* so that the first contact parts 420'*d* are located on a lower surface 324'*d* (i.e. located under the lower surface 324'*d*) of the plate portion 320'*d*. The fixed portion 440'*d* extends in the negative Z-direction (i.e. downward) from the negative X-side end (i.e. rear end) of the contact-holding member 360'*d*. Each of the second contacts 500'*d* has a second contact part (contact part) 520'*d* and a fixed portion 540'*d*. The second contacts 500'*d* are press-fitted in the contact-holding member 360'*d* from below along the positive Z-direction so that the second contact parts 520'*d* are located on the lower surface 324'*d* (i.e. located under the lower surface 324'*d*) of the plate portion 320'*d*. The fixed portion 540'*d* extends in the negative Z-direction (i.e. downward) from the negative X-side end (i.e. rear end) of the contact-holding member 360'*d*. As can be seen from the above description, the special receptacle 100'*d* according to the fourth modification is a reverse type receptacle.

Figure 82:
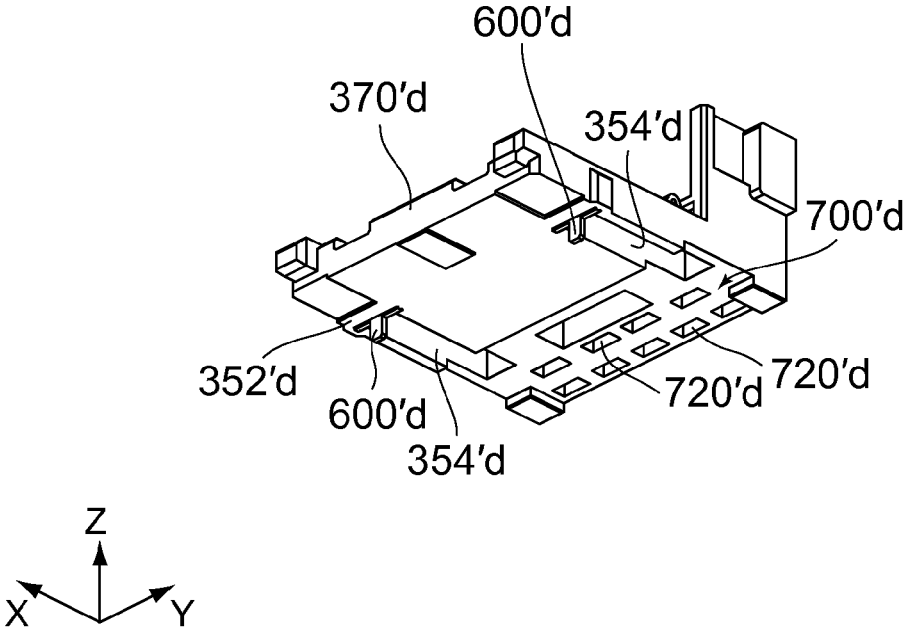
FIG. 82 is a perspective view showing a structure comprised of detectors and a detector-holding member included in the special receptacle of FIG. 80.
Figure 83:
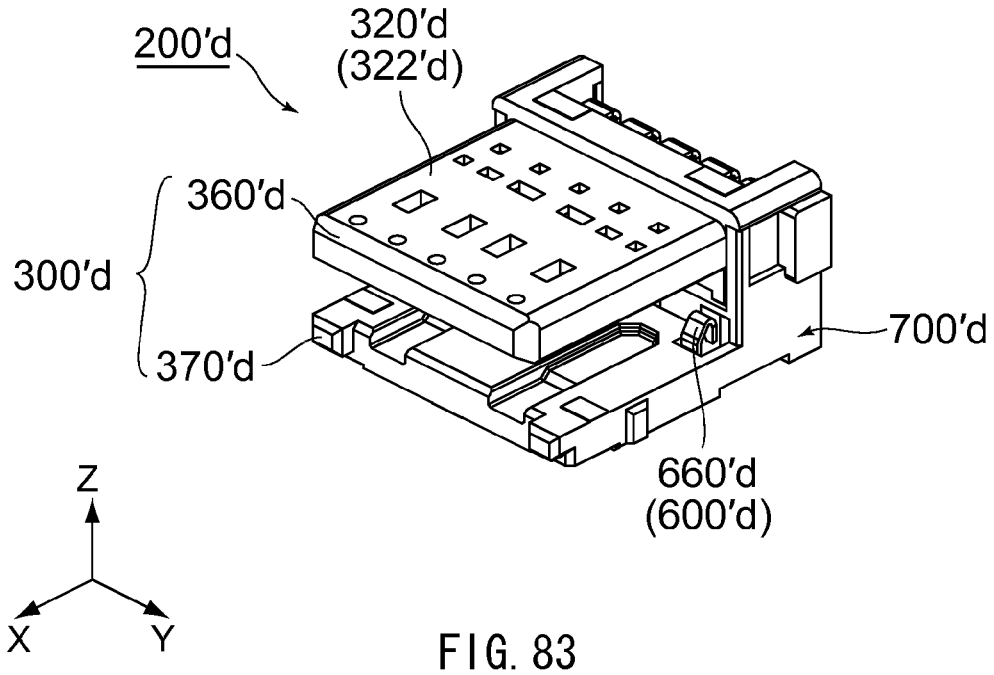
FIG. 83 is a perspective view showing a body structure included in the special receptacle of FIG. 80.

As can be seen from FIGS. 80 and 82, the detector-holding member 370'*d* has a fixing portion 352'*d* and a positioning portion 700'*d*. The fixing portion 352'*d* has a plate-like shape extending in the positive X-direction from the positioning portion 700'*d*. The fixing portion 352'*d* is formed with two ditch portions 354'*d*. The detector-holding member 370'*d* holds two detectors 600'*d*. Each of the detectors 600'*d* is configured similar to the detector 600'. In detail, the detector 600'*d* has a fixed portion 620'*d*, a support portion 640'*d* and a contact portion 660'*d*. The detectors 600'*d* are fixed to the fixing portion 352'*d*. In detail, the fixed portion 620'*d* is press-fitted in the fixing portion 352'*d* from below along the positive Z-direction so that the detector 600'*d* is held by the detector-holding member 370'*d*. The fixed portion 620'*d* is held by the detector-holding member 370'*d* so that the support portion 640'*d* is resiliently deformable in the ditch portion 354'*d*. In other words, the contact portion 660'*d* is movable similar to the contact portion 660' of the detector 600'.

The positioning portion 700'*d* of the detector-holding member 370'*d* is provided with a plurality of positioning holes 720'*d*. The positioning holes 720'*d* are configured so as to arrange and hold the fixed portions 440'*d* of the first contacts 400'*d* and the fixed portions 540'*d* of the second contacts 500'*d*.

As can be seen from FIGS. 80 to 83, the body structure 200'*d* is formed (see FIG. 83) by combining the contact-holding member 360'*d* holding the first contacts 400'*d* and the second contacts 500'*d* (see FIG. 81) and the detector-holding member 370'*d* holding the detectors 600'*d* (see FIG. 82).

The detectors 600'*d* according to the fourth modification are, similar to the detectors 600', configured to detect which type of the mating plugs is inserted. The special receptacle 100'*d* or the other special receptacle may be provided with, in addition to the detectors 600' or 600'*d*, a plug detector which is configured to detect the fact itself that the mating plug is inserted, regardless of type of the mating plug.

The Fifth Modification of the Third Embodiment

Figure 84:
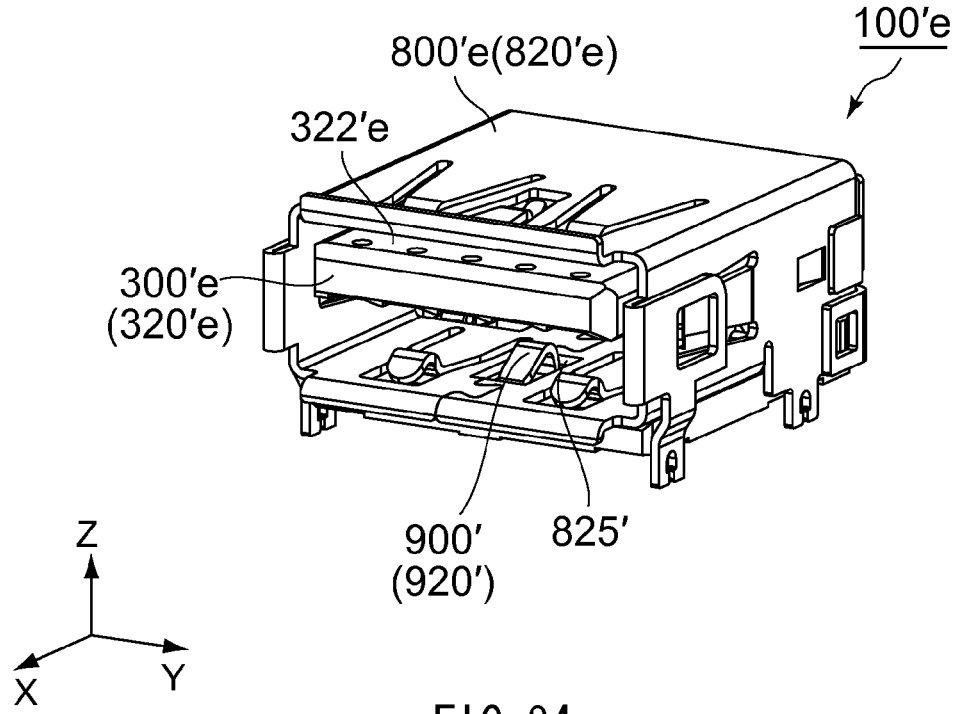
FIG. 84 is a perspective view showing yet another modification of the special receptacle of FIG. 57.
Figure 85:
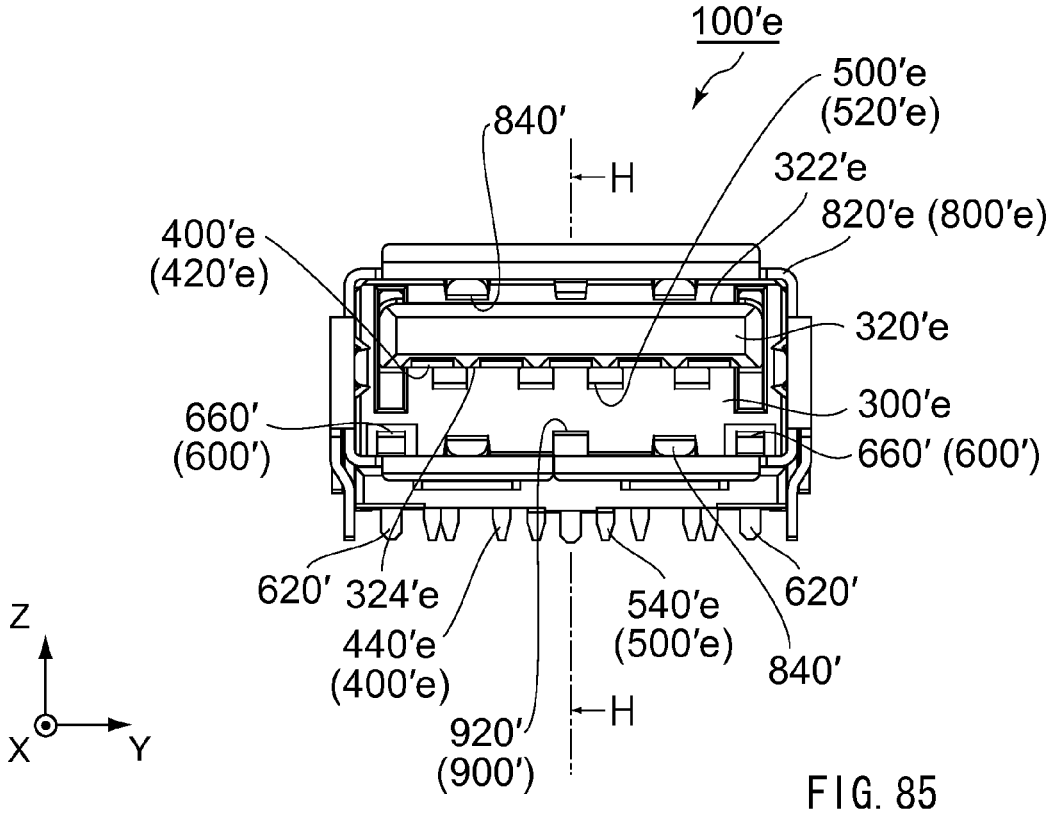
FIG. 85 is a front view showing the special receptacle of FIG. 84.
Figure 86:
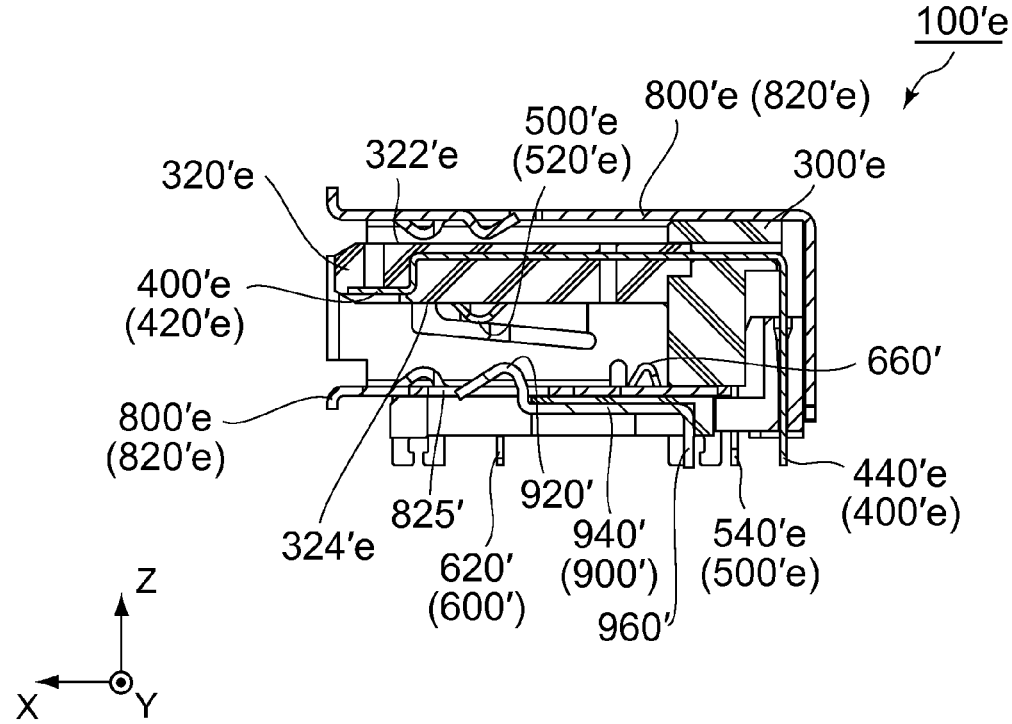
FIG. 86 is a cross-sectional view showing the special receptacle of FIG. 85, taken along lines H-H.
Figure 87:
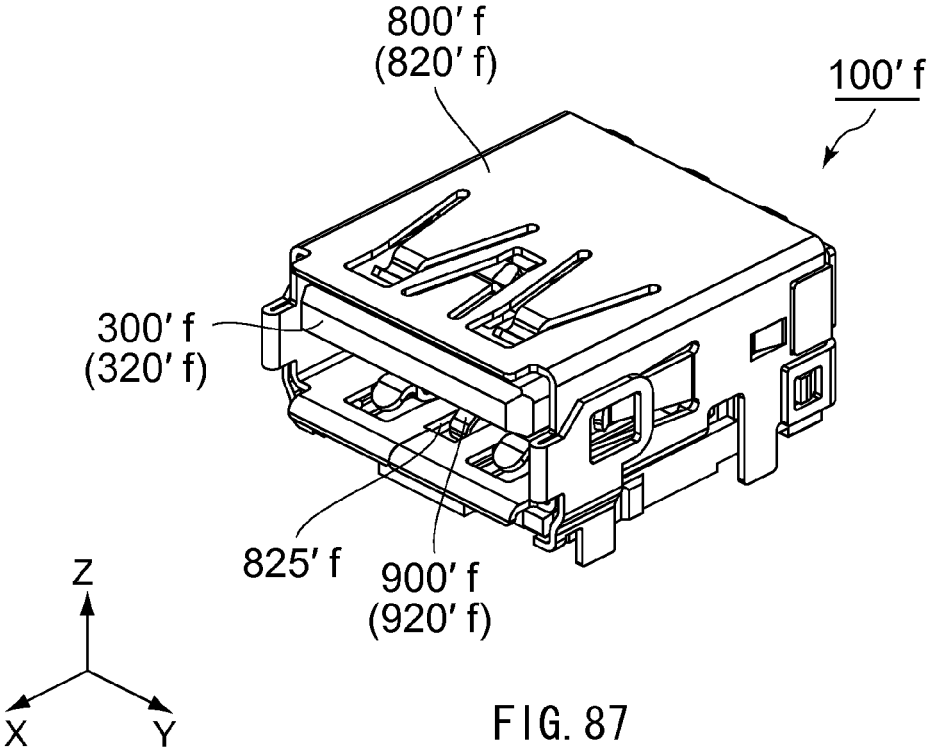
FIG. 87 is a perspective view showing yet another modification of the special receptacle of FIG. 57.
Figure 88:
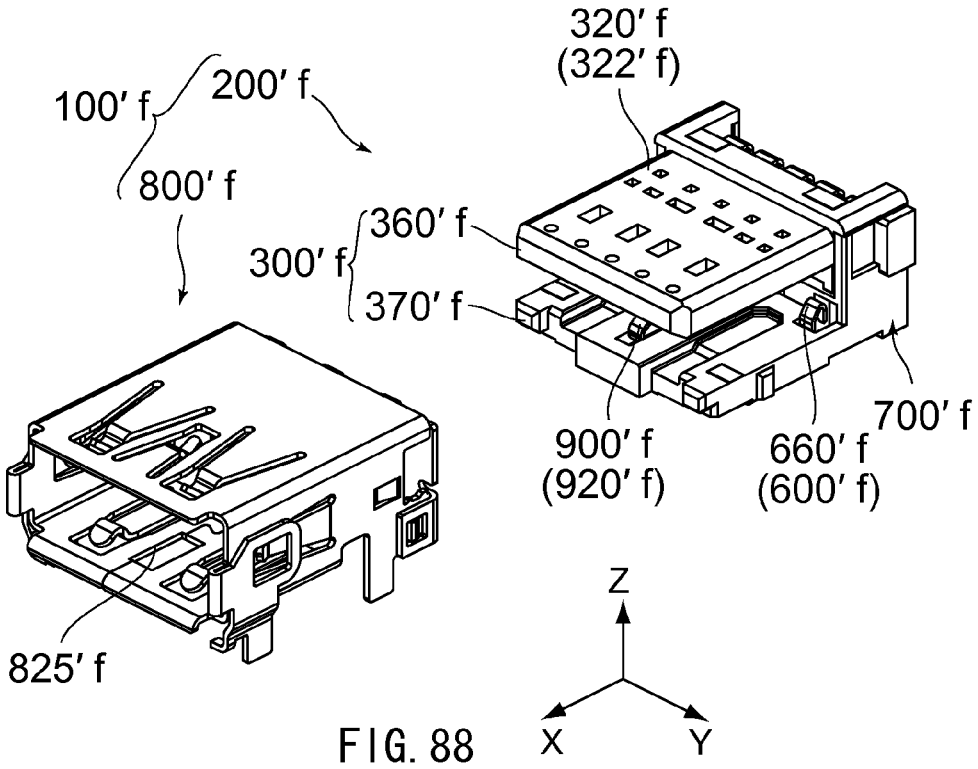
FIG. 88 is a perspective view showing a body structure and a shell constituting the special receptacle of FIG. 87.

Referring to FIGS. 84 to 86, a special receptacle (USB receptacle) 100'*e* according to the fifth modification is a reverse type receptacle. The special receptacle 100'*e* comprises a holding member 300'*e*, five first contacts (contacts) 400'*e* in accordance with the USB 3.0 standard, four second contacts (contacts) 500'*e* in accordance with the USB 2.0 standard, the two detectors 600' and a shell 800'*e*. The holding member 300'*e* comprises a plate portion 320'*e*. Each of the first contacts 400'*e* has a first contact part (contact part) 420'*e* and a fixed portion 440'*e*. Each of the second contacts 500'*e* has a second contact part (contact part) 520'*e* and a fixed portion 540'*e*. The first contact parts 420'*e* and the second contact parts 520'*e* are located not on an upper surface 322'*e* of the plate portion 320'*e* but on a lower surface 324'*e* of the plate portion 320'*e*.

The special receptacle 100'*e* according to the fifth modification further comprises a plug detector 900'. The plug detector 900' is configured to detect the fact itself that the mating plug is inserted both when the standard USB plug 10' or 30' (i.e. the mating plug) is inserted and when the special plug 20', 20'*a* or 20'*b* (i.e. the mating plug) is inserted (i.e. regardless of type of the inserted mating plug). In other words, the plug detector 900' is configured to detect that one of the USB 3.0 plug 10', the USB 2.0 plug 30' and the special plug 20', 20'*a* and 20'*b* is inserted when one of the USB 3.0 plug 10', the USB 2.0 plug 30' and the special plug 20', 20'*a* and 20'*b* is mated with the special receptacle 100'*e*. As shown in FIG. 86, the plug detector 900' has a contact portion 920', a support portion 940' and a fixed portion 960'. The support portion 940' resiliently supports the contact portion 920' so that the contact portion 920' is movable. The fixed portion 960' is fixed to and held by the holding member 300'*e*. The support portion 940' extends forward (i.e. in the positive X-direction) from upper end of the fixed portion 960'. As shown in FIGS. 84 and 86, the shell 800'*e* according to the fifth modification has a body portion 820'*e*. The body portion 820'*e* is formed with a hole 825' on a bottom surface thereof. The body portion 820'*e* is provided with the elastic contact portion 840' on an upper surface thereof. As shown in FIG. 86, the support portion 940' resiliently supports the contact portion 920' so that the contact portion 920' is movable mainly in the upper-to-lower direction (Z-direction). The contact portion 920' protrudes in the body portion 820'*e* of the shell 800'*e* through the hole 825'.

When the shell (for example, the special shell 22') of the mating plug is inserted in the special receptacle 100'*e* according to the fifth modification, the inserted shell is brought into contact with both the elastic contact portion 840' of the shell 800'*e* and the contact portion 920' of the plug detector 900'. Accordingly, an electrical path is formed between the shell 800'*e* and the plug detector 900' through the shell of the mating plug. According to the fifth modification, it is possible to detect whether the mating plug is inserted in the special receptacle 100'*e* or not by monitoring whether the shell 800'*e* and the plug detector 900' are electrically connected or not.

As can be seen from FIG. 86, according to the fifth modification, the contact portion 920' of the plug detector 900' is located forward of the contact portion 660' of the detector 600'. In other words, the contact portion 920' is located between a mating end of the special receptacle 100'*e* and the contact portion 660' in the X-direction. Accordingly, it is possible to detect the insertion itself of the mating plug before the detector 600' detects the type of the mating plug which is inserted in the special receptacle 100'*e*.

When the plug detector 900' is provided as described above, it is possible to stop the power-supply to a circuit which is related to the detector 600' until the mating plug is inserted. Moreover, it is possible to set the circuit to a standby state when detecting the insertion of the mating plug. Therefore, it is possible to reduce the electricity consumption.

The Sixth Modification of the Third Embodiment

Referring to FIGS. 87 to 92, a special receptacle (USB receptacle) 100'*f* according to the sixth modification is configured to detect the insertion of the mating plug by different method from the fifth modification.

The special receptacle 100'*f* according to the sixth modification comprises a body structure 200'*f*, five first contacts (contacts) 400'*f* in accordance with the USB 3.0 standard, four second contacts (contacts) 500'*f* in accordance with the USB 2.0 standard, two detectors 600'*f*, a shell 800'*f*, a first plug-detector (plug detector) 900'*f* and a second plug-detector (plug detector) 905'*f*. The body structure 200'*f* according to the sixth modification comprises a holding member 300'*f*. The holding member 300'*f* is formed with a contact-holding member (member) 360'*f* and a detector-holding member (member) 370'*f*. Each of the first contacts 400'*f* has a first contact part (contact part) 420'*f* and a fixed portion 440'*f*. Each of the second contacts 500'*f* has a second contact part (contact part) 520'*f* and a fixed portion 540'*f*. Each of the detectors 600'*f* has a fixed portion 620'*f*, a support portion 640'*f* and a contact portion 660'*f*. The first plug-detector 900'*f* has a pressed portion 920'*f*, a support portion 940'*f*, a fixed portion 960'*f* and a contact portion 980'*f*. The second plug-detector 905'*f* has a contact portion 925'*f*, a support portion 945'*f* and a fixed portion 965'*f*.

Figure 90:
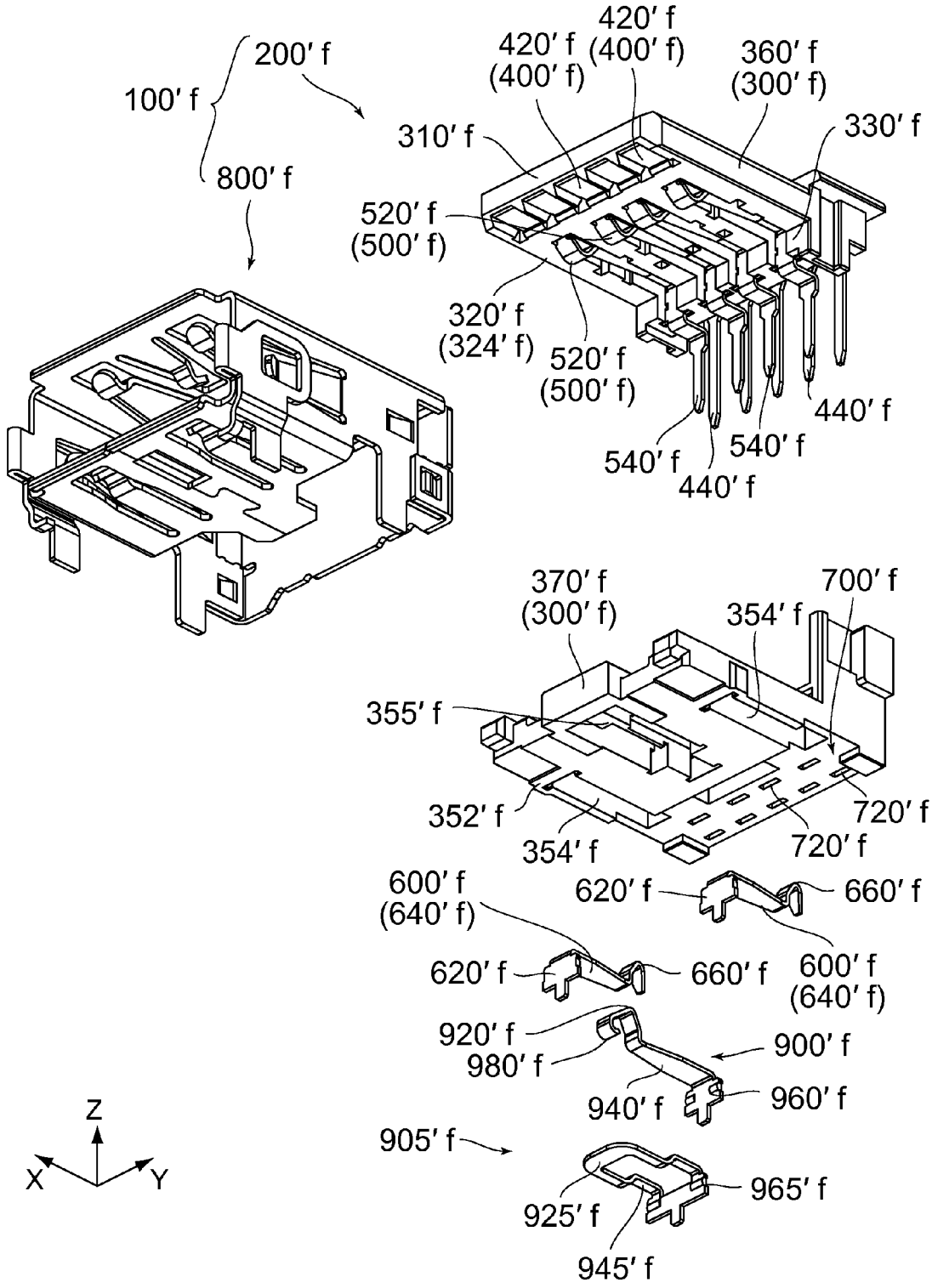
FIG. 90 is a partially exploded, bottom, perspective view showing the special receptacle of FIG. 87.

As shown in FIG. 90, the contact-holding member 360'*f* of the body structure 200'*f* is configured by combining a first member (member) 310'*f* and a second member (member) 330'*f* with each other. The first member 310'*f* holds the first contacts 400'*f*. The second member 330'*f* holds the second contacts 500'*f*. In detail, the first member 310'*f* includes a plate portion 320'*f*. The first contacts 400'*f* are insert-molded in the first member 310'*f* of the contact-holding member 360'*f* so that the first contact parts 420'*f* are located on a lower surface 324'*f* of the plate portion 320'*f*. The second contacts 500'*f* are press-fitted in the second member 330'*f* of the contact-holding member 360'*f* from below along the positive Z-direction so that the second contact parts 520'*f* are located on the lower surface 324'*f* of the plate portion 320'*f*. The fixed portion 440'*f* of the first contact 400'*f* and the fixed portion 540'*f* of the second contact 500'*f* extend along the negative Z-direction (i.e. downward) from the negative X-side end (i.e. rear end) of the contact-holding member 360'*f*. As can be seen from the above description, the special receptacle 100'*f* according to the sixth modification is a reverse type receptacle.

As shown in FIG. 90, the detector-holding member 370'*f* has a fixing portion 352'*f* having a plate-like shape, and a positioning portion 700'*f*. The fixing portion 352'*f* projects in the positive X-direction from the positioning portion 700'*f*. The fixing portion 352'*f* is formed with two ditch portions 354'*f* and a ditch portion 355'*f*. The ditch portions 354'*f* extend along the X-direction at both end parts in the Y-direction of the fixing portion 352'*f*. The ditch portion 355'*f* extends along the X-direction at middle part in the Y-direction of the fixing portion 352'*f*. The detectors 600'*f*, the first plug-detector 900'*f* and the second plug-detector 905'*f* are fixed to and held by the fixing portion 352'*f*.

In detail, the fixed portion 620'*f* of the detector 600'*f* is press-fitted in the ditch portion 354'*f* of the fixing portion 352'*f* from below so that the detector 600'*f* is fixed to the fixing portion 352'*f* of the detector-holding member 370'*f*. The detector 600'*f* is held by the detector-holding member 370'*f* so that the support portion 640'*f* is resiliently deformable in the ditch portion 354'*f*. Therefore, similar to the aforementioned third embodiment (including the modifications), the contact portion 660'*f* is movable.

Referring to FIG. 90, the fixed portion 960'*f* of the first plug detector 900'*f* is press-fitted in the ditch portion 355'*f* of the fixing portion 352'*f* from below so that the first plug detector 900'*f* is fixed to fixing portion 352'*f* of the detector-holding member 370'*f*. The first plug detector 900'*f* is held by the detector-holding member 370'*f* so that the support portion 940'*f* is resiliently deformable in the ditch portion 355'*f*. Therefore, the pressed portion 920'*f* and the contact portion 980'*f* is movable in the Z-direction.

Figure 91:
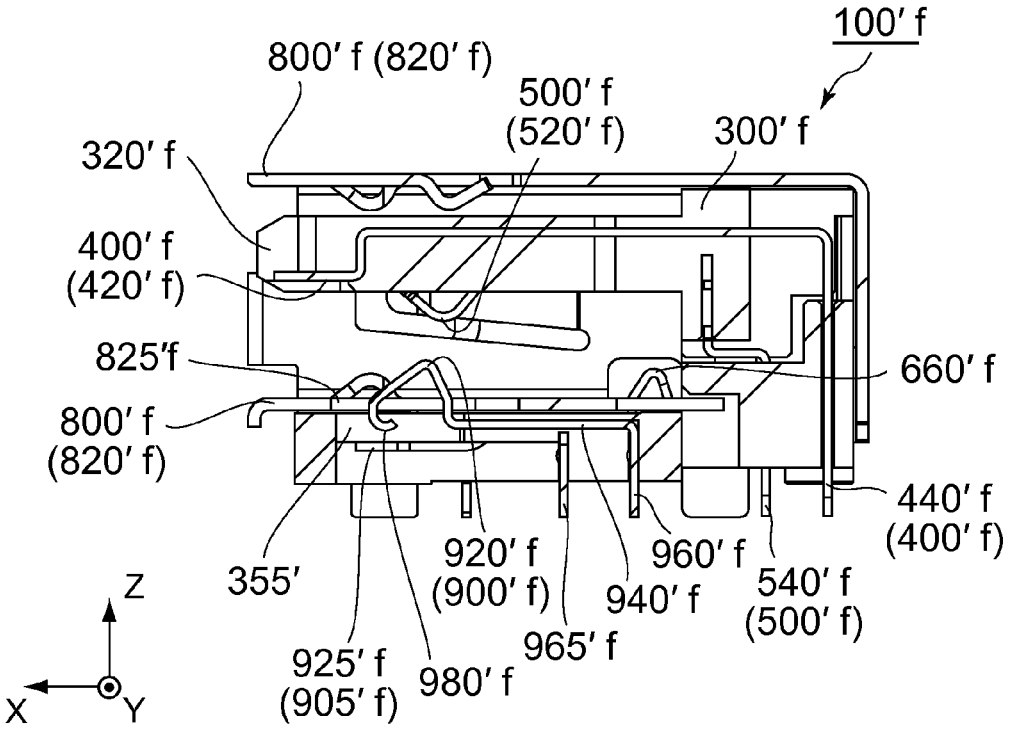
FIG. 91 is a cross-sectional view showing the special receptacle of FIG. 87.

As shown in FIG. 91, the support portion 940'*f* extends forward (i.e. in the positive X-direction) from an upper end of the fixed portion 960'*f*. The shell 800'*f* according to the sixth modification has a body portion 820'*f*. The body portion 820'*f* is formed with a hole 825'*f* on a bottom surface thereof. The support portion 940'*f* resiliently supports the pressed portion 920'*f* so that the pressed portion 920'*f* is movable mainly in the upper-to-lower direction (Z-direction). The pressed portion 920'*f* protrudes in the body portion 820'*f* of the shell 800'*f* through the hole 825'*f*.

Referring to FIG. 90, the second plug detector 905'*f* is fixed to and held by the fixing portion 352'*f* after the first plug detector 900'*f* is fixed to and held by the fixing portion 352'*f*. In detail, the fixed portion 965'*f* of the second plug detector 905'*f* is press-fitted in the ditch portion 355'*f* of the fixing portion 352'*f* from below so that the second plug detector 905'*f* is fixed to fixing portion 352'*f* of the detector-holding member 370'*f*. The second plug detector 905'*f* is held by the detector-holding member 370'*f* so that the support portion 945'*f* and the contact portion 925'*f* are located in the ditch portion 355'*f*.

As shown in FIG. 91, under a state where the first plug detector 900'*f* and the second plug detector 905'*f* are held by the detector-holding member 370'*f*, the contact portion 980'*f* of the first plug detector 900'*f* is located above the contact portion 925'*f* of the second plug detector 905'*f* in the Z-direction (upper-to-lower direction). The contact portion 980'*f* and the contact portion 925'*f* face each other in the Z-direction (upper-to-lower direction).

Figure 89:
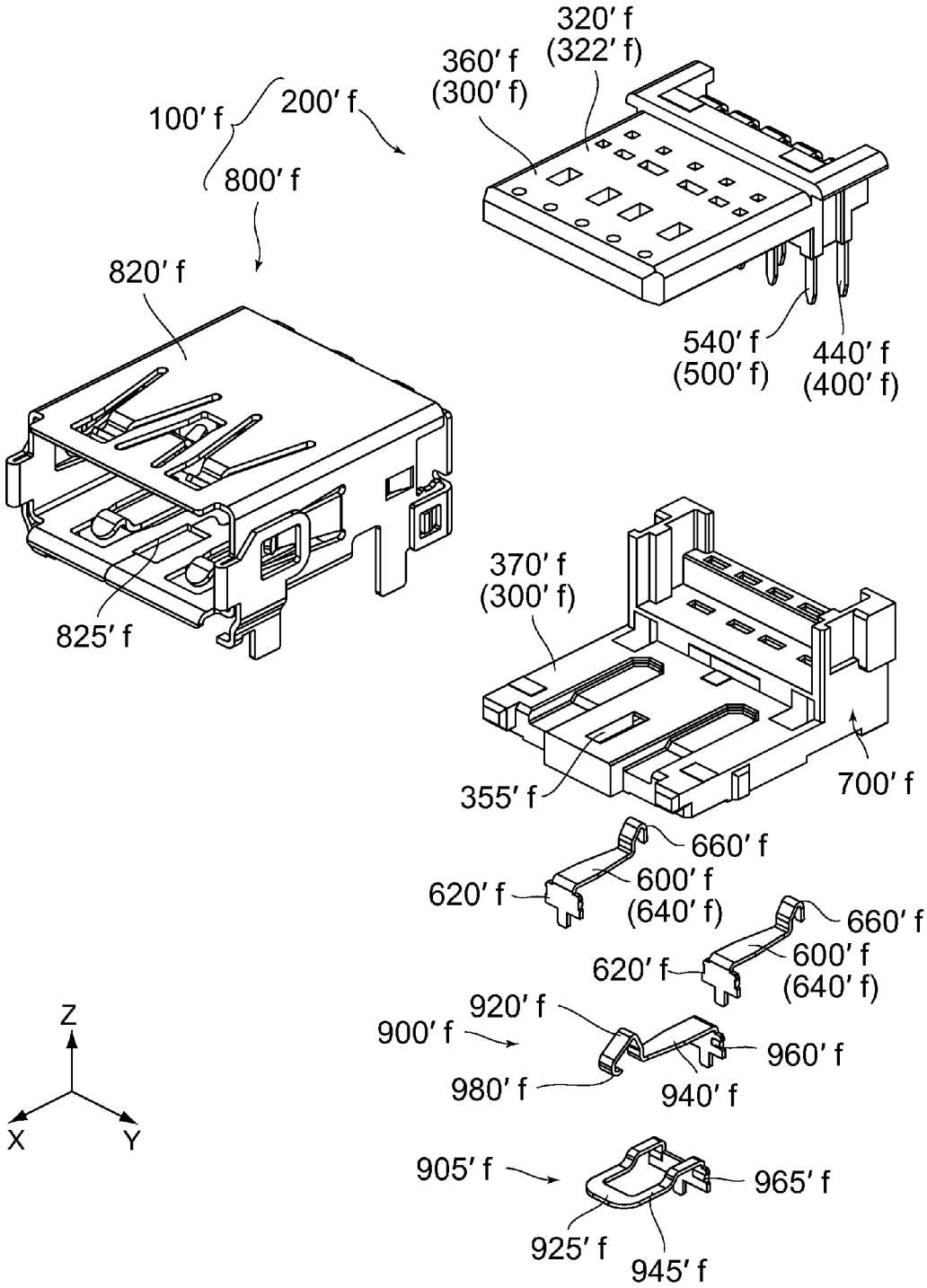
FIG. 89 is a partially exploded, top, perspective view showing the special receptacle of FIG. 87.

As shown in FIGS. 89 to 91, the positioning portion 700'*f* of the detector-holding member 370'*f* is provide with a plurality of positioning holes 720'*f*. The positioning holes 720'*f* arrange and hold the fixed portions 440'*f* of the first contacts 400'*f* and the fixed portions 540'*f* of the second contacts 500'*f*.

Figure 92:
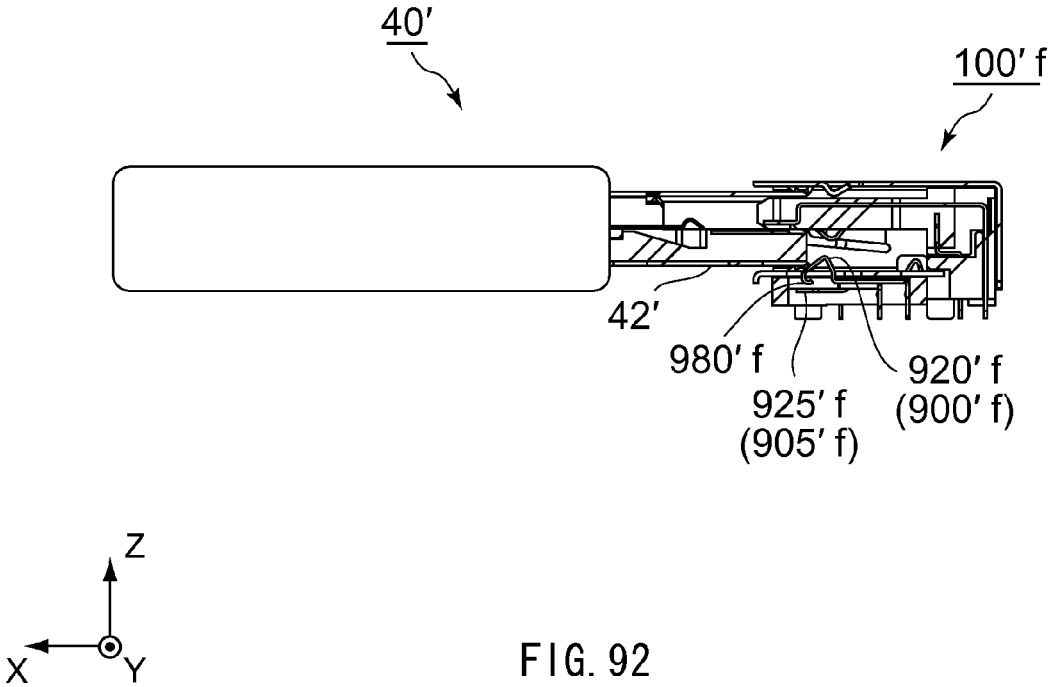
FIG. 92 is a cross-sectional view showing the special receptacle of FIG. 91 in a state where a plug is inserted in the special receptacle.

As shown in FIG. 92, when a mating plug 40' (i.e. the standard USB plug or the special plug) is inserted in the special receptacle 100'*f*, a plug-side shell 42' of the mating plug 40' is brought into contact with the pressed portion 920'*f* of the first plug detector 900'*f*. The plug-side shell 42' presses the pressed portion 920'*f* in the negative Z-direction (i.e. downward). Accordingly, the contact portion 980'*f* moves in the negative Z-direction (i.e. downward) to be brought into contact with the contact portion 925'*f* of the second plug detector 905'*f*. In other words, the first plug detector 900'*f* and the second plug detector 905'*f* are electrically connected with each other. According to the sixth modification, it is possible to detect whether the mating plug 40' is inserted in the special receptacle 100'*f* or not by monitoring whether the first plug detector 900'*f* and the second plug detector 905'*f* are electrically connected with each other or not. According to the sixth modification, it is possible to plate the first plug detector 900'*f* and the second plug detector 905'*f* in the same manner (for example, by the same material). Therefore, it is possible to lower the contact resistance of the parts which are used to detect the insertion of the mating plug 40'. In other words, it is possible to improve the detection accuracy. Moreover, according to the sixth modification, it is possible improve the detection accuracy without changing the material of the plug-side shell 42' or changing the surface treatment manner such as the plating manner.

According to the third embodiment, the detector 600' is held by the arm portion 350' extending in the positive X-direction so that the buckling of the detector 600' is prevented. However, the detector 600' may be held by a part which is other than the arm portion 350'. In this case, the arm portion 350' may not be provided. Moreover, the detector 600' (especially, the support portion 640') may extend not only in the X-direction (predetermined direction) but also in the Y-direction (lateral direction), Z-direction (vertical direction) or a direction oblique to both the Y-direction and the Z-direction. The special receptacles according to the first to sixth modifications also may be modified similarly.

According to the third embodiment (including the first to sixth modifications), the number (i.e. detector-number) of the detectors 600', 600'*d* or 600'*f* is two. The detector-number may be one or three or more than three. However, considering the size of the receptacle and the number of the special plug to be detected, it is preferable that the detector-number is two.

The shell (special shell) of the special plug (i.e. the mating plug matable with the special receptacle) according to the third embodiment (including the first to sixth modifications) is formed by modifying the shell (standard shell) of the standard USB 3.0 plug. However, the shell (special shell) of the special plug may be formed by modifying the shell (standard shell) of the standard USB 2.0 plug. In this case, the other parts of the special plug, which are other than the special shell, may be formed same as the standard USB 2.0 plug. When the special plug is configured as described above, the contacts of the special plug consist of the contacts for the USB 2.0 connection, which are in accordance with the USB 2.0 standard. Similarly, the contacts of the special receptacle consist of the contacts for the USB 2.0 connection, which are in accordance with the USB 2.0 standard.

The present application is based on a Japanese patent applications of JP2011-136795, JP2011-197680, JP2012-004872 and JP2012-011339 filed before the Japan Patent Office on Jun. 20, 2011, Sep. 9, 2011, Jan. 13, 2012 and Jan. 23, 2012, respectively, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A universal serial bus (USB) receptacle with which and from which a standard USB plug and a special USB plug are selectively mateable and removable along a predetermined direction, the standard USB plug being in accordance with a USB standard so as to have a standard shell, the special USB plug having a special shell so as to have a different structure from the standard USB plug, the USB receptacle comprising:

a detector having a contact portion, wherein the contact portion is arranged at a position at which the standard shell does not arrive when the standard USB plug is mated with the USB receptacle, and wherein the special shell is connected to the contact portion at the position when the special USB plug is mated with the USB receptacle.

2. A universal serial bus (USB) receptacle with which and from which a standard USB plug and a special USB plug are selectively mateable and removable along a predetermined direction, the standard USB plug being in accordance with a USB standard so as to have a standard shell made of a conductive material, the special USB plug having a special shell made of a conductive material, the special shell including a part having a same shape as the standard shell and an identified portion projecting over the part in the predetermined direction so that the special USB plug has a different structure from the standard USB plug, the USB receptacle comprising:

a plurality of contacts, each of the contacts having a contact part;

a holding member made of an insulating material, the holding member holding the contacts so that the contacts are arranged in a pitch direction perpendicular to the predetermined direction, the holding member having a body portion, the body portion having a plate-like shape which extends in the predetermined direction while having a thickness in a vertical direction perpendicular to both the predetermined direction and the pitch direction, the contact parts of the contacts being arranged on an upper surface of the body portion;

a shell made of a conductive material, the shell enclosing the holding member in a plane perpendicular to the predetermined direction, the shell having a shape which is connectable to the standard shell when the USB receptacle is mated with the standard USB plug and connectable to the special shell when the USB receptacle is mated with the special USB plug; and a detector made of a conductive material, the detector being other than the shell, the detector being held by the holding member so as not to be directly connected to the shell, the detector having a contact portion, the contact portion being arranged at a position where the standard shell does not arrive when the standard USB plug is mated with the USB receptacle, the identified portion of the special shell being connected to the contact portion at the position when the special USB plug is mated with the USB receptacle.

3. The USB receptacle as recited in claim 2, wherein:

the holding member has a side portion in the pitch direction; and the detector is held at the side portion so that the contact portion is movable in a horizontal plane perpendicular to the vertical direction.

4. The USB receptacle as recited in claim 3, wherein:

the detector has a held portion and a spring portion, the spring portion extending from the held portion so as to be resiliently deformable, the contact portion being provided on the spring portion;

the holding portion has a detector-holding portion, a movable region, and a deformable region, the detector-holding portion holding the held portion, the movable region is configured so that the contact portion is movable in the movable region, the deformable region is configured so that the spring portion is deformable in the deformable region; and the deformable region is formed to be located between the detector-holding portion and the movable region in the pitch direction, a size in the pitch direction of the deformable region being designed so as to become larger as being nearer to the movable region.

5. The USB receptacle as recited in claim 4, wherein:

the spring portion is provided with a regulated portion; and the holding member is formed with a regulating portion, the regulating portion being configured to regulate an outward movement of the regulated portion in the pitch direction.

6. The USB receptacle as recited in claim 5, wherein the regulating portion is located inside of the special shell in the pitch direction when the USB receptacle is mated with the special USB plug.

7. The USB receptacle as recited in claim 4, wherein:

the detector-holding portion is a ditch which extends in a vertical plane perpendicular to the pitch direction so as to be formed with an inside wall;

each of the held portion and the spring portion extends in the vertical plane, a size of each of the held portion and the spring portion being smaller than a size of the detector-holding portion in the pitch direction; and the detector-holding portion is formed with a protrusion, the protrusion pressing the held portion against the inside wall of the detector-holding portion.

8. The USB receptacle as recited in claim 7, wherein:

the detector is formed with a press-fit post, the press-fit post being press-fitted in the holding member; and the protrusion is formed on the press-fit post.

9. The USB receptacle as recited in claim 4, wherein the spring portion extends in a direction oblique to both the vertical direction and the predetermined direction.

10. The USB receptacle as recited in claim 3, wherein the contact portion has a curved surface protruding outward in the pitch direction in a plane defined by the pitch direction and the predetermined direction.

11. The USB receptacle as recited in claim 2, wherein the holding member is formed with a guard portion, the guard portion being located between the standard shell and the detector in the predetermined direction when the USB receptacle is mated with the standard USB plug.

12. The USB receptacle as recited in claim 2, wherein:

the identified portion comprises a first identified portion and a second identified portion;

the detector comprises a first detector and a second detector, the first detector and the second detector being connectable to the first identified portion and the second identified portion, respectively; and the first detector and the second detector are held at both side portions of the holding member in the pitch direction, respectively.

13. The USB receptacle as recited in claim 2, further comprising:

an additional holding member made of an insulating material, the additional holding member having a support portion, the additional holding member being installed on the holding member so that the support portion has a plate-like shape extending in the predetermined direction, the support portion being arranged so as to be apart from the body portion in the vertical direction, the support portion being formed with a hole, the hole piercing the support portion in the vertical direction; and a plurality of additional contacts, the additional contacts being held by the additional holding member, each of the additional contacts being contactable only through the hole of the support portion in a space interposed between the support portion and the body portion.

14. The USB receptacle as recited in claim 13, wherein a length of the additional holding member in the predetermined direction is designed so that the additional holding member does not overlap the standard USB plug when the USB receptacle is mated with the standard USB plug.

15. The USB receptacle as recited in claim 13, wherein the additional holding member is at least partially interposed between the holding member and the shell in the vertical direction to be fixed.

16. The USB receptacle as recited in claim 15, wherein the additional holding member has an additional protrusion formed on an upper surface thereof, the additional protrusion being brought into abutment with the shell so as to press the additional holding member against the holding member.

17. The USB receptacle as recited in claim 13, wherein:

the additional contact is bent so as to be formed with an additional contact part; and the additional contact is resiliently deformable, the additional contact being held by the additional holding member so that the additional contact part partially projects below the support portion through the hole.

18. The USB receptacle as recited in claim 17, wherein the support portion is formed with an additional guard portion, and the additional guard portion is located between the standard shell and the additional contact in the predetermined direction when the USB receptacle is mated with the standard USB plug.

19. The USB receptacle as recited in claim 17, wherein:

the shell is formed with an opening, the opening piercing an upper surface of the shell in the vertical direction; and the opening is located above the additional contact part so that the additional contact part is visible through the opening, and the additional contact part is not brought into contact with the shell even when the additional contact is resiliently deformed.

20. A special universal serial bus (USB) plug mateable with the USB receptacle as recited in claim 13 along the predetermined direction, the special USB plug comprising:

a special holding member, the special holding member having a modified holding portion and an extended portion, the modified holding portion corresponding to a standard holding member of a standard USB plug which is in accordance with the USB standard, the extended portion having a plate-like shape projecting over the modified holding portion in the predetermined direction so as to have an end surface in the predetermined direction, the extended portion being provided with a thin portion, the thin portion having a small thickness in the vertical direction, the thin portion extending in the predetermined direction to arrive at the end surface of the extended portion;

a plurality of standard contacts in accordance with the USB standard, the standard contacts being configured to be connected to the contacts of the USB receptacle, respectively, the standard contacts being held by the special holding member so as to be arranged on a lower surface of the special holding member in the vertical direction and so as not to arrive at the extended portion in the predetermined direction;

a plurality of special contacts different from the standard contacts, the special contacts being configured to be connected to the additional contacts of the USB receptacle, respectively, the special contacts being held and arranged by the special holding member so as to be exposed on an upper surface of the thin portion; and a special shell made of a conductive material, the special shell including a part having a same shape as a standard shell of a standard USB plug which is in accordance with the USB standard, a side protrusion projecting over the part in the predetermined direction and a notch, the notch being formed so that the thin portion is visible from above in the vertical direction, the side protrusion protruding in the predetermined direction so as to cover a side portion of the extended portion in the pitch direction, the side protrusion being connected to the contact portion of the USB receptacle when the special USB plug is mated with the USB receptacle.

21. The special USB plug as recited in claim 20, wherein the special holding member is provided with a boundary portion, the boundary portion being formed between the thin portion and an upper surface of the extended portion so as to have a slope oblique to the vertical direction.

22. The special USB plug as recited in claim 20, wherein the special contact is continuously exposed on the upper surface of the thin portion and the end surface of the extended portion.

23. The special USB plug as recited in claim 20, wherein the special shell has an upper-side protruding portion, the upper-side protruding portion being continuous with the side protrusion so as to cover an upper surface of the extended portion.

24. The special USB plug as recited in claim 20, wherein the thin portion is inserted between the body portion of the holding member and the support portion of the additional holding member when the special USB plug is mated with the USB receptacle.

25. A universal serial bus (USB) receptacle with which and from which a standard USB plug and a special USB plug are selectively mateable and removable along a predetermined direction, the standard USB plug being in accordance with a USB standard so as to have a standard shell made of a conductive material, the special USB plug having a special shell made of a conductive material, the special shell including a part having a same shape as the standard shell and an identified portion projecting over the part in the predetermined direction so that the special USB plug has a different structure from the standard USB plug, the USB receptacle comprising:

a plurality of contacts;

a holding member made of an insulating material, the holding member holding the contacts so that the contacts are arranged in a pitch direction perpendicular to the predetermined direction;

a shell made of a conductive material, the shell enclosing the holding member in a plane perpendicular to the predetermined direction, the shell having a shape which is connectable to the standard shell when the USB receptacle is mated with the standard USB plug and connectable to the special shell when the USB receptacle is mated with the special USB plug; and a detector made of a conductive material, the detector being other than the shell, the detector being held by the holding member so as not to be directly connected to the shell, the detector having a contact portion, the contact portion being arranged at a position where the standard shell does not arrive when the standard USB plug is mated with the USB receptacle, the identified portion of the special shell being connected to the contact portion at the position when the special USB plug is mated with the USB receptacle.

26. The USB receptacle as recited in claim 1, wherein:

the USB receptacle is mateable along the predetermined direction with any one of a USB 3.0 plug which is the standard USB plug in accordance with a USB 3.0 standard of the USB standard, a USB 2.0 plug which is the standard USB plug in accordance with a USB 2.0 standard of the USB standard and the special USB plug configured by modifying the USB 3.0 plug so as to have the special shell, the USB receptacle comprising:

a plurality of first contacts, the first contacts being in accordance with the USB 3.0 standard;

a plurality of second contacts, the second contacts being in accordance with the USB 2.0 standard;

a holding member, the holding member holding the first contacts and the second contacts;

a shell, the shell being attached to the holding member;

a predetermined space, the predetermined space being formed within the USB receptacle, the predetermined space corresponding to a space, formed within a USB 3.0 receptacle in accordance with the USB 3.0 standard, where the USB 2.0 plug does not arrive when the USB 2.0 plug is mated with the USB 3.0 receptacle; and the detector, the detector being held by the holding member, the detector having the contact portion, the contact portion being arranged in the predetermined space, the contact portion being configured to be brought into contact with the special shell in a mated state in which the USB receptacle is mated with the special shell, the detector being configured to detect that the special USB plug is mated with the USB receptacle when the special shell is brought into contact with the contact portion.

27. The USB receptacle as recited in claim 26, wherein:

the holding member is formed integrally; and the first contacts, the second contacts, and the detector are press-fitted or insert-molded in the holding member.

28. The USB receptacle as recited in claim 26, wherein the holding member comprises a plurality of members.

29. The USB receptacle as recited in claim 28, wherein:

the plurality of members of the holding member comprise a first member and a second member;

the first contacts are press-fitted or insert-molded in the first member; and the second contacts are press-fitted or insert-molded in the second member.

30. The USB receptacle as recited in claim 29, wherein the detector is press-fitted or insert-molded in the second member.

31. The USB receptacle as recited in claim 28, wherein:

the plurality of members of the holding member comprise a contact-holding member and a detector-holding member, the contact-holding member holding the first contacts and the second contacts, the detector-holding member holding the detector; and the detector is press-fitted or insert-molded in the detector-holding member.

32. The USB receptacle as recited in claim 26, wherein:

the holding member has a plate portion and an arm portion, the plate portion extending forward in the predetermined direction so as to have an upper surface and a lower surface, the arm portion being located apart from the plate portion in a vertical direction perpendicular to the predetermined direction, the arm portion extending in the predetermined direction;

the first contact and the second contact have a first contact part and a second contact part, respectively, the first contact part and the second contact part being located on one of the upper surface and the lower surface of the plate portion; and the detector is held by the arm portion.

33. The USB receptacle as recited in claim 32, wherein:

the detector has, in addition to the contact portion, a fixed portion and a support portion, the fixed portion being fixed to the arm portion, the support portion extending rearward, which is opposite of forward, from the fixed portion in the predetermined direction so as to be resiliently deformable; and the contact portion is supported by the support portion.

34. The USB receptacle as recited in claim 33, wherein:

the shell has a body portion, the body portion enclosing the plate portion in a vertical plane perpendicular to the predetermined direction;

the arm portion is located outside of the body portion in the vertical plane;

the fixed portion and the support portion are located outside of the body portion in the vertical plane; and the contact portion protrudes inside of the body portion in the vertical plane.

35. The USB receptacle as recited in claim 34, wherein:

the arm portion is formed with a ditch portion, the ditch portion corresponding to the support portion; and the support portion is resiliently deformable in the ditch portion.

36. The USB receptacle as recited in claim 32, wherein:

the first contact part and the second contact part are arranged on the upper surface of the plate portion; and the contact portion of the detector is located below the plate portion so as to protrude upward.

37. The USB receptacle as recited in claim 1, wherein:

the USB receptacle is mateable along the predetermined direction with any one of a USB 3.0 plug which is the standard USB plug in accordance with a USB 3.0 standard of the USB standard, a USB 2.0 plug which is the standard USB plug in accordance with a USB 2.0 standard of the USB standard and the special USB plug formed by modifying the USB 2.0 plug or the USB 3.0 plug so as to have the special shell, the USB receptacle comprising:

a plurality of contacts;

a holding member, the holding member holding the contacts;

a shell, the shell being attached to the holding member;

a predetermined space, the predetermined space being formed within the USB receptacle, the predetermined space corresponding to a space, formed within a USB 3.0 receptacle in accordance with the USB 3.0 standard, where the USB 2.0 plug does not arrive when the USB 2.0 plug is mated with the USB 3.0 receptacle; and the detector, the detector being held by the holding member, the detector having the contact portion, the contact portion being arranged in the predetermined space, the contact portion being configured to be brought into contact with the special shell in a mated state in which the USB receptacle is mated with the special shell, the detector being configured to detect that the special USB plug is mated with the USB receptacle when the special shell is brought into contact with the contact portion.

38. The USB receptacle as recited in claim 37, wherein:

the holding member is formed integrally; and the contacts and the detector are press-fitted or insert-molded in the holding member.

39. The USB receptacle as recited in claim 37, wherein the holding member comprises a plurality of members.

40. The USB receptacle as recited in claim 39, wherein:

the plurality of members of the holding member comprise a first member and a second member; and the contacts are press-fitted or insert-molded in the first member.

41. The USB receptacle as recited in claim 40, wherein the detector is press-fitted or insert-molded in the second member.

42. The USB receptacle as recited in claim 37, wherein:

the holding member has a plate portion and an arm portion, the plate portion extending forward in the predetermined direction so as to have an upper surface and a lower surface, the arm portion being located apart from the plate portion in a vertical direction perpendicular to the predetermined direction, the arm portion extending in the predetermined direction;

the contact has a contact part, the contact part being located on one of the upper surface and the lower surface of the plate portion; and the detector is held by the arm portion.

43. The USB receptacle as recited in claim 42, wherein:

the detector has, in addition to the contact portion, a fixed portion and a support portion, the fixed portion being fixed to the arm portion, the support portion extending rearward, which is opposite of forward, from the fixed portion in the predetermined direction so as to be resiliently deformable; and the contact portion is supported by the support portion.

44. The USB receptacle as recited in claim 43, wherein:

the shell has a body portion, the body portion enclosing the plate portion in a vertical plane perpendicular to the predetermined direction;

the arm portion is located outside of the body portion in the vertical plane;

the fixed portion and the support portion are located outside of the body portion in the vertical plane; and the contact portion protrudes inside of the body portion in the vertical plane.

45. The USB receptacle as recited in claim 44, wherein:

the arm portion is formed with a ditch portion, the ditch portion corresponding to the support portion; and the support portion is resiliently deformable in the ditch portion.

46. The USB receptacle as recited in claim 42, wherein:

the contact parts are arranged on the upper surface of the plate portion; and the contact portion of the detector is located below the plate portion so as to protrude upward.

47. The USB receptacle as recited in claim 37, wherein the USB receptacle comprises the two detector.

48. The USB receptacle as recited in claim 37, wherein the detector is gold-plated.

49. The USB receptacle as recited in claim 37, wherein the detector and the shell are arranged so as not to be directly brought into contact with each other.

50. The USB receptacle as recited in claim 37, further comprising a plug detector, the plug detector being configured to detect that one of the USB 3.0 plug, the USB 2.0 plug and the special USB plug is inserted when one of the USB 3.0 plug, the USB 2.0 plug and the special USB plug is mated with the USB receptacle.

51. A special universal serial bus (USB) plug mateable with the USB receptacle as recited in claim 26 in a predetermined direction, the special USB plug comprising:

a special shell, the special shell being configured to be accommodated in the predetermined space when the USB receptacle is mated with the special shell.

52. The special USB plug as recited in claim 51, further comprising a holding member having an end surface in the predetermined direction, wherein:

the special shell has an end surface in the predetermined direction; and the end surface of the holding member of the special USB plug is located at a same position as the end surface of the special shell in the predetermined direction or located rearward of the end surface of the special shell in the predetermined direction.

53. The special USB plug as recited in claim 51, wherein the special shell is gold-plated.

* * * * *